US009670015B2

(12) United States Patent
Hara

(10) Patent No.: US 9,670,015 B2
(45) Date of Patent: Jun. 6, 2017

(54) MEDIUM FEEDING DEVICE AND IMAGE FORMING APPARATUS

(71) Applicant: Oki Data Corporation, Tokyo (JP)

(72) Inventor: Shinjiro Hara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/289,845

(22) Filed: May 29, 2014

(65) Prior Publication Data

US 2014/0353907 A1 Dec. 4, 2014

(30) Foreign Application Priority Data

May 29, 2013 (JP) ..... 2013-112766

(51) Int. Cl.

| | |
|---|---|
| ***B65H 1/04*** | (2006.01) |
| ***B65H 1/26*** | (2006.01) |
| ***B65H 7/06*** | (2006.01) |
| ***B65H 7/14*** | (2006.01) |
| ***B65H 7/02*** | (2006.01) |

(52) U.S. Cl.

CPC ..... *B65H 1/266* (2013.01); *B65H 7/02* (2013.01); *B65H 7/06* (2013.01); *B65H 7/14* (2013.01); *B65H 2301/422* (2013.01); *B65H 2403/53* (2013.01); *B65H 2405/313* (2013.01); *B65H 2511/212* (2013.01); *B65H 2511/24* (2013.01);

(Continued)

(58) Field of Classification Search

CPC ... B65H 7/02; B65H 7/04; B65H 7/14; B65H 2405/31; B65H 2511/152; B65H 2511/515; B65H 2511/52; B65H 2553/41; B65H 2553/412; B65H 2553/60; B65H 2553/61; B65H 2553/80; B65H 2601/1231; B65H 1/12; B65H 1/24; B65H 1/266; G03G 2215/00383; G03G 2215/00725

See application file for complete search history.

(56) References Cited

U.S. PATENT DOCUMENTS 5,564,690 A * 10/1996 Oshida ..... 271/157
5,897,112 A * 4/1999 Kwag ..... G03G 15/6502 271/111

(Continued)

FOREIGN PATENT DOCUMENTS

JP H07-215494 A 8/1995
JP H11-343048 A 12/1999

(Continued)

*Primary Examiner* — Ernesto Suarez
(74) *Attorney, Agent, or Firm* — Muncy, Geissler, Olds & Lowe, P.C.

(57) ABSTRACT

A medium feeding device includes a device body, a tray that regulates and contains a plurality of kinds of media of different sizes in a loading area according to the sizes of the media, and a detection lever that detects whether or not the media are properly loaded in the tray. In a state in which the tray is contained in the device body, when the media are not properly loaded in the tray, the detection lever moves to a non-load detection position. When the media are properly loaded in the tray, the detection lever moves to a load detection position with a front end part being oriented toward the tray containing side, and when a pressing force is applied to the detection lever at the non-load detection position from the tray containing side, the detection lever retreats toward the tray pulling out side.

18 Claims, 18 Drawing Sheets

(52) U.S. Cl.
CPC .. *B65H 2553/412* (2013.01); *B65H 2553/612* (2013.01)

(56) References Cited

U.S. PATENT DOCUMENTS

| | | | | |
|---|---|---|---|---|
| 6,783,026 | B2 * | 8/2004 | Chambers | B65H 7/02 271/265.01 |
| 7,540,492 | B2 * | 6/2009 | Miyazaki | B65H 3/02 271/152 |
| 8,042,801 | B2 * | 10/2011 | You | 271/157 |
| 8,070,153 | B2 * | 12/2011 | Kang | 271/164 |
| 8,282,093 | B2 * | 10/2012 | Sugishima | 271/152 |
| 8,550,459 | B2 * | 10/2013 | Sekiguchi et al. | 271/265.03 |
| 2011/0062660 | A1 * | 3/2011 | Tokuda | 271/265.02 |

FOREIGN PATENT DOCUMENTS

| | | | |
|---|---|---|---|
| JP | 2011-057432 | A | 3/2011 |
| JP | 2011-195294 | A | 10/2011 |

* cited by examiner

0°
d1
a1
b1
c1
121
120
θx1
122
123
126
270°
90°
126E
124
5
67A
Ax1
125
Lx1
Cx
67
180°
CS
PS d1
a1
121
120
b1
c1
122
123
126E
126
125
124
5
67A
67

0°
d1
a1
b1
c1
121
120
122
123
Ax1
126E
270°
90°
124
126
Cx
125
5
67A
67
θx2
180°
CS
PS a1
d1
b1
c1
130E
130B
130D
130C
130A
130

0°
d1
a1
b1
c1
121
122
123
155
θx1
Ax22
270°
90°
161
160
5
67A
Ax21
162
Lx1
Cx
67
180° d1
a1
b1
c1
121
122
123
155
161
160
5
67A
162
67

0°
d1
a1
121
123
155
b1
c1
122
Ax22
160
270°
161
90°
Ax21
162
5
67A
Cx
67
Lx2
θx2
180°
CS
PS

MEDIUM FEEDING DEVICE AND IMAGE FORMING APPARATUS

CROSS REFERENCE TO RELATED APPLICATION

The present application is related to, claims priority from and incorporates by reference Japanese Patent Application No. 2013-112766, filed on May 29, 2013.

TECHNICAL FIELD

The present invention relates to a medium feeding device and an image forming apparatus.

BACKGROUND

Conventionally, as a medium feeding device and an image forming apparatus, for example, there is a printer capable of color printing (hereinafter, this is also referred to as a color printer).

In the conventional color printer, an image forming part that has a plurality of image forming units and the like is provided at a central part of a housing, and a recording sheet feeding part (hereinafter, this is also referred to as a sheet feeding part) that feeds a rectangular recording sheet to the image forming part is provided at a lower part of the case.

In the sheet feeding part, a substantially flat dish-shaped tray (hereinafter, this is also referred to as a sheet feeding tray) for sheet feeding that is capable of loading a plurality of recording sheets in a stacked manner is provided in a manner capable of being pulled out from the housing from a front side of the color printer and being contained in the housing from the front side of the color printer.

A sheet feeding guide part in a projection shape long in a left-right direction is provided at a front end part of the sheet feeding tray. Further, a loading part as a recess part that is long in a front-rear direction and that is surrounded by the sheet feeding guide part, a tray rear plate, left and right tray side plates and a tray bottom plate is provided to the rear of the sheet feeding guide in the sheet feeding tray.

Further, a length of the loading part of the sheet feeding tray in the front-rear direction is selected to be a predetermined length that is longer than a length of a long side of a recording sheet that has a longest long side among recording sheets of a plurality of kinds of sizes such as the A4 size and the B5 size so that any one of the recording sheets of the plurality of kinds of sizes can be loaded in the loading part in a state in which a longitudinal direction of the recording sheets is in parallel to the front-rear direction.

Further, at a rear end part of the tray bottom plate of the sheet feeding tray, a tail guide is provided in a manner moveable in the front-rear direction for defining a loading area of the recording sheet in the loading part with respect to the sheet feeding guide part so that the loading area matches the size of the recording sheet.

Further, near a front side of the loading part of the sheet feeding tray, a placing plate on which one end portions of the recording sheets that are loaded in the loading part is placed is provided in a manner rotatable within a predetermined angle range from a loading position, at which the placing plate is leveled for loading the recording sheets, to a sheet feeding position, at which the placing plate is inclined in a direction parallel to an obliquely forward and upward direction to lift the one end portions of the recording sheets for sheet feeding.

Further, at a predetermined position on an upper side of the sheet feeding tray of the sheet feeding part (that is, on a body of the color printer), a sheet feeding roller is rotatably provided in a state in which a roller shaft of the sheet feeding roller is parallel to the left-right direction.

According to such a configuration of the conventional color printer, when the sheet feeding tray is pulled out from the housing by a user, the placing plate of the sheet feeding tray is rotated to the loading position and is leveled.

Then, by letting the user to suitably adjust a position of the tail guide in the sheet feeding tray, the color printer allows the loading area in the loading part to be defined to match the size of the recording sheets to be loaded.

As a result, the color printer allows a plurality of recording sheets of the same size to be loaded in a stacked state in the loading area that is defined by the user in the loading part of the sheet feeding tray in a manner in which short sides of the recording sheets on a front side are brought into contact with the sheet feeding guide part and are aligned and short sides of the recording sheets on a rear side are brought into contact with the tail guide and are aligned.

Thereafter, when the sheet feeding tray is put in the housing of the color printer by the user, by rotating the placing plate in the sheet feeding tray toward the sheet feeding position side, one end portions of the plurality of the recording sheets that are placed on the placing plate are obliquely lifted.

As a result, among the one end portions of the plurality of the recording sheets that are obliquely lifted in the loading part of the sheet feeding tray of the color printer, an one end portion of a recording sheet that is positioned uppermost is pressed against the sheet feeding roller.

In this way, when a print image is formed, by rotating the sheet feeding roller in the sheet feeding part of the color printer, the plurality of the recording sheets are sequentially fed out one by one from the loading part of the sheet feeding tray toward a front side to be fed to the image forming part (for example, see Japanese Patent Laid-Open Publication No. 2011-195294 (page 4, FIGS. 2 and 3)).

However, in the conventional color printer, a detection lever for detecting presence or absence of loaded recording sheets with respect to the loading part of the sheet feeding tray is provided on an upper side of the sheet feeding tray of the sheet feeding part in a manner rotatable about a rotation shaft in a state in which the rotation shaft that is provided at a base portion of the detection lever is in parallel to the left-right direction.

In this case, although the detection lever rotates so that, for example, a front end part is lowered due to its self weight in a state in which no external force is applied, a rotation regulation part is provided for stopping the rotation at a predetermined rotation regulation position at which the front end part is oriented toward an obliquely rearward and downward side of the rotation shaft.

When the sheet feeding tray is contained in the housing from the front side and when recording sheets of a corresponding size are loaded in the loading area that is defined by the user in the loading part of the sheet feeding tray of the color printer, one end portions of the recording sheets that are lifted by the placing plate are pressed against the front end part of the detection lever from below so that the detection lever is rotated to a position above the rotation regulation position (this is a forward direction).

In this way, when the detection lever is rotated to a position above the rotation regulation position, in response to the rotation, the color printer detects that the recording sheets are loaded in the loading part of the sheet feeding tray.

Further, when an empty sheet feeding tray is erroneously contained in the housing from the front side or when recording sheets are all fed out from the loading part so that the sheet feeding tray contained in the case becomes empty, the color printer rotates the detection lever to the rotation regulation position and stops the rotation.

In this way, when the detection lever rotates to the rotation regulation position, in response to the rotation, the color printer detects that the sheet feeding tray is empty.

When the color printer detects via the detection lever that the sheet feeding tray is empty, the color printer notifies a user about the detection via a display, a speaker, and the like, to prompt the user to load recording sheets in the loading part of the sheet feeding tray.

Conventionally, a movement of the detection lever is sensed by a sensor. When positioned at the rotation regulation position, the sensor detects a part of the detection lever (sense target part), determines that there is no sheet loaded. On the other hand, when the detection lever is lifted by sheets that are loaded, the sense target part rotates in the forward direction from the rotation regulation position together with the detection lever. As the result, the sensor no longer senses the sense target part, determining that sheets are loaded. Herein, it is preferred to design the sense target part to be sensed by the sensor as small as possible in a light of device downsizing. On the other hand, in order to securely detect such a downsized sense target part, the detection lever is required to be located at an identical position at every movement. Considering these matters, conventional detection levers are configured to be allowed to rotate in the forward direction, but not to rotate in the reverse direction.

In the conventional medium feeding device and the image forming apparatus, for example, when the sheet feeding tray is contained in the housing from the front side and when a plurality of recording sheets of a size smaller than a corresponding size are erroneously loaded, in a manner shifted toward the tray rear plate, in the loading area that is defined by the user in the loading part of the sheet feeding tray, one end portions of the plurality of the recording sheets that are lifted by the placing plate are positioned behind the front end part of the detection lever.

As a result, in the medium feeding device and the image forming apparatus, the detection lever cannot be rotated rotation regulation position toward an upper side by the one end portions of the recording sheets that are lifted by the placing plate, so that is detected that recording sheets are not loaded in the sheet feeding tray and the user is notified that the sheet feeding tray is empty.

Then, in the medium feeding device and the image forming apparatus, there is a problem that, when the user is notified that the sheet feeding tray is empty, as described above, and the sheet feeding tray is pulled out from the housing toward the front side by the user, one end portions of the recording sheets in the sheet feeding tray are caught by the detection lever and the recording sheets are damaged. That is because the conventional detection levers are not allowed to rotates in the reverse direction.

The present invention is made by considering the above problem and is intended to propose a medium feeding device and an image forming apparatus that are capable of preventing damage to a medium when a tray is pulled out.

SUMMARY

In order to resolve the above subjects, the invention includes a medium feeding device including: a device body; a tray that is provided in a manner capable of being pulled out from and contained in the device body, and in which a plurality of kinds of media of different sizes are loaded in a loading area according to the sizes of the media; and a detection lever that is provide in a moveable manner above an end part on a tray pulling out side of the tray in the device body for detecting whether or not the media are properly loaded in the tray Wherein, in a state in which the tray is contained in the device body, when the media are not properly loaded in the tray, with a front end part being oriented toward a tray containing side of the tray, the detection lever moves to a non-load detection position that is on a lower side for detecting that the media are not properly loaded in the tray; when the media are properly loaded in the tray, with a front end part being oriented toward the tray containing side, the detection lever moves to a load detection position that is on an upper side for detecting that the media are properly loaded in the tray; and when a pressing force is applied to the detection lever at the non-load detection position from the tray containing side, the detection lever retreats toward the tray pulling out side.

According to the present invention, when a plurality of media are loaded at a tray in a manner that the media is shifted toward a tray containing side, the detection lever is moved to the non-load detection position. The sensor detects that the media are not properly loaded in the tray. When the tray is pulled out in this state, the detection lever can retreat toward the tray pulling out side in correspondence with a pushing force by the media moving with the tray toward the tray pulling out side from the tray containing side.

Also, one feature of the invention is that the detection lever and the sense target part are structurally configured in different parts, allowed them to independently rotate. Specifically, the detection lever rotates not only between the non-load detection position and load detection position but also from the non-load detection position to the retreat position that is in the reverse direction from the non-load detection position. Meanwhile, the sense target part synchronously rotates with the detection lever in a range between the non-load detection position and the load detection position. However, when the detection lever moves from the non-load detection position to the retreat position, the sense target part does not synchronize the detection lever, remaining at the non-load detection position. Thereby, it is realized to prevent from damaging the detection lever and/or the loaded sheets. Further, the sensor is able to maintain a sensing level that there is no sheet loaded. In the specification, the above "rotation regulation position" may be used as "non-load detection position." When an optical sensor is used for sensing a movement of the detection lever, the sense target part is embodied by a light blocking part that plays a role to block the sensing light.

In the invention, a phase, "a state where media are properly loaded," means that a state where a predetermined sized sheets are loaded. Specifically, shown in FIGS. 8 and 16, in such a state, the lever body is lifted by the sheets. Meanwhile, another phase, "a state where media are not properly loaded," means that a state where the lever body does not contact the media. Specifically, the phase is applied to a state where there is no sheet loaded as shown in FIGS. 9 and 17 or a state where sheets are loaded but the lever body and the sheets are not in contact because the size of the sheets are too small as shown in FIGS. 10A and 18A. Further, the phase may include a state where even though in contact with, the lever body is not lifted enough by the sheets.

BRIEF DESCRIPTION OF THE DRAWINGS

FIG. 10A shows the non-load detection position. FIG. 10C shows the retreat position. FIG. 10B shows a progress in which the lever moves from the non-load detection position toward the retreat position. FIG. 10A shows a state where the sheets are loaded but the detection lever remains at the non-load detection position because the detection lever and sheet are not in contact.

FIG. 18A shows the non-load detection position. FIG. 18C shows the retreat position.

DETAILED DESCRIPTION OF EMBODIMENTS

With reference to the drawings, best modes (hereinafter, these are also referred to as embodiments) for carrying out the invention are described. The description will be made in the following order: (1) a first embodiment, (2) a second embodiment, and (3) other embodiments.

(1) First Embodiment

(1-1) Internal Configuration of Color Printer

Figure 1:
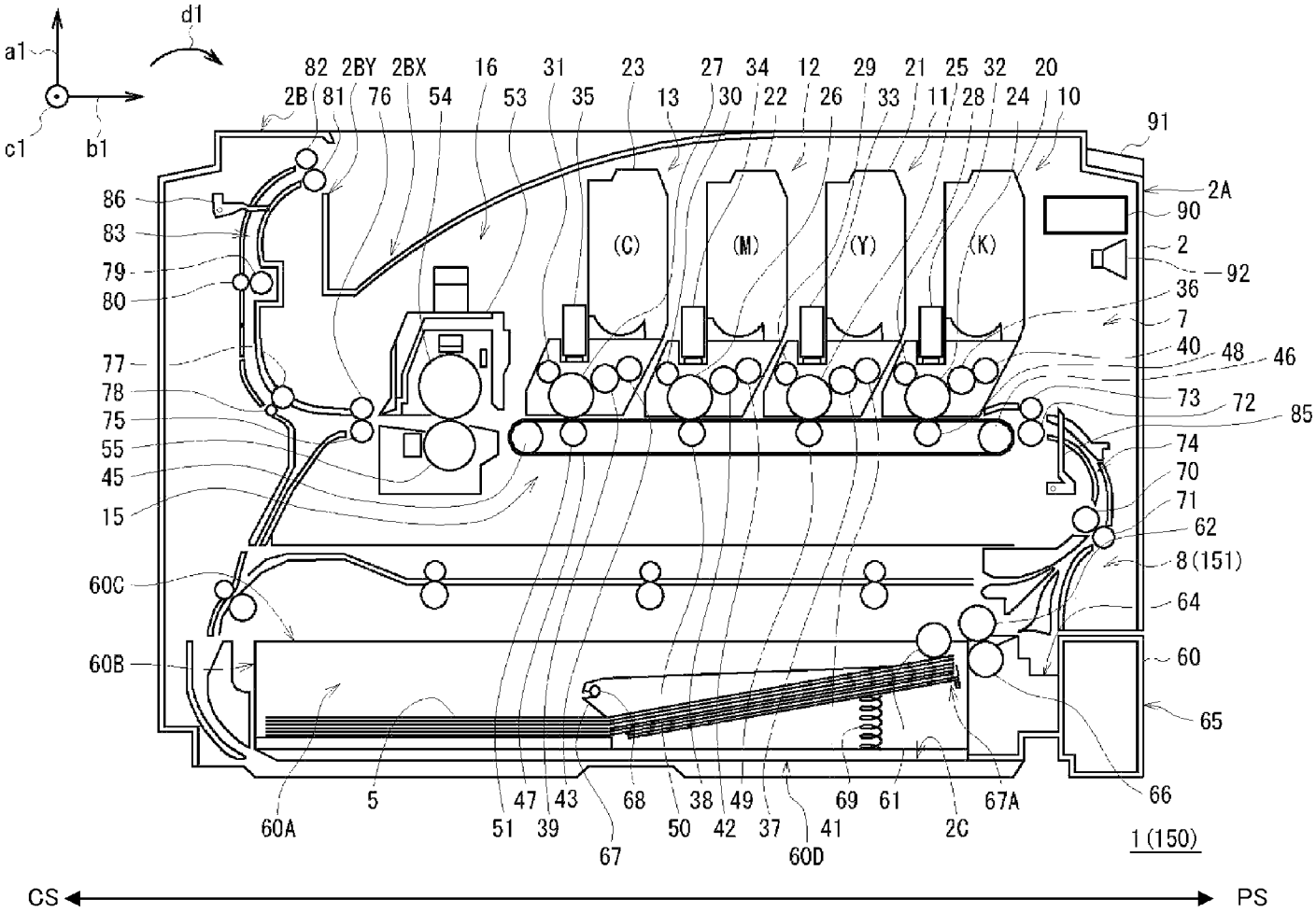
FIG. 1 illustrates a schematic cross-sectional view of an internal configuration of a color printer according to a first embodiment. In the invention, a left side of the sheet (minus/negative b1) is determined as a containing side (CS), a right side of the sheet (plus/positive b1) is as a pulling out side (PS). An upper side means a plus side of a1 and an lower side means a minus side of a1 in the drawing.

In FIG. 1, a reference numeral symbol 1 indicates as a whole a color printer according to a first embodiment. The color printer 1 has, for example, a substantially box-shaped housing (hereinafter, this is also referred to as a printer housing in the following) 2.

In the following description, an upward direction of the color printer 1 as indicated by an arrow a1 in FIG. 1 when the color printer 1 is viewed from a direction opposing a front surface 2A of the printer housing 2 is also referred to as a printer upward direction, and a direction opposite to the printer upward direction is also referred to as a printer downward direction.

In the following description, when it is not necessary to particularly distinguish between the printer upward direction and the printer downward direction, they may also be collectively referred to as a printer up-down direction.

Further, in the following description, a frontward direction of the color printer 1 as indicated by an arrow b1 in FIG. 1 when the color printer 1 is viewed from the direction opposing the front surface 2A of the printer housing 2 is also referred to as a printer frontward direction, and a direction opposite to the printer frontward direction is also referred to as a printer rearward direction.

In the following description, when it is not necessary to particularly distinguish between the printer frontward direction and the printer rearward direction, they may also be collectively referred to as a printer front-rear direction.

Further, in the following description, a leftward direction of the color printer 1 as indicated by an arrow c1 in FIG. 1 when the color printer 1 is viewed from the direction opposing the front surface 2A of the printer housing 2 is also referred to as a printer leftward direction, and a direction opposite to the printer leftward direction is also referred to as a printer rightward direction.

In the following description, when it is not necessary to particularly distinguish between the printer leftward direction and the printer rightward direction, they may also be collectively referred to as a printer left-right direction.

On a rear end part of an upper surface 2B of the printer housing 2, a recording sheet delivery part 2BX in a recessed shape is formed for placing thereon a rectangular recording sheet 5, on which a print image is formed, to be delivered to a user.

Further, at a predetermined position on a rear inner wall of the recording sheet delivery part 2BX of the printer housing 2, a recording sheet ejection port 2BY is formed for ejecting the recording sheet 5, on which the print image is formed, from inside the printer housing 2 to the recording sheet delivery part 2BX.

On the other hand, at a central part inside the printer housing 2, an image forming part 7 is provided for forming a print image by printing a print target color image on a surface of the recording sheet 5.

Further, at a lower end part inside the printer housing 2, a recording sheet feeding part (hereinafter, this is also referred to as a sheet feeding part) 8 is provided for feeding (that is, sheet feeding) the recording sheet 5 to the image forming part 7 for forming the print image.

The image forming part 7 has four image forming units 10-13 corresponding to four colors including black (K), yellow (Y), magenta (M) and cyan (C).

That is, the image forming part 7 has four image forming units 10-13 that use toners of four colors including black (K), yellow (Y), magenta (M) and cyan (C) to each form a toner image with one color without duplicating.

In the following description, the image forming unit 10 corresponding to black (K) is also referred to as a first image forming unit 10, and the image forming unit 11 corresponding to yellow (Y) is also referred to as a second image forming unit 11.

Further, in the following description, the image forming unit 12 corresponding to magenta (M) is also referred to as a third image forming unit 12, and the image forming unit 13 corresponding to cyan (C) is also referred to as a fourth image forming unit 13.

Further, the image forming part 7 also has a transfer part 15 for transferring the toner images of four colors (that is, black, yellow, magenta and cyan) that are formed by the first-fourth image forming units 10-13 to the surface of the recording sheet 5 by sequentially superimposing the toner images while carrying the recording sheet 5, for example, from a front side to a rear side.

Further, the image forming part 7 has a fuser 16 for forming a print image on the surface of the recording sheet 5 by fusing the toner images of the four colors that are transferred by the transfer part 15.

The first-fourth image forming units 10-13 are arranged at equal intervals from a front side to a rear side (that is, from an upstream side to a downstream side in a carrying direction when the recording sheet 5 is carried by the transfer part 15) in the order of the first image forming unit 10, the second image forming unit 11, the third image forming unit 12 and the fourth image forming unit 13.

Further, the first-fourth image forming units 10-13 are similarly configured except that they each use a mutually different single color toner for the formation of the toner image.

That is, in the first-fourth image forming units 10-13, toner cartridges 20-23 that respectively contain toners of corresponding colors are removably provided.

Further, in the first-fourth image forming units 10-13, photosensitive drums 24-27 (hereinafter, these are also referred to as first-fourth photosensitive drums 24-27 to correspond to the names of the first-fourth image forming units 10-13) are provided each rotatable in a forward rotation direction indicated by an arrow d1 in the drawing about a drum rotation shaft parallel to the printer left-right direction.

The drum rotation shafts of the first-fourth photosensitive drums 24-27 of the first-fourth image forming units 10-13 are linked via a plurality of gears (not illustrated in the drawings) to an output shaft of one unit drive motor (not illustrated in the drawings) that is provided in the printer housing 2.

As a result, in the first-fourth image forming units 10-13, during the formation of the print image, in response to the operation of the unit drive motor, the first-fourth photosensitive drums 24-27 can be rotated about the respective drum rotation shafts in the forward rotation direction.

Further, in the first-fourth image forming units 10-13, charging rollers 28-31 (hereinafter, these are also referred to as first-fourth charging rollers 28-31 to correspond to the names of the first-fourth image forming units 10-13) for charging surfaces of the respective first-fourth photosensitive drums 24-27 are provided each rotatable in the backward rotation direction that is opposite to the forward rotation direction about a roller rotation shaft parallel to the printer left-right direction.

The roller rotation shafts of the first-fourth charging rollers 28-31 of the first-fourth image forming units 10-13 are respectively linked via an even number of gears (not illustrated in the drawings) to the drum rotation shafts of the first-fourth photosensitive drums 24-27.

Therefore, in the first-fourth image forming units 10-13, during the formation of the print image, in conjunction with the rotation of the first-fourth photosensitive drums 24-27 in the forward rotation direction, the first-fourth charging rollers 28-31 can be rotated in the backward rotation direction about the roller rotation shafts for charging the surfaces of the first-fourth photosensitive drums 24-27.

The respective first-fourth charging rollers 28-31 of the first-fourth image forming units 10-13 are electrically connected to a predetermined charging roller voltage source (not illustrated in the drawings) that is provided in the printer housing 2.

As a result, in the first-fourth image forming units 10-13, during the formation of the print image, due to the first-fourth charging rollers 28-31, in response to application of a DC voltage from the charging roller voltage source, the surfaces of the first-fourth photosensitive drums 24-27 can be charged, via the first-fourth charging rollers 28-31, to a state in which an electrostatic latent image can be formed.

Further, in the first-fourth image forming units 10-13, exposure heads 32-35 (hereinafter, these are also referred to as first-fourth exposure heads to correspond to the names of the first-fourth image forming units 10-13) are provided having, for example, a plurality of LED elements and lens arrays for exposing charged portions of the surfaces of the respective first-fourth photosensitive drums 24-27 to form electrostatic latent images.

Further, in the first-fourth image forming units 10-13, development rollers 36-39 (hereinafter, these are also referred to as first-fourth development rollers 36-39 to correspond to the names of the first-fourth image forming units 10-13) for transferring (attaching) toners to the electrostatic latent images on the surfaces of the respective first-fourth photosensitive drums 24-27 to develop the electrostatic latent images (that is, to form toner images by visualizing the electrostatic latent images with the toners) are provided each rotatable in the backward rotation direction about a roller rotation shaft parallel to the printer left-right direction.

The roller rotation shafts of the first-fourth development rollers 36-39 of the first-fourth image forming units 10-13 are respectively linked via an even number of gears (not illustrated in the drawings) to the drum rotation shafts of the first-fourth photosensitive drums 24-27.

Therefore, in the first-fourth image forming units 10-13, during the formation of the print image, in conjunction with the rotation of the first-fourth photosensitive drums 24-27 in the forward rotation direction, the first-fourth development rollers 36-39 can be rotated in the backward rotation direction about the roller rotation shafts for developing the electrostatic latent images.

The respective first-fourth development rollers 36-39 of the first-fourth image forming units 10-13 are electrically connected to a predetermined development roller voltage source (not illustrated in the drawings) that is provided in the printer housing 2.

As a result, in the first-fourth image forming units 10-13, during the formation of the print image, due to the first-fourth development rollers 36-39, in response to application of a DC voltage from the development roller voltage source, while toners are carried on surfaces of the first-fourth development rollers 36-39, the toners can be transferred (attached) to the electrostatic latent images on the surfaces of the first-fourth photosensitive drums 24-27 to develop the electrostatic latent images.

Further, in the first-fourth image forming units 10-13, supply rollers 40-43 (hereinafter, these are also referred to as first-fourth supply rollers 40-43 to correspond to the names of the first-fourth image forming units 10-13) for supplying toners to the surfaces of the respective first-fourth development rollers 36-39 are provided each rotatable in the backward rotation direction about a roller rotation shaft parallel to the printer left-right direction.

The roller rotation shafts of the first-fourth supply rollers 40-43 of the first-fourth image forming units 10-13 are respectively linked via an odd number of gears (not illustrated in the drawings) to the roller rotation shafts of the first-fourth development rollers 36-39.

Therefore, in the first-fourth image forming units 10-13, during the formation of the print image, in conjunction with the rotation of the first-fourth development rollers 36-39 in the backward rotation direction, the first-fourth supply rollers 40-43 can be rotated in the backward rotation direction about the roller rotation shafts.

The respective first-fourth supply rollers 40-43 of the first-fourth image forming units 10-13 are electrically connected to a predetermined supply roller voltage source (not illustrated in the drawings) that is provided in the printer housing 2.

As a result, in the first-fourth image forming units 10-13, during the formation of the print image, due to the first-fourth supply rollers 40-43, in response to application of a DC voltage from the supply roller voltage source, toners can be supplied to the first-fourth development rollers 36-39.

The transfer part 15 is arranged at a central part in the printer housing 2 extending from below the first image forming unit 10 to vicinity below the fourth image forming unit 13.

That is, in the transfer part 15, on an obliquely rearward and downward side of the fourth image forming unit 13, a drive roller 45 is provided rotatable in the backward rotation direction about a roller rotation shaft parallel to the printer left-right direction.

Further, in the transfer part 15, below the first image forming unit 10, a tension roller 46 is provided rotatable in the backward rotation direction about a roller rotation shaft parallel to the printer left-right direction.

Further, in the transfer part 15, an endless carrying belt (hereinafter, this is also referred to as a transfer belt) 47 is stretched from the drive roller 45 to the tension roller 46 for electrostatically adsorbing the recording sheet 5 for transferring the toner images.

As a result, in the transfer part 15, four places on a surface of a flat portion on an upper side (hereinafter, this is also referred to as an upper side flat portion), which is one of a pair of flat portions of the transfer belt 47 between the drive roller 45 and the tension roller 46, are brought in contact with the surfaces of the first-fourth photosensitive drums 24-27 for transferring the toner images to the surface of the recording sheet 5.

In the following description, the four places on the surface of the upper side flat portion of the transfer belt 47 that are in contact with the surfaces of the first-fourth photosensitive drums 24-27 are also referred to as first-fourth transfer execution positions to correspond to the names of the first-fourth photosensitive drums 24-27.

The roller rotation shaft of the drive roller 45 of the transfer part 15 is linked via a plurality of gears (not illustrated in the drawings) to an output shaft of one transfer part drive motor (not illustrated in the drawings) that is provided in the printer housing 2.

Therefore, in the transfer part 15, during the formation of the print image, in response to the operation of the transfer part drive motor, the drive roller 45 can be rotated in the backward rotation direction about the roller rotation shaft and, in conjunction with the rotation of the drive roller 45, the tension roller 46 and the transfer belt 47 can also be rotated in the backward rotation direction.

Further, on an inner side of the transfer belt 47, four transfer rollers 48-51 (hereinafter, these are also referred to as first-fourth transfer rollers 48-51 to correspond to the names of the first-fourth photosensitive drums 24-27) corresponding to the first-fourth photosensitive drums 24-27 are provided each rotatable in the backward rotation direction about a roller rotation shaft parallel to the printer left-right direction.

As a result, in the transfer part 15, surfaces of the first-fourth transfer rollers 48-51 are pressed against the surfaces of the first-fourth photosensitive drums 24-27 via the corresponding first-fourth transfer execution positions of the upper side flat portion of the transfer belt 47.

The first-fourth transfer rollers 48-51 are respectively electrically connected to a predetermined transfer roller voltage source that is provided in the printer housing 2.

As a result, in the transfer part 15, during the formation of the print image, while the recording sheet 5 is carried by being sequentially sandwiched between the upper side flat portion of the transfer belt 47 and the first-fourth photosensitive drums 24-27 of the first-fourth image forming units 10-13, due to the first-fourth transfer rollers 48-51, in response to application of a DC voltage from the transfer roller voltage source, the toner images on the surfaces of the first-fourth photosensitive drums 24-27 can be transferred to the surface of the recording sheet 5.

The fuser 16 is arranged on a rear side of the fourth image forming unit 13 and the transfer part 15, near a rear end of the central part in the printer housing 2.

Specifically, the fuser 16 has a substantially box-shaped fuser case 53 in which a recording sheet passage is formed at a central part for letting the recording sheet 5 pass through, and the fuser case 53 is arranged in such a manner that one opening of the recording sheet passage (hereinafter, this opening is also referred to as a recording sheet inlet) is oriented toward the front side and the other opening of the recording sheet passage (hereinafter, this opening is also referred to as a recording sheet outlet) is oriented toward the rear side.

Further, in the fuser case 53, at an upper end portion, a cylindrical heat generation roller 54 is provided rotatable in the forward rotation direction about a roller rotation shaft parallel to the printer left-right direction in a state in which a portion of a surface of the heat generation roller 54 enters the recording sheet passage.

The roller rotation shaft of the heat generation roller 54 of the fuser 16 is linked via a plurality of gears to an output shaft of a fuser drive motor (not illustrated in the drawings) that is provided in the printer housing 2.

As a result, in the fuser 16, during the formation of the print image, in response to the operation of the fuser drive motor, the heat generation roller 54 can be rotated in the forward rotation direction about the roller rotation shaft.

Further, in the fuser case 53, at a lower end portion, a pressure application roller 55 is provided rotatable in the backward rotation direction about a roller rotation shaft parallel to the printer left-right direction in a state in which a surface of the pressure application roller 55 is pressed with a predetermined pressure against the surface of the heat generation roller 54.

The roller rotation shaft of the pressure application roller 55 of the fuser 16 is linked via an even number of gears (not illustrated in the drawings) to the roller rotation shaft of the heat generation roller 54.

As a result, in the fuser 16, during the formation of the print image, with the surface of the pressure application roller 55 being pressed with the predetermined pressure against the surface of the heat generation roller 54, in conjunction with the rotation of the heat generation roller 54 in the forward rotation direction, the pressure application roller 55 can be rotated in the backward rotation direction about the roller rotation shaft.

A heat application heater (not illustrated in the drawings) is arranged inside the heat generation roller 54. The heat application heater is electrically connected to a predetermined heater voltage source. During the formation of the print image, a predetermined voltage for heat application is applied to the heat application heater by the heater voltage source to generate heat and, thereby, the heat generation roller 54 is heated and the surface of the heat generation roller 54 is heated to a predetermined temperature.

As a result, in the fuser 16, during the formation of the print image, the recording sheet 5, onto the surface of which the toner images have been transferred, can be heated and pressurized while being carried in a manner being sandwiched between the heat generation roller 54 and the pressure application roller 55 that rotate in mutually opposite directions, and the toner images can be fused onto the surface of the recording sheet 5.

On the other hand, the sheet feeding part 8 has a tray 60 for sheet feeding (hereinafter, this is also referred to as a sheet feeding tray 60) and a tray container 2C. The sheet feeding tray 60 has, for example, a substantially rectangular flat dish shape, in which a depth is longer than a width, and is capable of loading a plurality of recording sheets 5. The tray container 2C is provided near a lower end of the printer housing 2 for containing the sheet feeding tray 60.

In the following description, in the sheet feeding tray 60, a direction along the width of the sheet feeding tray 60 is also referred to as a tray width direction, and a direction along the depth of the sheet feeding tray 60 is also referred to as a tray depth direction.

Further, the sheet feeding part 8 has a feeding-out roller 61 for feeding out the recording sheet 5 from the sheet feeding tray 60 for sheet feeding toward the image forming part 7 on a downstream side, and also a sheet feeding roller 62 for feeding the recording sheet 5, which is fed out from the sheet feeding 60 by the feeding-out roller 61 tray, toward the image forming part 7 side.

The sheet feeding tray 60 is provided in a manner that, in an orientation in which, with respect to the printer housing 2, the tray depth direction is parallel to the printer front-rear direction and the tray width direction is parallel to the printer left-right direction, the sheet feeding tray 60 can be pulled out from the tray container 2C to the front side of the color printer 1 and can be contained in the tray container 2C by pushing the sheet feeding tray 60 from the front side of the color printer 1 into the tray container 2C.

In the following description, the front side that is the side to which the sheet feeding tray 60 is pulled out from the tray container 2C of the printer housing 2 is also referred to, as appropriate, as a tray pulling out side, and the rear side that is the side where the sheet feeding tray 60 is contained in the tray container 2C of the printer housing 2 is also referred to, as appropriate, as a tray containing side.

In the sheet feeding tray 60, on a front end part that is one end part in the tray depth direction, a sheet feeding guide part 64 of a substantially projection shape long in the tray width direction is provided, and, in front of the sheet feeding guide part 64, an external part 65 long in the tray width direction is provided.

Further, in the sheet feeding tray 60, on a rear end part that is the other end part in the tray depth direction, a loading part 60A is formed as a recess part in a substantially rectangular shape long in the tray depth direction for loading the recording sheets 5 in a manner that a longitudinal direction of the recording sheets 5 is parallel to the tray depth direction.

That is, in the sheet feeding tray 60, behind the sheet feeding guide part 64, the loading part 60A for loading the recording sheets 5 is formed surrounded by the sheet feeding guide part 64, a tray rear plate 60B, a tray left side plate 60E, a tray right side plate 60C and a tray bottom plate 60D.

Further, the sheet feeding roller 62, for example, has a predetermined width shorter than that of the sheet feeding tray 60, and is provided at a predetermined position, such as a position close from an upper side to a central part of the sheet feeding guide part 64 in the printer housing 2, in a manner rotatable in the backward rotation direction about a roller rotation shaft parallel to the printer left-right direction (that is, also parallel to the tray width direction).

Further, the sheet feeding part 8 has a sheet feeding motor (not illustrated in the drawings) that is provided in the printer housing 2 for driving the sheet feeding roller 62, and an output shaft of the sheet feeding motor is linked via a plurality of gears (not illustrated in the drawings), a pair of pulleys, a belt (not illustrated in the drawings) stretched over the pulleys, and the like.

As a result, in the sheet feeding part 8, during the formation of the print image, in response to the operation of the sheet feeding motor, the sheet feeding roller 62 can be rotated in the backward rotation direction about the roller rotation shaft.

Further, the feeding-out roller 61, for example, has a width substantially equal to that of the sheet feeding roller 62, and is provided at a predetermined position opposing a front end part of the tray bottom plate 60D on a rear side of the sheet feeding roller 62 in the printer housing 2, in a manner rotatable in the backward rotation direction about a roller rotation shaft parallel to the printer left-right direction (that is, also parallel to the tray width direction).

The feeding-out roller 61 is linked via an odd number of gears (to be described later) to the roller rotation shaft of the sheet feeding roller 62.

Therefore, in the sheet feeding part 8, during the formation of the print image, in conjunction with the rotation of the sheet feeding roller 62 in the backward rotation direction, the feeding-out roller 61 can be rotated in the backward rotation direction about the roller rotation shaft.

However, in the sheet feeding tray 60, a separation roller 66 is fixedly provided on the sheet feeding guide part 64, for example, in a manner that an upper side portion of a surface of the separation roller 66 is pressed against a lower side portion of a surface of the sheet feeding roller 62 when the sheet feeding tray 60 is contained in the tray container 2C in a manner that a roller shaft of the separation roller 66 is parallel to the tray width direction.

Further, the sheet feeding tray 60 has a lifting part 67 for lifting at least a portion of the recording sheet 5 for feeding out the recording sheet 5 loaded in the loading part 60A.

The lifting part 67 is formed, for example, in a substantially U-shape by perpendicularly providing a left side plate and a right side plate on a left edge and a right edge of a placing plate 67A on which one short side portion of the recording sheet 5 is placed. Further, on the lifting part 67, at rear corner portions of the left side plate and the right side plate, shaft engagement parts in cutout shapes are respectively formed.

Further, in the sheet feeding tray 60, at predetermined mutually opposing positions on central part s of the tray left side plate 60E and the tray right side plate 60C, a pair of lifting rotation shafts 68 are perpendicularly provided.

Further, in the sheet feeding tray 60, in a state in which the placing plate 67A of the lifting part 67 is positioned near a front end of the tray bottom plate 60D, the pair of the lifting rotation shafts 68 are engaged with the left and right shaft engagement parts of the lifting part 67 by being inserted thereinto.

As a result, in the sheet feeding tray 60, the lifting part 67 is provided in the loading part 60A in a manner rotatable in the forward rotation direction and the backward rotation direction about the left and right lifting rotation shafts 68 within a predetermined angle range from a position at which the lifting part 67 puts the placing plate 67A parallel to the front end part of the tray bottom plate 60D to a position at which the placing plate 67A is inclined parallel to an obliquely forward and upward direction.

In the sheet feeding tray 60, among various positions that are possible due to the rotation of the lifting part 67, the position at which the placing plate 67A is put parallel to the front end part of the tray bottom plate 60D by rotating as much as possible in the forward rotation direction within the predetermined angle range is a position when the recording sheets 5 are loaded in the loading part 60A of the sheet feeding tray 60 as will described later.

Therefore, in the following description, the position at which the placing plate 67A is put parallel to the front end part of the tray bottom plate 60D when the lifting part 67 is rotated as much as possible in the forward rotation direction within the predetermined angle range is also referred to as a loading position.

Further, in the sheet feeding tray 60, among the various positions that are possible due to the rotation of the lifting part 67, a position at which the placing plate 67A is inclined parallel to an obliquely forward and upward direction by rotating from the loading position in the backward rotation direction is a position at which the loading part 60A of the sheet feeding tray 60 in the printer housing 2 is lifted for feeding out the recording sheet 5 from the loading part 60A (that is, for sheet feeding) as will be described later.

Therefore, in the following description, the position at which the placing plate 67A is inclined parallel to an obliquely forward and upward direction when the lifting part 67 has been rotated from the loading position in the backward rotation direction is also referred to as a lifted position.

In the sheet feeding tray 60, a lifted position at which the placing plate 67A is inclined parallel to an obliquely forward and upward direction when the lifting part 67 has been rotated as much as possible within the predetermined angle range in the backward rotation direction is an upper limit position for lifting the loading part 60A of the sheet feeding tray 60 in the printer housing 2 for feeding out the recording sheet 5 from the loading part 60A.

Therefore, in the following description, the lifted position at which the placing plate 67A is inclined parallel to an obliquely forward and upward direction when the lifting part 67 has been rotated as much as possible within the predetermined angle range in the backward rotation direction is also particularly referred to as a lifting upper limit position in order to be distinguished from other lifted positions.

Further, in the sheet feeding tray 60, for example, a compression coil spring 69 is provided between the tray bottom plate 60D and the placing plate 67A of the lifting part 67 and, due to the compression coil spring 69, the lifting part 67 is biased to rotate in the backward rotation direction.

Further, in the sheet feeding tray 60, a predetermined lock part (not illustrated in the drawings) is provided, for example, in the sheet feeding guide part 64 for locking the lifting part 67 in the loading position.

Therefore, in the sheet feeding part 8, as will be described later, when the sheet feeding tray 60 is pulled out from the tray container 2C of the printer housing 2, by compressing the compression coil spring 69, the lifting part 67 is rotated to the loading position in forward rotation direction and is locked by the lock part.

As a result, in a state in which the sheet feeding tray 60 is pulled out from the tray container 2C of the printer housing 2, a plurality of the recording sheets 5 can be aligned and loaded in a stacked state in the loading part 60A.

In the sheet feeding tray 60, by loading the plurality of the recording sheets 5 in the loading part 60A as described above, one end portions, that is, short side portions on the front side, of the plurality of the recording sheets 5 are placed on the placing plate 67A of the lifting part 67.

In this state, in the sheet feeding part 8, when the sheet feeding tray 60 is contained in the tray container 2C of the printer housing 2 by being pushed thereinto, the lock of the lifting part 67 due to the lock part is released by a lock release mechanism (not illustrated in the drawings) that is provided at a predetermined position in the printer housing 2.

Therefore, in the sheet feeding part 8, due to a decompression action of the compression coil spring 69 in the sheet feeding tray 60, the lifting part 67 is rotated from the loading position in the backward rotation direction and is moved to a lifted position.

As a result, in the sheet feeding part 8, the one end portions of the plurality of the recording sheets 5 are lifted by the placing plate 67A of the lifting part 67 in the sheet feeding tray 60 and are inclined parallel to an obliquely forward and upward direction, and the one end portion of the recording sheet 5 that is positioned uppermost among the plurality of the recording sheets 5 is pressed against the feeding-out roller 61.

In addition, in the printer housing 2, at a predetermined position obliquely upward to the front of the sheet feeding roller 62, a pair of recording sheet carrying rollers 70, 71 for carrying the recording sheet 5 by sandwiching the recording sheet 5 between opposing surfaces of the recording sheet carrying rollers 70, 71 are respectively provided rotatable in mutually opposite directions in the forward rotation direction and the backward rotation direction about roller rotation shafts parallel to the printer left-right direction. The forward rotation direction is referred to "d1" through the drawings, which means a rotational direction around the c1 axis.

Further, in the printer housing 2, also in front of transfer part 15, at a position obliquely upward to the rear of the pair of recording sheet carrying rollers 70, 71, a pair of recording sheet carrying rollers 72, 73 for carrying the recording sheet 5 by sandwiching the recording sheet 5 between opposing surfaces of the recording sheet carrying rollers 72, 73 are respectively provided rotatable in mutually opposite directions in the forward rotation direction and the backward rotation direction about roller rotation shafts parallel to the printer left-right direction.

Further, in the printer housing 2, in a region extending from a vicinity of the arrangement position of the sheet feeding roller 62 across the arrangement position of the pair of the recording sheet carrying rollers 70, 71 to a vicinity of the arrangement position of the pair of the recording sheet carrying rollers 72, 73, various kinds of carrying path formation parts such as a plurality of carrying guides are suitably arranged.

As a result, in the printer housing 2, at a lower front end part, by the sheet feeding roller 62, the plurality of the pairs of the recording sheet carrying rollers 70-73, the sheet feeding guide part 64 of the sheet feeding tray 60 and the carrying path formation parts, a sheet feeding carrying path 74 is formed for carrying the recording sheet 5 from the sheet feeding tray 60 to the transfer part 15 for forming a print image (that is, for printing).

Further, in the printer housing 2, also at a predetermined position to the fuser 16, a pair of recording sheet carrying rollers 75, 76 for carrying the recording sheet 5 by sandwiching the recording sheet 5 between opposing surfaces of the recording sheet carrying rollers 75, 76 are respectively provided rotatable in mutually opposite directions in the forward rotation direction and the backward rotation direction about roller rotation shafts parallel to the printer left-right direction.

Further, in the printer housing 2, in a region extending from the pair of the recording sheet carrying rollers 75, 76 to a vicinity of the recording sheet ejection port 2BY, a plurality of pairs of recording sheet ejection rollers 77-82, for carrying the recording sheet 5 for ejection from the recording sheet ejection port 2BY by sequentially sandwiching the recording sheet 5 between opposing surfaces of the pairs of the recording sheet ejection rollers 77-82, are provided in a manner that each pair of the pairs of the recording sheet ejection rollers 77-82 are rotatable in mutually opposite directions in the forward rotation direction and the backward rotation direction about roller rotation shafts parallel to the printer left-right direction.

Further, in the printer housing 2, in a region extending from a vicinity of the arrangement position of the pair of the recording sheet carrying rollers 75, 76 across the arrangement positions of the plurality of the pair of the recording sheet carrying rollers 77-80 to a vicinity of the arrangement position of the pair of the recording sheet carrying rollers 81, 82 in a vicinity of the recording sheet ejection port 2BY, various kinds of carrying path formation parts such as a plurality of carrying guides are suitably arranged.

As a result, in the printer housing 2, at a rear end part, by the pair of the recording sheet carrying rollers 75, 76, the plurality of the pairs of the recording sheet ejection rollers 77-82 and the carrying path formation parts, an ejection carrying path 83 is formed for carrying the recording sheet 5 from the recording sheet outlet of the fuser 16 to the recording sheet ejection port 2BY of the printer housing 2 to eject the recording sheet 5 from the recording sheet ejection port 2BY.

Further, in the printer housing 2, for example, when the recording sheet 5 is carried via the sheet feeding carrying path 74, at a predetermined passing detection position between the pair of the recording sheet carrying rollers 70, 71 and the pair of the recording sheet carrying rollers 72, 73, a sensor 85 is arranged for detecting whether or not the recording sheet 5 has arrived.

Further, in the printer housing 2, for example, when the recording sheet 5 is carried via the ejection carrying path 83, also at a predetermined passing detection position between the pair of the recording sheet ejection rollers 81, 82 that are in the vicinity of the recording sheet ejection port 2BY and the pair of the recording sheet ejection rollers 79, 80 that are positioned on a more upstream side in the carrying direction of the recording sheet 5 than the pair of the recording sheet ejection rollers 81, 82, a sensor 86 is arranged for detecting whether or not the recording sheet 5 has arrived.

In the printer housing 2, a controller 90 such as a microcomputer or a CPU (Central Processing Unit) is provided that integrally controls the entire color printer 1.

Further, the color printer 1 is connected via a wired or wireless connection to a host device (not illustrated in the drawings), such as personal computer, that instructs the color printer 1 to print a print target color image.

Therefore, the controller 90 receives image data representing a print target color image from the host device and, when an instruction to print the color image is received, executes a print image to form (that is, print) a print image on the surface of the recording sheet 5.

When the print image formation process is executed, based on the image data received from the host device, the controller 90 generates four kinds of print color data sets representing black, yellow, magenta and cyan color components of the print target color image.

Next, the controller 90 converts these four kinds of print color data sets representing the black, yellow, magenta and cyan color components to head control data sets (hereinafter, these are also referred to as first-fourth head control data sets to correspond to the names of the first-fourth exposure heads 32-35) for individually drive-controlling the respective corresponding first-fourth exposure heads 32-35 of the first-fourth image forming units 10-13.

Further, the controller 90 causes the unit drive motor to operate to rotate the first-fourth photosensitive drums 24-27, the first-fourth charging rollers 28-31, the first-fourth development rollers 36-39 and the first-fourth supply rollers 40-43, of the first-fourth image forming units 10-13, in the forward rotation direction or the backward rotation direction.

Further, the controller 90 causes the charging roller voltage source, the development roller voltage source and the supply roller voltage source to respectively apply DC voltages of corresponding voltage values to the first-fourth charging rollers 28-31, the first-fourth development rollers 36-39 and the first-fourth supply rollers 40-43, of the first-fourth image forming units 10-13.

In addition, the controller 90 causes the transfer part drive motor to operate to rotate the transfer belt 47 in the backward rotation direction and causes the transfer roller voltage source to apply a DC voltage of a predetermined voltage value to the first-fourth transfer rollers 48-51.

Further, the controller 90 causes the fuser drive motor to operate to rotate the heat generation roller 54 and the pressure application roller 55 in the forward rotation direction and the backward rotation direction that are mutually opposite, and causes, via the heater voltage source, the heat application heater to generate heat to surface of the heat generation roller 54 to a predetermined temperature.

Further, the controller 90 causes one or a plurality of carrying motors (not illustrated in the drawings), for carrying the recording sheet 5, to rotate the plurality of the pairs of the recording sheet carrying rollers 70-73, 75, 76, the plurality of the pairs of the recording sheet ejection rollers 77-82 in the forward rotation direction or the backward rotation direction for carrying the recording sheet 5.

Thereafter, the controller 90 causes the sheet feeding motor to operate to rotate the sheet feeding roller 62 and the feeding-out roller 61 in the backward rotation direction.

As a result, the controller 90 sends the recording sheet 5 that is positioned uppermost among the plurality of the recording sheets 5 loaded in the loading part 60A of the sheet feeding tray 60 and that is pressed against the feeding-out roller 61 into between the sheet feeding roller 62 and the separation roller 66 in a manner that the recording sheet 5 is fed out by the feeding-out roller 61 from the loading part 60A toward the front side.

Further, the controller 90 sends the recording sheet 5, which is fed out by the feeding-out roller 61 from the loading part 60A of the sheet feeding tray 60 to the front side, to the sheet feeding carrying path 74 on an obliquely front and upward side in a manner that the recording sheet 5 is sandwiched between the sheet feeding roller 62 and the separation roller 66 and carries the recording sheet 5 via the sheet feeding carrying path 74 toward the transfer part 15.

In this case, even when the uppermost recording sheet 5 is fed out together with a recording sheet 5 of one sheet below from the loading part 60A of the sheet feeding tray 60 by the feeding-out roller 61, due to the separation roller 66 that is fixedly provided (that is, it does not rotate at all), the recording sheet 5 of one sheet below is separated from the uppermost recording sheet 5 so that the controller 90 can send out only the uppermost recording sheet 5 through between the sheet feeding roller 62 and the separation roller 66 to the sheet feeding carrying path 74.

In this way, the controller 90 can feed the recording sheets 5 loaded in the loading part 60A of the sheet feeding tray 60 to the image forming part 7.

Next, when the recording sheet 5 via the sheet feeding carrying path 74, the controller 90 monitors, via the sensor 85, whether or not the recording sheet 5 has arrived at the passing detection position on the sheet feeding carrying path 74.

As a result, when the controller 90 detects, via the sensor 85, that the recording sheet 5 has arrived at the passing detection position on the sheet feeding carrying path 74, in response to this, the controller 90 sequentially transmits the corresponding first-fourth head control data sets to the first-fourth exposure heads 32-35 of the first-fourth image forming units 10-13 at transmission timings of predetermined time intervals before the recording sheet 5 sequentially arrives at the first-fourth transfer execution positions.

Therefore, before the recording sheet 5 arrives at the first transfer execution position on the transfer belt 47, the first image forming unit 10, using the first exposure head 32, forms an electrostatic latent image on the surface of the first photosensitive drum 24 based on the first head control data sets and starts to form a toner image by using the first development roller 36 to develop the electrostatic latent image with the black toner.

Further, before the recording sheet 5 arrives at the corresponding second-fourth transfer execution positions on the transfer belt 47, the second-fourth image forming units 11-13, using the second-fourth exposure heads 33-35, also similarly sequentially form electrostatic latent images on the surfaces of the second-fourth photosensitive drums 25-27 based on the second-fourth head control data sets and starts to form toner images by using the second-fourth development rollers 37-39 to develop the electrostatic latent images with the toners of the colors (yellow, magenta and cyan).

In this way, the controller 90 carries the recording sheet 5 via the sheet feeding carrying path 74 to the transfer part 15 and then passes the recording sheet 5 on to the transfer belt 47.

Next, when the recording sheet 5 arrives at the first transfer execution position in the transfer part 15, while the recording sheet 5 is carried in a manner being sandwiched between the transfer belt 47 and the first photosensitive drum 24 of the first image forming unit 10, the controller 90 transfers the black toner image that is formed on the surface of the first photosensitive drum 24 to the surface of the recording sheet 5.

Further, when the recording sheet 5 sequentially arrives at the second-fourth transfer execution positions in the transfer part 15, similarly, while the recording sheet 5 is carried in a manner being sandwiched between the transfer belt 47 and the second-fourth photosensitive drums 25-27 of the second-fourth image forming units 11-13, the controller 90 transfers the toner images (that is, the yellow, magenta and cyan toner images) that are formed on the surfaces of the second-fourth photosensitive drums 25-27 to the surface of the recording sheet 5.

In this way, while the recording sheet 5 that has been carried to the transfer part 15 is continuously carried by the transfer belt 47 and the first-fourth photosensitive drums 24-27 of the first-fourth image forming units 10-13, the controller 90 transfers the toner images of the four colors of black, yellow, magenta and cyan onto the surface of the recording sheet 5 by sequentially superimposing the toner images and thereafter passes the recording sheet 5 on to fuser 16.

Next, the controller 90 causes the recording sheet 5 to be brought from the recording sheet inlet to between the heat generation roller 54 and the pressure application roller 55 that are rotating in mutually opposite directions in the fuser 16.

As a result, in the fuser 16, between the heat generation roller 54 and the pressure application roller 55, the recording sheet 5 is pressurized while being heated, and thereby the toner images of the four colors are fused onto the surface of the recording sheet 5. Thereafter, the controller 90 passes the recording sheet 5 from the recording sheet outlet on to the ejection carrying path 83.

In this way, the controller 90 can cause the toner images of the four colors to be fused onto the surface of the recording sheet 5 by the fuser 16 to form a print image, carry the recording sheet 5, on which the print image has been formed, via the ejection carrying path 83 to the recording sheet ejection port 2BY, and eject the recording sheet 5 from the recording sheet ejection port 2BY to the recording sheet delivery part 2BX to pass the recording sheet 5 on to the user.

On the printer housing 2, for example, at a front end part of the upper surface 2B, display 91, such as a liquid crystal display, and a plurality of operation keys (not illustrated in the drawings) are provided.

Further, in the printer housing 2, at a predetermined position on an inner side of the front surface 2A, a speaker 92 is provided that outputs an operation sound when an operation key is operated.

Next, during the execution of the print image formation process, when that the recording sheet 5 has arrived at the passing detection position on the sheet feeding carrying path 74 is not detected via the sensor 85 even after a predetermined period of time has passed since a feeding-out time when one sheet of the recording sheet 5 is fed out from the sheet feeding tray 60 by rotating the feeding-out roller 61, the controller 90 judges that the recording sheet 5 is jammed on a more upstream side than the passing detection position in the carrying direction and a carrying error has occurred.

Further, when that the recording sheet 5 has passed the passing detection position on the ejection carrying path 83 is not detected via the sensor 86 even after a predetermined period of time has passed since a passing detection time when that the recording sheet 5 has passed the passing detection position on the sheet feeding carrying path 74 is detected via the sensor 85, the controller 90 judges that the recording sheet 5 is jammed between the passing detection position on the ejection carrying path 83 and the passing detection position on the sheet feeding carrying path 74 and a carrying error has occurred.

In this way, when that a carrying error of the recording sheet 5 has occurred during the print image formation process is detected, the controller 90 displays a message for carrying error notification in the display 91 and causes a predetermined sound for carrying error notification to be output from the speaker 92.

As a result, as described above, when a carrying error of the recording sheet 5 has occurred, the controller 90 can promptly notify the user via the display 91 and the speaker 92 about the occurrence of the carrying error.

(1-2) Configuration of Sheet Feeding Part

Figure 2:
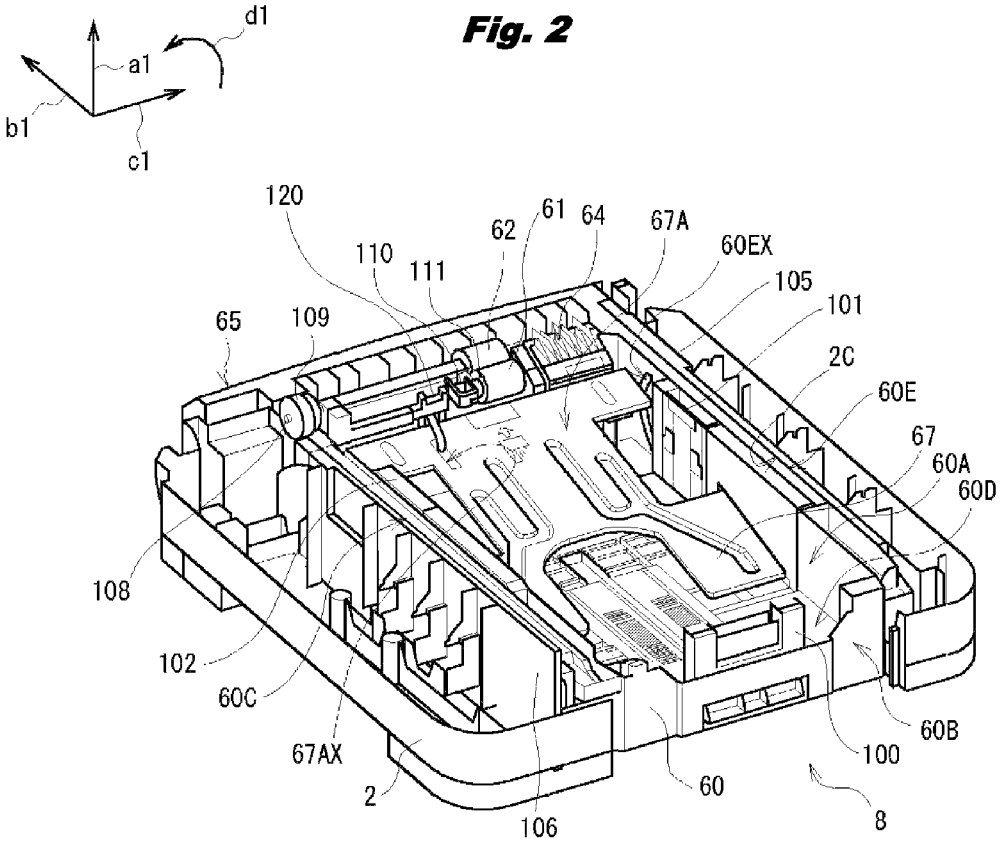
FIG. 2 illustrates a schematic perspective view of a configuration of a sheet feeding part according to the first embodiment.
Figure 3:
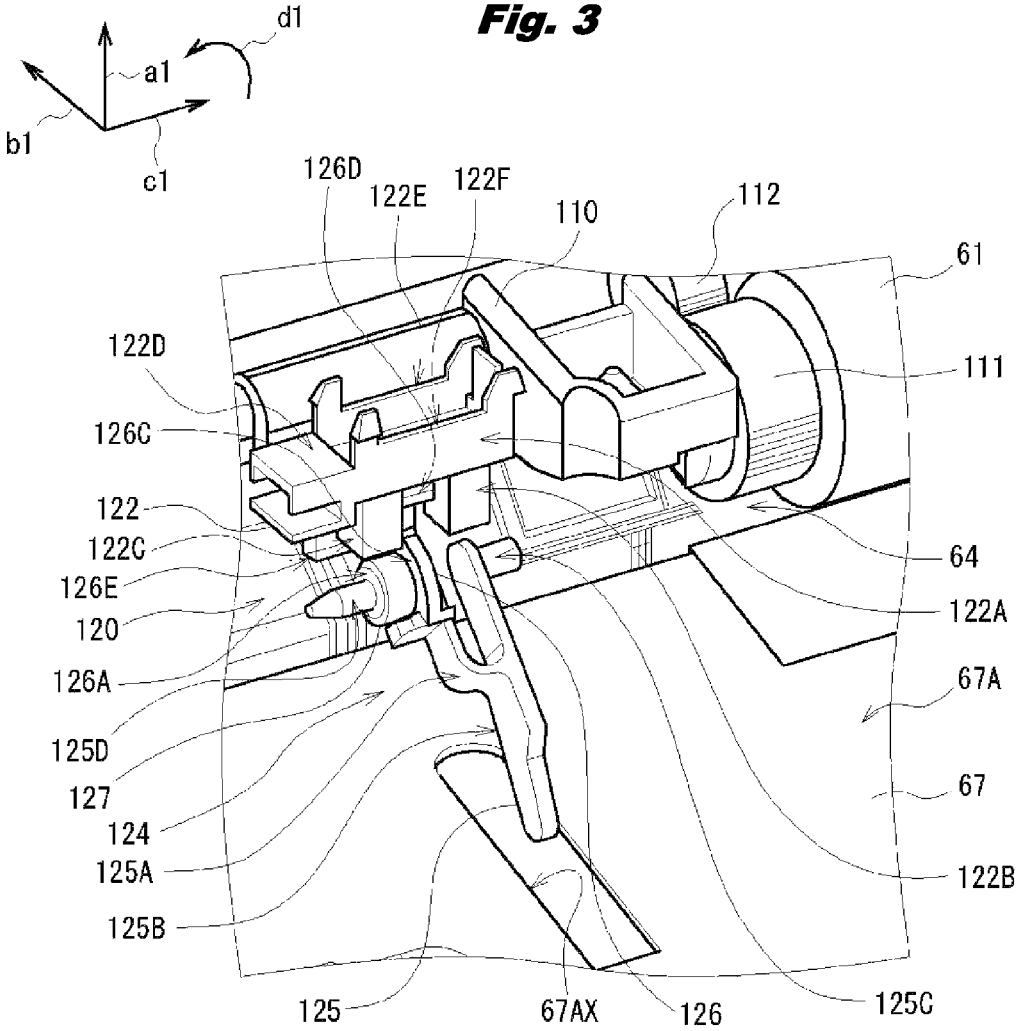
FIG. 3 illustrates a schematic perspective view for describing an arrangement position of a recording sheet detector.

Next, a configuration of the sheet feeding part 8 is described. As illustrated in FIGS. 2 and 3, the sheet feeding part 8 is configured by a lower end part of a body of the color printer 1 that is a portion on the printer housing 2 side that includes a tray container 2C, a feeding-out roller 61 and a sheet feeding roller 62, as described above, and the sheet feeding tray 60 that can be pulled out from and contained in the tray container 2C of the body of the color printer 1. In the following description, the body of the color printer 1 may also be referred to as the printer body.

In this case, a depth and a width of a loading part 60A of the sheet feeding tray 60 are suitably selected so that any of the recording sheets 5 of a plurality of kinds of sizes such the A4 size and the B5 size can be loaded in the loading part 60A in a state in which a long side of the recording sheets 5 is parallel to a tray depth direction and a short side of the recording sheets 5 is parallel to a tray width direction.

That is, the depth of the loading part 60A of the sheet feeding tray 60 is selected to be a predetermined length that is longer than a length of a long side of a recording sheet 5 that has a longest long side among the recording sheets 5 of the plurality of kinds of sizes to be loaded.

Further, the width of the loading part 60A of the sheet feeding tray 60 is selected to be a predetermined length that is longer than a length of a short side of a recording sheet 5 that has a longest short side among the recording sheets 5 of the plurality of kinds of sizes to be loaded.

Further, at a rear end part of the tray bottom plate 60D of the sheet feeding tray 60, a rear guide 100 is provided in a manner moveable in the tray depth direction for defining a depth of a loading area of the recording sheet 5 in the loading part 60A with respect to a rear surface of the sheet feeding guide part 64 to match a size of the recording sheet 5 by narrowing in front and extending rearward.

Further, at predetermined opposing positions of a left end part and a right end part of the tray bottom plate 60D of the sheet feeding tray 60, a pair of side guides 101, 102 are provided in a manner moveable in conjunction with each other in the tray width direction for defining a width of the loading area of the recording sheet 5 in the loading part 60A to match the size of the recording sheet 5 by narrowing from left and right and extending in the left-right direction.

As a result, when the sheet feeding tray 60 is pulled out from the printer body (that is, from the tray container 2C of the printer housing 2), according to the size of the recording sheet 5 that is loaded in the loading part 60A, the depth and the width of the loading area can be adjusted to match the size of the recording sheet 5 by suitably displacing the rear guide 100 and the pair of the side guides 101, 102.

Therefore, in the sheet feeding tray 60, a plurality of the recording sheets 5 that are to be loaded in the loading part 60A can be loaded in a stacked state in a manner in which short sides of the recording sheets 5 on one side are brought into contact with the rear surface of the sheet feeding guide part 64 and are aligned and short sides of the recording sheets 5 on the other side are brought into contact with the rear guide 100 and are aligned, and together with this, long sides of the recording sheets 5 on one side are brought into contact with the left side guide 101 and are aligned and long sides of the recording sheets 5 on the other side are brought into contact with the right side guide 102 and are aligned.

Further, in the sheet feeding tray 60, at a predetermined position near a front side on a left side surface of the placing plate 67A, for example, of the lifting part 67 provided in the loading part 60A as described above, a rotation angle regulation shaft (not illustrated in the drawings) is provided in a manner protruding toward the left side.

Further, in the sheet feeding tray 60, at a front end part of the tray left side plate 60E, a rotation angle regulation cutout part 60EX is formed in an arc shape of a predetermined radius centered at the lifting rotation shaft 68 (FIG. 1) that is perpendicularly provided on the tray left side plate 60E.

Further, the rotation angle regulation shaft of the lifting part 67 is slidably inserted into the rotation angle regulation cutout part 60EX of the sheet feeding tray 60 and a front end part of the rotation angle regulation shaft protrudes to the outside (that is, the left side) of the tray left side plate 60E.

As a result, the sheet feeding tray 60 allows the lifting part 67 in the loading part 60A to rotate in forward rotation direction and in the backward rotation direction about the left and right lifting rotation shafts 68 within an angle range from a loading position at which the rotation angle regulation shaft is butted against a lower end of the rotation angle regulation cutout part 60EX to a lifting upper limit position at which the rotation angle regulation shaft is butted against an upper end of the rotation angle regulation cutout part 60EX.

Further, in the sheet feeding tray 60, the compression coil spring 69 (FIG. 1) that biases the lifting part 67 is formed to have a predetermined elastic force by suitably selecting a spring constant and the like for the spring.

Therefore, when the sheet feeding tray 60 is contained in the printer body, due to the compression coil spring 69, the lifting part 67 can be rotated (or can be elevated) to a lifted position corresponding to the number of the recording sheets 5 that are placed on the placing plate 67A (that is, corresponding to the total weight of the recording sheets 5 that placed on the placing plate 67A).

That is, in the sheet feeding tray 60, since the larger the number of the recording sheets 5 that are placed on the placing plate 67A of the lifting part 67 is, the heavier the total weight of the recording sheets 5 is, in response to this, due to the compression coil spring 69, the lifting part 67 is rotated to a lifted position relatively closer to the loading position, and one end portion of a recording sheet 5 positioned uppermost among the plurality of recording sheets 5 that are placed on the placing plate 67A is pressed against the feeding-out roller 61.

Further, in the sheet feeding tray 60, since the smaller the number of the recording sheets 5 that are placed on the placing plate 67A of the lifting part 67 is, the lighter the total weight of the recording sheets 5 is, in response to this, due to the compression coil spring 69, the lifting part 67 is rotated to a lifted position relatively closer to the lifting upper limit position, and one end portion of a recording sheet 5 positioned uppermost among the plurality of recording sheets 5 that are placed on the placing plate 67A is pressed against the feeding-out roller 61.

In this way, in the sheet feeding tray 60, each time the recording sheet 5 on the placing plate 67A is fed out from the loading part 60A, in accordance with the bias force of the compression coil spring 69, the lifting part 67 is gradually rotated in the backward rotation direction and is moved toward the lifting upper limit position side so that one end portion of the recording sheet 5 positioned uppermost can always be pressed against the feeding-out roller 61.

Further, in the sheet feeding tray 60, when the number of the recording sheets 5 that are placed on the placing plate 67A of the lifting part 67 becomes a number of about one or several sheets, in accordance with the bias force of the compression coil spring 69, the lifting part 67 can be rotated to the lifting upper limit position.

Further, in the printer housing 2, at the lower end part, a left guide 105 and a right guide 106 that are in substantially strip-like shapes long in the front-rear direction are provided in a manner each having one surface opposing one surface of the other for defining a width of the tray container 2C to be approximately equal to the width of the sheet feeding tray 60 to guide the pulling out and containing of the sheet feeding tray 60 with respect to the tray container 2C (that is, to guide the movement of the sheet feeding tray 60 in the front-rear direction of the printer).

On one surface of the left guide 105, a recess part for pressing down (not illustrated in the drawings) of which an upper edge is inclined (that is, the upper edge is inclined obliquely forward and downward) is formed extending from a position opposing an upper end of the rotation angle regulation cutout part 60EX when the sheet feeding tray 60 is contained in the tray container 2C to a lower corner part of a front end.

Therefore, in the sheet feeding part 8, when the sheet feeding tray 60 is contained in the tray container 2C of the printer housing 2 and the lock of the lifting part 67 due to the lock part is automatically released by the lock release mechanism that is provided on the printer body as described above, the lifting part 67 is rotated from the loading position in the backward rotation direction.

Further, in the sheet feeding part 8, in this case, when a plurality of the recording sheets 5 are loaded in the loading part 60A of the sheet feeding tray 60, the front end part of the rotation angle regulation shaft of the lifting part 67 that protrudes to the outside of the tray left side plate 60E approaches a rear end of an upper most position in the upper edge of the recess part for pressing down of the left guide 105.

In this state, in the sheet feeding part 8, when the recording sheets 5 are sequentially fed out one by one from the loading part 60A of the sheet feeding tray 60 for forming print images, by rotating the lifting part 67 in the backward rotation direction in accordance with the bias force of the compression coil spring 69, the position of the front end of the placing plate 67A is gradually elevated.

In this way, in the sheet feeding part 8, when the lifting part 67 in the sheet feeding tray 60 is rotated to the lifting upper limit position, the front end part of the rotation angle regulation shaft is brought into contact with a rear end in the upper edge of the recess part for pressing down of the left guide 105.

Further, in the sheet feeding part 8, when the sheet feeding tray 60 is pulled out from the tray container 2C of the printer housing 2, in response to the movement in the printer frontward direction (that is, toward a tray pulling out side) of the sheet feeding tray 60, the front end part of the rotation angle regulation shaft of the lifting part 67 is slid with respect to the upper edge of the recess part for pressing down of the left guide 105 from a rear end to a front end of a lowermost position.

As a result, in the sheet feeding part 8, when the sheet feeding tray 60 is pulled out from the tray container 2C of the printer housing 2, due to the upper edge of the recess part for pressing down of the left guide 105, together with the rotation angle regulation shaft, the placing plate 67A is gradually pressed down, and the lifting part 67 is rotated in the forward rotation direction while the compression coil spring 69 is compressed.

Further, in the sheet feeding part 8, in this case, immediately before the front end of the placing plate 67A in the sheet feeding tray 60 exits the tray container 2C, due to the upper edge of the recess part for pressing down of the left guide 105, the lifting part 67 is rotated to the loading position in the forward rotation direction, and due to the above-described lock mechanism, the lifting part 67 is automatically locked to be kept at the loading position.

In this way, in the sheet feeding part 8, in response to the pulling out and containing of the sheet feeding tray 60 with respect to the tray container 2C of the printer housing 2, the lifting part 67 can be automatically pressed down to the loading position and automatically lifted to a lifted position.

Further, in the sheet feeding part 8, as described above, on an upper side of the sheet feeding tray 60 in the printer body (that is, in a vicinity of an upper side of a center of the sheet feeding guide part 64), the sheet feeding roller 62 is provided in a manner in which the roller rotation shaft 108 is parallel to the printer left-right direction.

In this case, the sheet feeding roller 62 is fixed on one end portion of the roller rotation shaft 108 of the sheet feeding roller 62 in a manner integrally rotatable with the roller rotation shaft 108, and the other end portion of the roller rotation shaft 108 is positioned in a vicinity of the right guide 106.

Further, on the other end portion of the roller rotation shaft 108 of the sheet feeding roller 62, the above-described pulley 109 for linking with the output shaft of the sheet feeding motor is fixed in a manner integrally rotatable with the roller rotation shaft 108.

Further, on the one end portion of the roller rotation shaft 108 of the sheet feeding roller 62, in a vicinity of a right side surface of the sheet feeding roller 62, a gear (hereinafter, this is also referred to as a sheet feeding roller gear) (not illustrated in the drawings) is fixed in a manner integrally rotatable with the roller rotation shaft 108.

Further, the sheet feeding part 8 has a roller connecting part 110. One end part of the roller connecting part 110 is positioned on a rear side of the roller rotation shaft 108 of the sheet feeding roller 62, and the other end part of the roller connecting part 110 is supported on the roller rotation shaft 108 to the right of the sheet feeding roller gear in a manner rotatable in the forward rotation direction and the backward rotation direction.

Further, on one end part of a left side surface of the roller connecting part 110, for example, a roller rotation shaft (not illustrated in the drawings) of the feeding-out roller 61 is fixed in an orientation parallel to the printer left-right direction.

Further, the roller rotation shaft that is fixed on the roller connecting part 110 supports the feeding-out roller 61 and a gear 111 in a manner allowing the feeding-out roller 61 and the gear 111 to integrally rotate in the backward rotation direction.

In the following description, the gear 111 that is supported on the roller rotation shaft in a manner integrally rotatable with the feeding-out roller 61 is also referred to as a feeding-out roller gear 111.

Further, on a central part of the left side surface of the roller connecting part 110, an intermediate gear 112 is attached in a manner rotatable in the forward rotation direction via a gear shaft (not illustrated in the drawings) parallel to the printer left-right direction. Via the intermediate gear 112, the sheet feeding roller gear and the feeding-out roller gear 111 are linked.

As a result, in the sheet feeding part 8, when the sheet feeding roller 62 rotates in the backward rotation direction in response to an operation of the sheet feeding motor, the rotation of the sheet feeding roller 62 is transmitted to the feeding-out roller gear 111 sequentially via the sheet feeding roller gear and the intermediate gear 112, and the feeding-out roller 61 can also be rotated in the backward rotation direction.

Further, on the one end part of the roller connecting part 110, a compression coil spring (not illustrated in the drawings) is provided. Due to the compression coil spring, the roller connecting part 110 is biased to rotate in the backward rotation direction about the roller rotation shaft 108 of the sheet feeding roller 62.

As a result, in the sheet feeding part 8, when the sheet feeding tray 60 is contained in the printer body and one end portions of the recording sheets 5 are lifted by the lifting part 67 in the loading part 60A, the one end portion of the recording sheet 5 positioned uppermost can be properly pressed against the feeding-out roller 61 in a manner that the recording sheet 5 can be fed out from the loading part 60A.

However, as described above, the sheet feeding part 8 requires a user to load the recording sheets 5 to the loading part 60A of the sheet feeding tray 60 from outside of the printer body (that is, the printer housing 2).

Therefore, in the sheet feeding part 8, for example, there is a possibility that an empty (that is, the user forgot to load the recording sheets 5 to the loading part 60A) sheet feeding tray 60 is erroneously put in the printer body by the user.

Further, as described above, the sheet feeding part 8 requires the user to define, from outside of the printer body, the loading area for the recording sheets 5 that are to be loaded in the loading part 60A of the sheet feeding tray 60, according to the size of the recording sheets 5, by suitably displacing positions of the rear guide 100 and the pair of the side guides 101, 102.

Therefore, in the sheet feeding part 8, for example, there is also a possibility that the depth of the loading area is erroneously defined by the user using the rear guide 100 in the loading part 60A of the sheet feeding tray 60 to be longer than the size (that is, the length) of the recording sheets 5 that are to be loaded.

Further, in the sheet feeding part 8, for example, when the loading area in the loading part 60A of the sheet feeding tray 60 is erroneously defined by the user as described above, there is also a possibility that a plurality of recording sheets 5 of a size smaller than the size of the corresponding loading area are loaded in a manner shifted toward the tray containing side (that is, toward the side close to the tray rear plate 60B).

That is, in the sheet feeding part 8, when the loading area in the loading part 60A of the sheet feeding tray 60 is erroneously defined by the user, there is also a possibility that the recording sheets 5 are loaded in the loading part 60A in a manner that the position of the recording sheets 5 is shifted more toward the tray containing side than a position opposing the feeding-out roller 61.

In the sheet feeding part 8, when an empty sheet feeding tray 60 is contained in the printer body (that is, the tray container 2C of the printer housing 2), as a matter of course, the recording sheet 5 cannot be fed out from the sheet feeding tray 60 when a print image is formed.

Further, in the sheet feeding part 8, when the sheet feeding tray 60 in which the recording sheets 5 are loaded in the loading part 60A in the manner that the position of the recording sheets 5 is shifted toward the tray containing side is contained in the printer body, even when the recording sheets 5 are lifted by the lifting part 67, due to that the position of the recording sheets 5 is shifted toward the tray containing side, the recording sheets 5 cannot be pressed against the feeding-out roller 61.

That is, in the sheet feeding part 8, even when a plurality of the recording sheets 5 are loaded in the loading part 60A in the sheet feeding tray 60 that is contained in the printer body, as described above, in a manner that the position of the recording sheets 5 is shifted toward the tray containing side, the recording sheets 5 cannot be fed out from the sheet feeding tray 60 when a print image is formed.

Therefore, in the sheet feeding part 8, to the right of the roller connecting part 110 in the printer body (that is, the printer housing 2), a detector (hereinafter, this is also referred to as a recording sheet detector) 120 is provided for detecting whether or not the recording sheets 5 are properly loaded in the loading part 60A of the sheet feeding tray 60 in a manner allowing the recording sheets 5 to be fed out.

A state in which the recording sheets 5 are properly loaded in the loading part 60A of the sheet feeding tray 60 in a manner allowing the recording sheets 5 to be fed out is a state in which, in the loading part 60A, at least one recording sheet 5 is loaded in a loading area that matches the size of the recording sheet 5, in a manner being aligned in a loading orientation in which the long side of the recording sheets 5 is parallel to the tray depth direction and the short side of the recording sheets 5 is parallel to the tray width direction, so as to allow the recording sheets 5 to be pressed against the feeding-out roller 61 (that is, the recording sheet 5 is loaded in the original loading area without misalignment).

However, in FIGS. 2 and 3, the recording sheet detector 120 is illustrated in a simplified manner by excluding a part of the configuration. Therefore, in the following, a configuration of the recording sheet detector 120 is described using FIGS. 4A, 4B, 5A and 5B in which the configuration of the recording sheet detector 120 is specifically illustrated.

As illustrated in FIGS. 4A, 4B, 5A and 5B, the recording sheet detector 120 is configured by a detector base 121, a sensor containing case 122, a lever support part 123 and a detection lever 124.

The detector base 121 has a plate part 121A, through a central part of one surface of which, a long hole 121AX is drilled. Further, on the detector base 121, on two sides of a pair of long sides of the long hole 121AX on the one surface of the plate part 121A, a first and second attaching parts 121B, 121C of substantially triangular block shapes for attaching the sensor containing case 122 and the lever support part 123 are provided in projecting manners each having one surface opposing one surface of the other across a predetermined spacing.

The detector base 121 is provided in the printer housing 2 in an orientation in which one surface of the plate part 121A is oriented toward a lower side and a longitudinal direction of the long hole 121AX is parallel to the printer left-right direction.

The lever support part 123 has a substantially U-shaped trunk part 123A of a predetermined length in which a ditch part 123AX of a predetermined depth is formed.

In the following description, a longitudinal direction of the trunk part 123A (which is also a longitudinal direction of the ditch part 123AX) in the lever support part 123 is also referred to as a support part longitudinal direction.

Further, on the lever support part 123, at a central part of a lower surface (that is, an under side surface of a bottom surface of the ditch part 123AX) of the trunk part 123A, a cutout part 123AY is formed having a length in the support part longitudinal direction selected to be a predetermined length and penetrating to the ditch part 123AX.

Further, on the lever support part 123, at one end portion and the other end portion in the support part longitudinal direction that are two sides of the cutout part 123AY on the lower surface of the trunk part 123A, a pair of substantially plate-shaped first and second support leg parts 123B, 123C are perpendicularly provided each having one surface opposing one surface of the other across a predetermined spacing.

Further, on the lever support part 123, at opposing positions near front ends on the opposing surfaces of the first and second support leg parts 123B, 123C, circular first and second bearing holes are drilled.

The lever support part 123 is installed on the first and second attaching parts 121B, 121C of the detector base 121 in a manner that the support part longitudinal direction is parallel to the printer left-right direction and the ditch part 123AX opposes the long hole 121AX.

The sensor containing case 122 has a substantially prism-shaped case body 122A of a predetermined length. In the following description, a longitudinal direction of the case body in the sensor containing case 122 is also referred to as a case longitudinal direction.

Further, on the sensor containing case 122, near one end and near the other end in the case longitudinal direction on one surface of the case body 122A, a pair of rectangular box-shaped first and second sensor arrangement parts 122B, 122C (FIG. 3) are integrally provided in a protruding manner each having one surface opposing one surface of the other across a predetermined spacing.

Further, on the sensor containing case 122, at opposing positions in central parts on the opposing surfaces of the first and second sensor arrangement parts 122B, 122C, relatively small first and second holes are drilled.

In the sensor containing case 122, for example, a light emitting element (not illustrated in the drawings) is contained in the first sensor arrangement part 122B in such a manner that a light emitting surface opposes the first hole, and a light receiving element (not illustrated in the drawings) is contained in the second sensor arrangement part 122C in such a manner that a light receiving surface opposes the second hole.

In this way, the sensor containing case 122 hold the light emitting element and the light receiving element in such a manner that detection light emitted from the light emitting surface of the light emitting element can sequentially pass through the first and second holes and be received by the light receiving surface of the light receiving element.

Further, in the sensor containing case 122, on one end portion of the case body 122A in the case longitudinal direction, a female connector 122D is integrally provided in a projecting manner, and a plurality of terminals (not illustrated in the drawings) that are arranged at an inner back position in the connector 122D are electrically connected to the light emitting element and the light receiving element.

Further, on the other surface of the case body 122A of the sensor containing case 122, at edges on one side and the other side parallel to the case longitudinal direction, substantially U-shaped plate-like first and second locking latches 122E, 122F are perpendicularly provided in a manner opposing each other.

The sensor containing case 122 is installed on the first and second attaching parts 121B, 121C of the detector base 121 via the first and second locking latches 122E, 122F in a manner that the case longitudinal direction is parallel to the printer left-right direction and the other surface of the case body 122A opposes the long hole.

As a result, on the detector base 121, one end part and the other end part of the case body 122A in the sensor containing case 122 are positioned at one end part and the other end part in the ditch part 123AX of the lever support part 123, and the first and second sensor arrangement parts 122B, 122C protrude downward from the cutout part 123AY of the lever support part 123.

That is, on the detector base 121, the first and second sensor arrangement parts 122B, 122C of the sensor containing case 122 are positioned between base portions of the first and second support leg parts 123B, 123C of the lever support part 123 (that is, above the opposing first and second bearing holes between the first and second support leg parts 123B, 123C.

Further, on the detector base 121, the connector 122D of the sensor containing case 122 protrudes rightward from the ditch part 123AX of the lever support part 123.

(Explanation of Detection Lever)

The detection lever 124 has a lever body 125, a body holding part 126 and a torsion spring 127.

The lever body 125 is formed in a Y-shape with a lever base part 125A and a lever front end part 125B that protrudes from the lever base part 125. The lever base part 125A has a pair of parallel linear portions formed in a substantially U-shaped plate-like shape.

Further, on the lever body 125, on an end portion of an outer surface of one of the linear portions of the lever base part 125A, a column-shaped first rotation shaft 125C of a predetermined length is perpendicularly provided.

Further, on the lever body 125, on an end portion of an outer surface of the other linear portion of the lever base part 125A, a second rotation shaft 125D having a predetermined length longer than the first rotation shaft 125C and having a front end part formed in a tapered shape is perpendicularly provided in a manner that a center of the second rotation shaft 125D is positioned on an imaginary straight line passing through a center of the first rotation shaft 125C. The first and second rotation shaft 125C and 125D are disposed at heights where a top of loaded sheets does not hit when the tray is fully loaded with sheets.

Further, one the lever body 125, at a central part of the outer surface of the other linear portion of the lever base part 125A (that is, at a predetermined position closer to the lever front end part 125B than the second rotation shaft 125D), a substantially rectangular plate-like abutting part 125E is perpendicularly provided in a manner that lateral surfaces of the abutting part 125E on one side and the other side are respectively made flush with lateral surfaces of the other linear portion on one side and the other side.

On the other hand, the body holding part 126 has a cylindrical shaft insertion part 126A that has a predetermined length and is slightly thicker than the second rotation shaft 125D.

Further, on the body holding part 126, a substantially fan-shaped overhanging part 126B having a predetermined thickness is formed on one end portion of an outer peripheral surface of the shaft insertion part 126A in a manner that one surface of the overhanging part 126B is made flush with one end surface of the shaft insertion part 126A.

Further, on the body holding part 126, on one end side of an arc-shaped outer peripheral surface of the overhanging part 126B, a substantially rectangular plate-like light blocking part 126C having a thickness equal to that of the overhanging part 126B is provided in a projecting manner such that one surface and the other surface of the light blocking part 126C are respectively made flush with one surface and the other surface of the overhanging part 126B.

Further, on the body holding part 126, on a front end part of one surface of the light blocking part 126, a substantially rectangular plate-like light blocking position regulation part 126D having a width equal to that of the light blocking part 126C is perpendicularly provided in a manner protruding toward one end surface side of the shaft insertion part 126A.

Further, on the body holding part 126, on a side surface on one end side of the overhanging part 126B, a rod-like stopper 126E for regulating the rotation of the body holding part is provided in a manner that a longitudinal direction of the stopper 126E is parallel to a longitudinal direction of the shaft insertion part 126A and a front end part of the stopper 126E protrudes to the other end surface side of the shaft insertion part 126A.

Further, on the body holding part 126, on a side surface on the other end side of the overhanging part 126B, a substantially rectangular plate-like engagement part 126F that has a predetermined length longer than the thickness (that is, length between one surface and the other surface) of the overhanging part 126B and corresponds to the abutting part 125E of the lever body 125 is provided in a manner protruding to the one end surface side of the shaft insertion part 126A.

The second rotation shaft 125D of the lever body 125 of the detection lever 124 is inserted from the one end surface side into a hole of the shaft insertion part 126A of the body holding part 126 and a front end part of the second rotation shaft 125D protrudes from the other end surface of the shaft insertion part 126A.

As a result, the detection lever 124 is held by the body holding part 126 in a manner that the lever body 125 can be rotated in forward rotation direction and the backward rotation direction about the second rotation shaft 125D.

Further, the other end part of the shaft insertion part 126A of the body holding part 126 of the detection lever 124 is inserted into the torsion spring 127.

Further, one end part 127A of the torsion spring 127 of the detection lever 124 is locked to a cutout part formed on an outer surface of the stopper 126E of the body holding part 126, and another end part 127B of the torsion spring 127 is locked to recess part formed on one surface (that is, a surface on the lever front end part 125B) of the abutting part 125E of the lever body 125.

As a result, the lever body 125 of the detection lever 124 is biased by the torsion spring 127 to rotate with respect to the body holding part 126 in the forward rotation direction.

The torsion spring 127 is formed to have a predetermined elastic force by suitably selecting a spring constant and the like.

Therefore, in a state in which, except the bias force due to the torsion spring 127, no external pressing force is applied to the lever body 125 of the detection lever 124, in accordance with the bias force of the torsion spring 127, the abutting part 125E of the lever body 125 and a joining portion of the abutting part 125E in the other linear portion of the lever base part 125A are butted against the engagement part 126F of the body holding part 126.

In this way, in the state in which, except the bias force due to the torsion spring 127, no pressing force is applied to the lever body 125 of the detection lever 124, due to the torsion spring 127, the body holding part 126 and the lever body 125 are combined as if they were a single molded product.

In the following description, the state in which the body holding part 126 and the lever body 125 of the detection lever 124 are combined is also referred to as a combined state.

The lever front end part 125B of the lever body 125 of the detection lever 124 is positioned on the tray containing side (that is, a rear side) more than the body holding part 126, and the first rotation shaft 125C of the lever body 125 is inserted into the first bearing hole of the first support leg part 123B of the lever support part 123.

Further, the front end part of the second rotation shaft 125D of the lever body 125 of the detection lever 124 that protrudes from the shaft insertion part 126A of the body holding part 126 is inserted into the second bearing hole of the second support leg part 123C of the lever support part 123.

As a result, the detection lever 124 is supported by the lever support part 123 in a manner rotatable in the forward rotation direction and the backward rotation direction about the first and second rotation shafts 125C, 125D that are parallel to the printer left-right direction (that is, also parallel to the tray width direction).

The body holding part 126 is integrally molded, for example, using a predetermined resin material. Further, the lever body 125 is also molded, for example, using a predetermined resin material.

The lever body 125 has such an elasticity that, when ends of the pair of the linear portions of the lever base part 125A are sandwiched from both sides using fingers, the pair of linear portions deform so as to narrow a spacing between the pair of linear portions, and, in this state, when the fingers are released, the pair of linear portions restore to their original shapes.

Therefore, by utilizing the elasticity of the lever body 125, the detection lever 124 can be easily installed on the lever support part 123. With the above structure, the lever body 125 is able to travel from the load detection position to the retreat position in the backward direction. Meanwhile, the body holding part 126 does not rotate from the load detection position to the retreat position, but remains at the load detection position. Thereby, because the light blocking part 126C that is a part of the body holding part 126 remains where the sensing light from the optical sensor is blocked, the sheet status that sheets are not loaded maintains.

In the recording sheet detector 120, a male connector (not illustrated in the drawings) that has a plurality of terminals electrically connected to the above-described controller 90 is inserted to the connector 122D of the sensor containing case 122.

As a result, in the recording sheet detector 120, the light emitting element and the light receiving element that are contained in the sensor containing case 122 are electrically connected to the controller 90 sequentially via the female connector 122D and the male connector.

However, in the sheet feeding part 8, for example, at a predetermined position such as front end part of the tray container 2C, a predetermined tray detector is provided for detecting presence or absence of the sheet feeding tray 60 contained in the tray container 2C in the printer body (that is, in the printer housing 2).

Therefore, when the controller 90 detects, for example, via the tray detector, that the sheet feeding tray 60 is contained in the printer body (that is, in the tray container 2C of the printer housing 2), during a time period in which the sheet feeding tray 60 is contained in the tray container 2C, the controller 90 supplies power for operation to the light emitting element and the light receiving element of the recording sheet detector 120.

Therefore, in the recording sheet detector 120, during the time period in which the sheet feeding tray 60 is contained in the printer body (that is, in the tray container 2C), the light emitting element and the light receiving element receive the power supplied from the controller 90 and operate.

As a result, in the recording sheet detector 120, during the time period in which the sheet feeding tray 60 is contained in the printer body, the light emitting element emits detection light from the light emitting surface toward the light receiving surface of the light receiving element.

Further, in the recording sheet detector 120, during the time period in which the sheet feeding tray 60 is contained in the printer body, the light receiving element transmits a detection signal indicating presence or absence of detection light received by the light receiving surface to the controller 90.

That is, during the time period in which the sheet feeding tray 60 is contained in the printer body, as will be described later, due to that the recording sheets 5 are properly loaded in the loading part 60A of the sheet feeding tray 60 in a manner allowing the recording sheets 5 to be fed, when the detection light is received by the light receiving surface of the light receiving element, a signal level of the detection signal that is transmitted to the controller 90 is lowered to, for example, a logic "L" level.

Further, during the time period in which the sheet feeding tray 60 is contained in the printer body, as will be described later, due to that the sheet feeding tray 60 is empty or that the recording sheets 5 are loaded in a manner being misaligned so that the recording sheets 5 cannot be fed, when the detection light is not received by the light receiving surface of the light receiving element, a signal level of the detection signal that is transmitted to the controller 90 is raised to, for example, a logic "H" level.

When the signal level of the detection signal provided from the light receiving element of the recording sheet detector 120 lowers to the logic "L" level, in response to this, the controller 90 judges that the recording sheets 5 are properly loaded in the loading part 60A of the sheet feeding tray 60 in a manner allowing the recording sheets 5 to be fed out.

Further, when the signal level of the detection signal provided from the light receiving element of the recording sheet detector 120 rises to the logic "H" level, in response to this, the controller 90 judges that the recording sheets 5 are not properly loaded in the loading part 60A of the sheet feeding tray 60.

Therefore, the recording sheet detector 120 is formed in such a manner that, when the recording sheets 5 are properly loaded in the sheet feeding tray 60 contained in the printer body in a manner allowing the recording sheets 5 to be fed, for detecting this, the detection light is received by the light receiving surface of the light receiving element, and when the recording sheets 5 are not properly loaded in the sheet feeding tray 60, for detecting this, the detection light is not received by the light receiving surface of the light receiving element.

That is, in the detection lever 124, a length from an end part on an outer surface of the linear portion on one side (that is, from a portion where the first rotation shaft 125C is perpendicularly provided) of the lever base part 125A of the lever body 125 to the other end surface of the shaft insertion part 126A of the body holding part 126 is selected to a predetermined length (Ld) slightly shorter than the spacing (Sd, see FIG. 3) between the mutually opposing surfaces of the first and second support leg parts 123B, 123C of the lever support part 123.

Therefore, in the recording sheet detector 120 (FIGS. 4A and 4B), in the state in which no external pressing force is applied to the lever body 125 of the detection lever 124, due to the self weight of the lever body 125, the detection lever 124 in the combined state can be rotated in the backward rotation direction in a state in which the lever front end part 125B is oriented toward the tray containing side more than the first and second rotation shafts 125C, 125D.

However, in the recording sheet detector 120, as described above, even when the detection lever 124 in the combined state rotates in the backward rotation direction, when the detection lever 124 reaches a position at which the lever front end part 125B is oriented obliquely rearward and downward, the stopper 126E is pressed from the tray pulling out side against the second support leg part 123C of the lever support part 123 so that the rotation of the detection lever 124 in the backward rotation direction is stopped.

The light blocking part 126C and the light blocking position regulation part 126D of the body holding part 126 of the detection lever 124 are provided on a rear side of the stopper 126E.

Further, in the detection lever 124, a length from the other end surface of the shaft insertion part 126A of the body holding part 126 to the other surface of the overhanging part 126B (that is, a surface on the other end surface side of the shaft insertion part 126A) is selected to be a predetermined length substantially equal to a length from one surface of the second support leg part 123C of the lever support part 123 to one surface of the second sensor arrangement part 122C of the sensor containing case 122.

Further, in the detection lever 124, a length from an imaginary straight line passing through centers of the first and second rotation shafts 125C, 125D to a front end of the light blocking part 126C of the body holding part 126 is selected to be a predetermined length that is longer than a length from an imaginary straight line passing through centers of the first and second bearing holes of the lever support part 123 to the second hole of the sensor containing case 122 and is slightly shorter than a length to the one surface of the case body 122A.

Therefore, in the recording sheet detector 120, when the rotation of the detection lever 124 in the combined state in the backward rotation direction is stopped, the light blocking part 126C and the light blocking position regulation part 126D of the body holding part 126 can be inserted from the tray pulling out side into between the first and second sensor arrangement parts 122B, 122C of the sensor containing case 122 (that is, between the light emitting element and the light receiving element).

Further, in the recording sheet detector 120, in this case, to the one surface of the second sensor arrangement part 122C of the sensor containing case 122 (that is, the surface on which the second hole is drilled), the other surface of the light blocking part 126C of the body holding part 126 (that is, the surface on the other end surface side of the shaft insertion part 126A) can be brought close.

As a result, in the recording sheet detector 120, due to the light blocking part 126C of the body holding part 126, the detection light emitted from the light emitting surface of the light emitting element can be blocked so that the detection light cannot be received by the light receiving surface of the light receiving element.

Here, the position at which, even when the detection lever 124 in the combined state rotates in the backward rotation direction, the rotation of the detection lever 124 is stopped by the stopper 126E (that is, the position at which the lever front end part 125B is oriented obliquely rearward and downward) is a position for blocking the detection light so that the detection light cannot be received by the light receiving surface of the light receiving element in order to detect that the recording sheets 5 are not properly loaded in the sheet feeding tray 60 as described above.

Therefore, in the following description, the position at which the rotation in the backward rotation direction of the detection lever 124 in the combined state is stopped by the stopper 126E in order to detect that the recording sheets 5 are not properly loaded in the sheet feeding tray 60 is also referred to as a non-load detection position. At the position, the light blocking part 126C blocks the sensing light of the optical sensor.

In addition to this, in the detection lever 124, a length from the other surface of the light blocking part 126C of the body holding part 126 to the end surface of the light blocking position regulation part 126D (that is, the surface on the one end surface side of the shaft insertion part 126A) is selected to be a predetermined length slightly shorter than the spacing between the opposing surfaces of the first and second sensor arrangement parts 122B, 122C of the sensor containing case 122.

Therefore, in the recording sheet detector 120, when the light blocking part 126C and the light blocking position regulation part 126D of the body holding part 126 are inserted into between the first and second sensor arrangement parts 122B, 122C of the sensor containing case 122, the end surface of the light blocking position regulation part 126D can be brought close to one surface of the first sensor arrangement part 122B of the sensor containing case 122.

As a result, in the recording sheet detector 120, when the light blocking part 126C and the light blocking position regulation part 126D of the body holding part 126 are inserted into between the first and second sensor arrangement parts 122B, 122C of the sensor containing case 122, a state can be maintained in which the other surface of the light blocking part 126C is close to the one surface of the second sensor arrangement part 122C.

Therefore, in the recording sheet detector 120, when the stopper 126E of the body holding part 126 is pressed or is being pressed from the tray pulling out side against the second support leg part 123C of the lever support part 123, it can be substantially surely prevented that, due to that the light blocking part 126C moves away from the one surface of the second sensor arrangement part 122C or is deformed, the detection light passes around the light blocking part 126C and is received by the light receiving surface of the light receiving element.

However, in the detection lever 124 in the combined state, in accordance with the bias force due to the torsion spring 127 toward the forward rotation direction as described above, when viewed from the stopper 126E of the body holding part 126, the abutting part 125E of the lever body 125 and a portion of the lever base part 125A are butted from the stopper 126E side against the engagement part 126F positioned in the forward rotation direction.

Figure 6A:
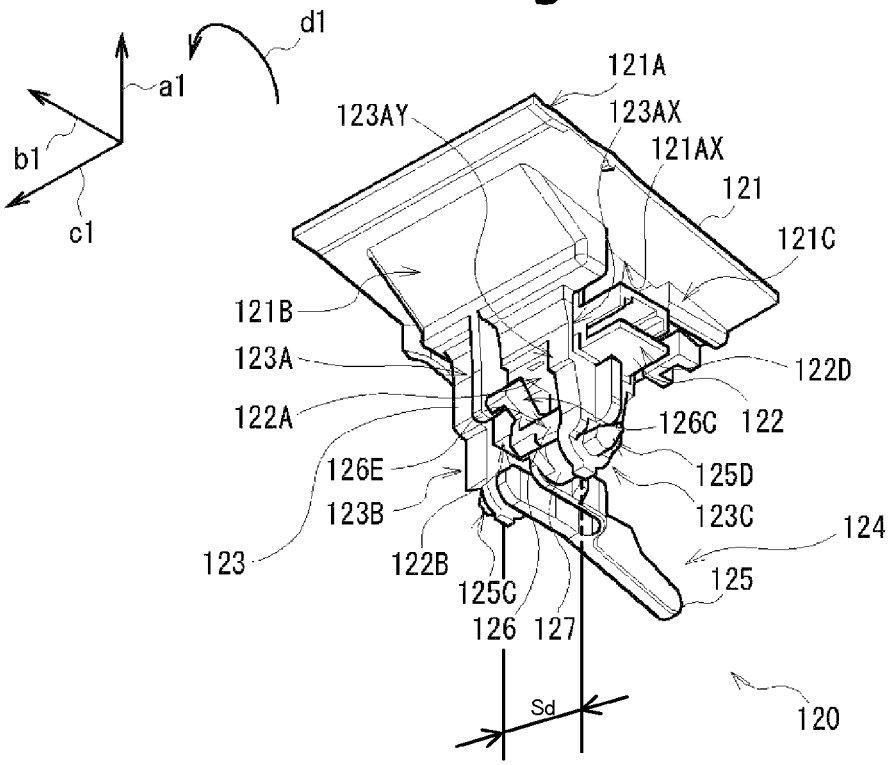
FIGS. 6A and 6B respectively illustrate a schematic perspective view and a schematic side view for describing rotation of the detection lever in an integrate state in the recording sheet detector, illustrating a load detection position.
Figure 6B:
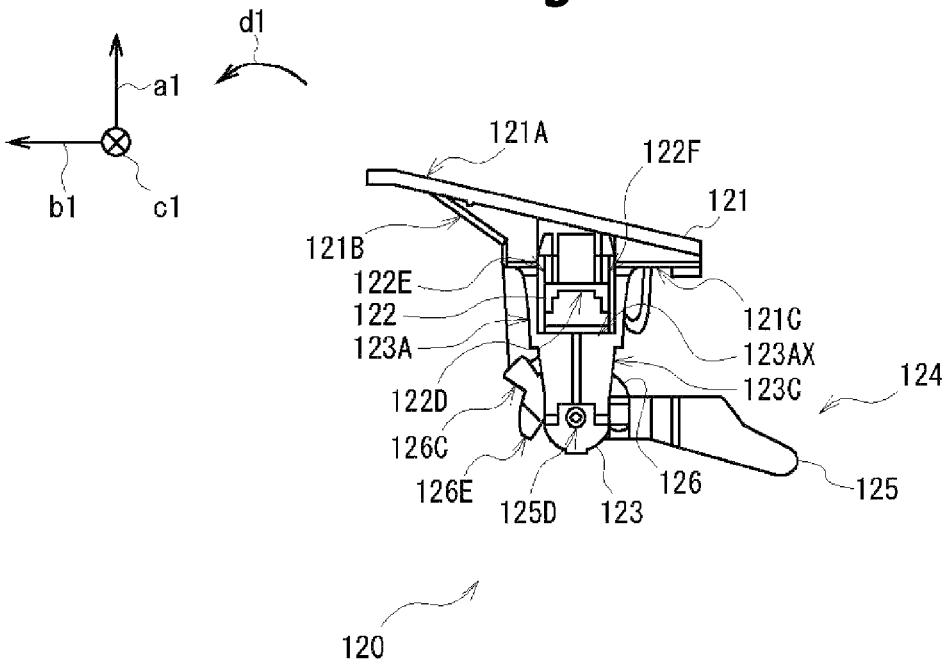

Therefore, as illustrated in FIGS. 6A and 6B, in the recording sheet detector 120, in the state in which the detection lever 124 is stopped at the non-load detection position, when a pressing force such as a lifting force (that is, a force to rotate the lever front end part 125B in the forward rotation direction) is applied from outside to the lever front end part 125B, the detection lever 124 in the combined state can be rotated in the forward rotation direction in a state in which the lever front end part 125B is oriented toward the tray containing side more than the first and second rotation shafts 125C, 125D.

In this case, in the recording sheet detector 120, in response to the rotation in the forward rotation direction of the detection lever 124, the stopper 126E is separated away from the second support leg part 123C of the lever support part 123 toward the tray pulling out side.

Further, in the recording sheet detector 120, in response to the rotation in the forward rotation direction of the detection lever 124, the light blocking part 126C and the light blocking position regulation part 126D of the body holding part 126 are pulled out from between the first and second sensor arrangement parts 122B, 122C of the sensor containing case 122 (that is, from between the light emitting element and the light receiving element) toward the tray pulling out side.

As a result, in the recording sheet detector 120, the detection light emitted from the light emitting surface of the light emitting element can be received by the light receiving surface of the light receiving element. FIG. 6A illustrates that the light blocking part 126C is at the load detection position. Meanwhile, in FIG. 4B, the light blocking part 126C is at the non-load detection position, hiding behind the second support leg part 123C.

Here, the position at which the detection lever 124 in the combined state is rotated in the forward rotation direction from the non-load detection position is a position at which the detection light can be received by the light receiving surface of the light receiving element in order to detect that the recording sheets 5 are properly loaded in the sheet feeding tray 60 in a manner allowing the recording sheets 5 to be fed out as described above.

Therefore, in the following description, the position when detection lever 124 in the combined state is rotated in the forward rotation direction from the non-load detection position in order to detect that the recording sheets 5 are properly loaded in the sheet feeding tray 60 in a manner allowing the recording sheets 5 to be fed out (that is, the position at which the detection light can be received by the light receiving surface of the light receiving element) is also referred to as a load detection position. Since the light blocking part 126C does not block the light of the optical sensor at the load detection position, the tray is recognized being loaded by sheets However, as described above, the lever body 125 of the detection lever 124 is biased by the torsion spring 127 to rotate in the forward rotation direction with respect to the body holding part 126 and is combined.

Figure 7A:
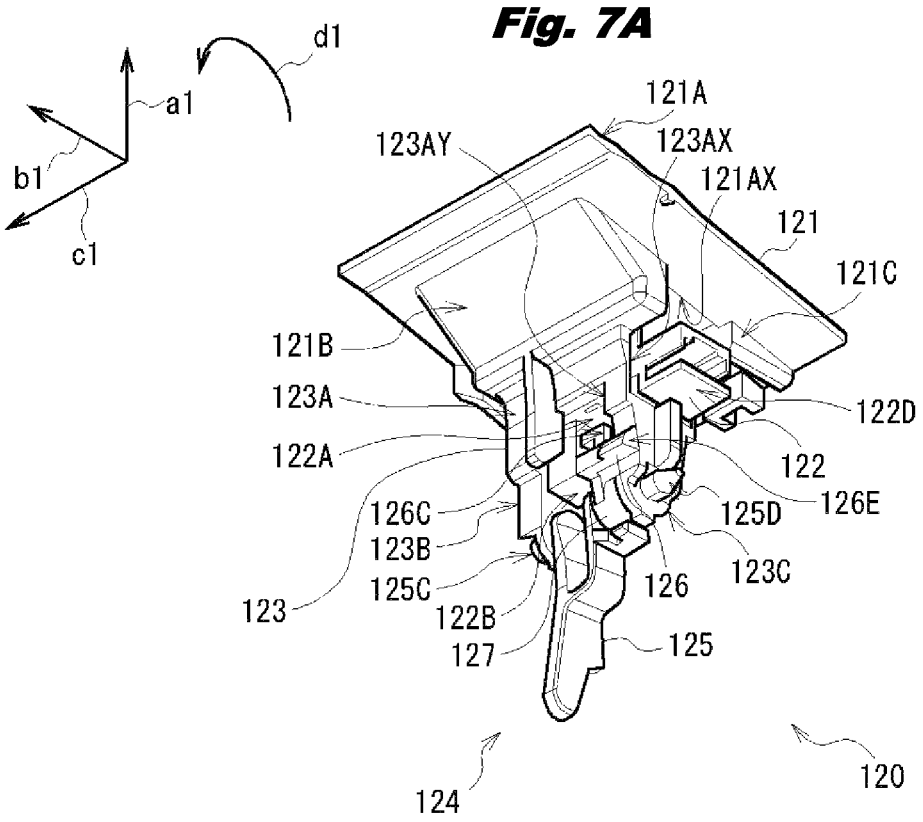
FIGS. 7A and 7B respectively illustrate a schematic perspective view and a schematic side view for describing rotation of only a lever body of the detection lever in the recording sheet detector.
Figure 7B:
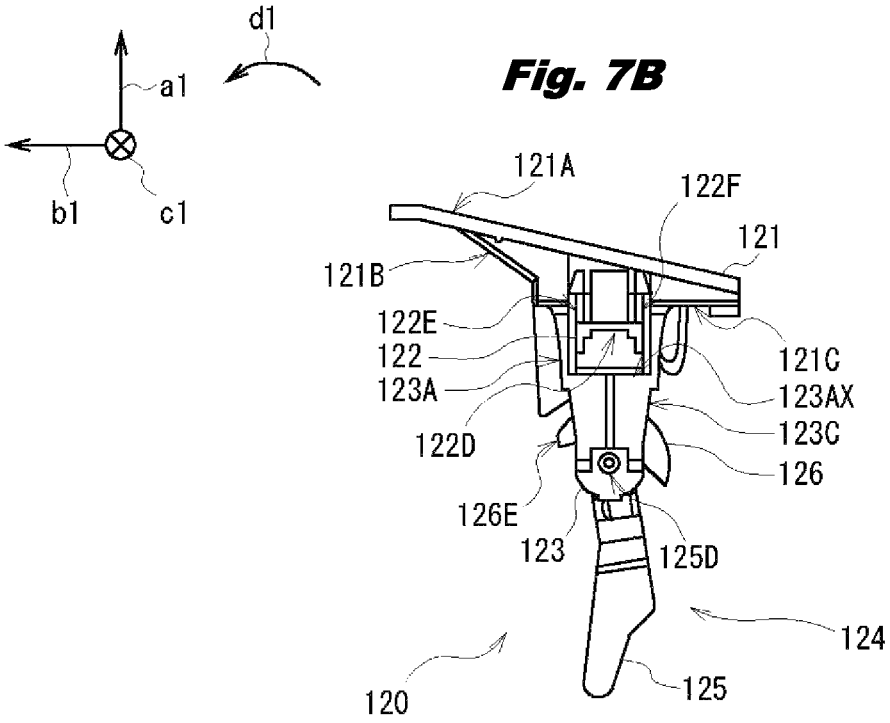

Therefore, as illustrated in FIGS. 7A and 7B, in the recording sheet detector 120, in the state in which the detection lever 124 is stopped at the non-load detection position, when a pressing force to press the lever front end part 125B toward the tray pulling out side (that is, to rotate the lever front end part 125B in the backward rotation direction) is applied from outside to the lever front end part 125B, the lever body 125 can be individually further rotated in the backward rotation direction without rotating the body holding part 126.

That is, in the recording sheet detector 120, in this case, with respect to the body holding part 126 of the detection lever 124, even when a pressing force pressing toward the tray pulling out side is applied, since the stopper 126E is pressed against the second support leg part 123C of the lever support part 123, the rotation remains being stopped at the non-load detection position. The second support leg part 123C is positioned on a rotation pass way of the stopper 126E, and at a position that is further in the backward rotation direction from the non-loaded detection position. Therewith, even when the lever body 125 makes the backward rotation toward the retreat position, the body holding part 126 that is integrated with the supper 126E does not travel in the backward rotation direction from the non-load detection position.

Further, in the recording sheet detector 120, with respect to the lever body 125 of the detection lever 124, since the elastic force and the bias force of the torsion spring 127 are relatively small, the lever front end part 125B can be made independent from the body holding part 126 and can be rotated through a lower side of the first and second rotation shafts 125C, 125D toward the tray pulling out side.

Further, in the recording sheet detector 120, when the lever body 125 of the detection lever 124 is individually rotated in the backward rotation direction as described above, in response to this, the torsion spring 127 is compressed and the bias force becomes larger.

However, in the recording sheet detector 120, since the bias force due to the torsion spring 127 is relatively small, the lever body 125 can be smoothly rotated to a position in the backward rotation direction to be oriented toward the tray pulling out side such as an obliquely forward and downward side substantially without being influenced by the bias force due to the torsion spring 127.

In practice, in the recording sheet detector 120, when the sheet feeding tray 60 is pulled out from the printer body (that is, the tray container 2C of the printer housing 2), as described above using FIG. 4, due to the self weight of the lever body 125, the detection lever 124 in the combined state is rotated to the non-load detection position in the backward rotation direction and the rotation is stopped.

Figure 8:
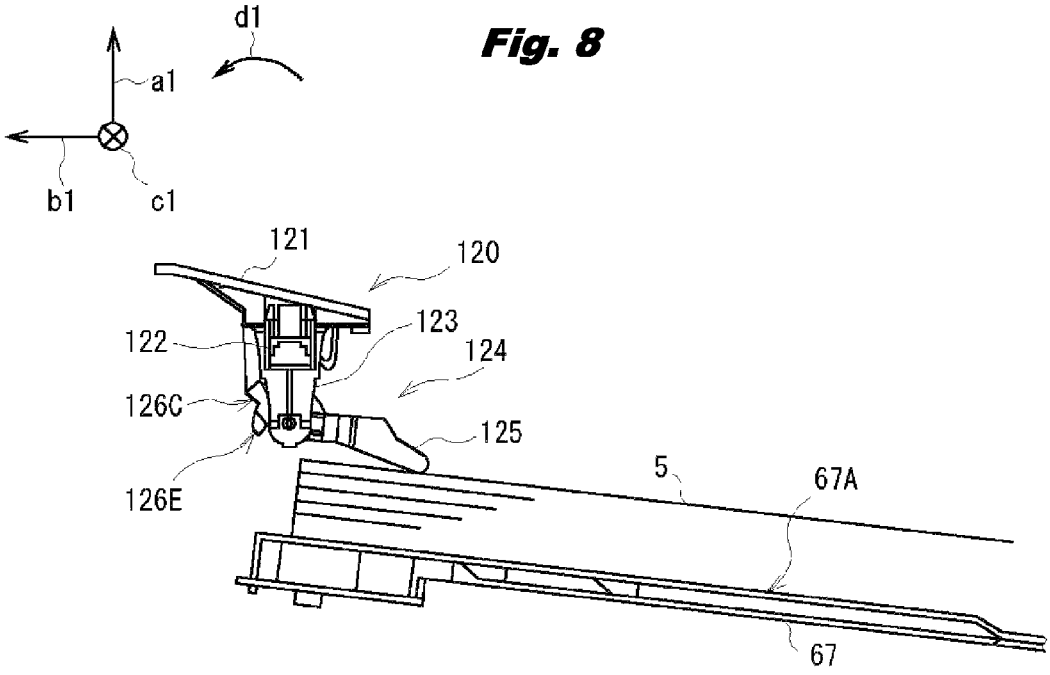
FIG. 8 illustrates a schematic side view for describing the recording sheet detector when recording sheets are properly loaded in a sheet feeding tray, illustrating the load detection position.

As illustrated in FIG. 8, when at least one recording sheet 5 is loaded in the loading part 60A of the sheet feeding tray 60, as described above, when the sheet feeding tray 60 is contained in the printer body, one end portion of the recording sheet 5 is automatically lifted by the lifting part 67.

In this case, in the recording sheet detector 120, when at least one recording sheet 5 is properly loaded in the sheet feeding tray 60 in a manner allowing the recording sheet 5 to be fed, the one end portion of the recording sheet 5 that is lifted by the lifting part 67 is pressed from below against the lever front end part 125B and pressing force to rotate the detection lever 124 in the forward rotation direction is applied to the detection lever 124.

As a result, in the recording sheet detector 120, in response to the pressing force applied by the pressing of the recording sheets 5, the detection lever 124 can be rotated from the non-load detection position in the forward rotation direction to the load detection position corresponding to the number of the recording sheets 5 on the placing plate 67A.

In the recording sheet detector 120, in this case, when the detection light emitted by the light emitting element from the light emitting surface is received by the light receiving surface of the light receiving element, a detection signal of the logic "L" level is transmitted from the light receiving element to the controller 90.

Therefore, based on the detection signal provided from the light receiving element of the recording sheet detector 120, the controller 90 can detect that the recording sheets 5 are properly loaded in the sheet feeding tray 60 in a manner allowing the recording sheets 5 to be fed out.

When the sheet feeding tray 60 is contained in the printer body in the state in which the recording sheet 5 is loaded in the loading part 60A, as described above, one end portion of the recording sheet 5 is automatically lifted by the lifting part 67 to be inclined parallel to an obliquely forward and upward direction.

Therefore, in the recording sheet detector 120, when the sheet feeding tray 60 is contained in the printer body, in order to make the detection lever 124 at the non-load detection position easily rotated in the forward rotation direction in response to the pressing of the one end portion of the recording sheet 5 against the lever front end part 125B, the detection lever 124 at the non-load detection position is inclined parallel to an obliquely rearward and downward direction.

However, when the sheet feeding tray 60 is pulled out from the printer body, it is not always that a maximum allowable number of the recording sheets 5 are loaded in the loading part 60A and the sheet feeding tray 60 is contained in printer body.

When the sheet feeding tray 60 is contained in the printer body, the more the number of the recording sheets 5 that are loaded in the loading part 60A, the smaller the angle of the one end portions of the recording sheets 5 that are lifted by the lifting part 67 with respect to the tray bottom plate 60D.

Therefore, in the recording sheet detector 120, when the sheet feeding tray 60 is contained in the printer body, depending on the number of the recording sheets 5 loaded in the loading part 60A, the one end portion of the recording sheet 5 is pressed against the lever front end part 125B of the detection lever 124 at a different angle.

Therefore, in the recording sheet detector 120, the length of the lever body 125 of the detection lever 124 is suitably selected and the end part of the lever front end part 125B is formed in an arc shape or in an arch shape.

Further, in the recording sheet detector 120, an inclination angle of the detection lever 124 at the non-load detection position with respect to the tray bottom plate 60D is suitably selected depending on a rotation torque when the detection lever 124 rotates from the non-load detection position toward the forward rotation direction in response to the pressing by the recording sheets 5, a friction coefficient of the surface of the recording sheets 5, and the like.

As a result, in the recording sheet detector 120, when the sheet feeding tray 60 is contained in the printer body and the one end portion of the recording sheet 5 lifted by the lifting part 67 is pressed against the lever front end part 125B of the detection lever 124, regardless of the inclination angle of the one end portion of the recording sheet 5, the detection lever 124 can be properly rotated from the non-load detection position to the load detection position in the forward rotation direction without being caught by the surface of the recording sheet 5.

However, in the sheet feeding tray 60, as described above, when the number of the recording sheets 5 that are placed on the placing plate 67A of the lifting part 67 becomes a number of about one or several sheets, in accordance with the bias force of the compression coil spring 69, the lifting part 67 can be rotated to the lifting upper limit position.

In the recording sheet detector 120, as described above, even when the lifting part 67 in the sheet feeding tray 60 is rotated to the lifting upper limit position, when one or several recording sheets 5 are placed on the placing plate 67A, due to that the recording sheets 5 are pressed from below against the lever front end part 125B, the detection lever 124 is moved more toward the load detection position in the forward rotation direction than the non-load detection position.

Therefore, in the recording sheet detector 120, also in this case, the light receiving element receives the detection light with the light receiving surface and transmits a detection signal of the logic "L" level to the controller 90.

Therefore, based on the detection signal provided from the light receiving element of the recording sheet detector 120, the controller 90 detects that the recording sheets 5 are properly loaded in the sheet feeding tray 60 in a manner allowing the recording sheets 5 to be fed out.

However, in the recording sheet detector 120, when the sheet feeding tray 60 becomes empty in the state in which the lifting part 67 is lifted to the lifting upper limit position, in order to detect that the recording sheets 5 are not properly loaded in the sheet feeding tray 60, it is necessary to rotate the detection lever 124 in the combined state from the load detection position to the non-load detection position in the backward rotation direction, which is below the placing plate 67A.

Therefore, in the sheet feeding tray 60 (FIGS. 2 and 3), on the placing plate 67A of the lifting part 67 and at a position opposing the detection lever 124 of the recording sheet detector 120, a lever insertion hole 67AX long in the printer front-rear direction is drilled. The shape of the lever insertion hole 67AX is properly designed in order not to make a front/distal end of the detection lever 124 contact the bottom of the sheet supply tray 60 while the detection lever 124 travels from the non-load detection position to the retreat position. This is a technical consideration for a state where the amount of loaded sheets is small.

Figure 9:
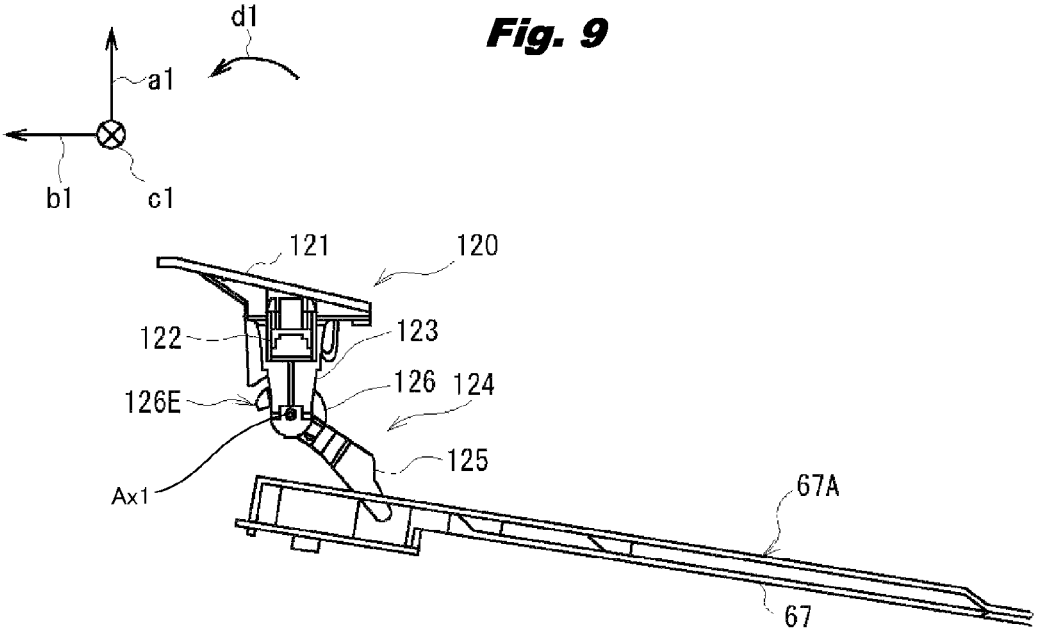
FIG. 9 illustrates a schematic side view for describing the recording sheet detector when the sheet feeding tray is empty, illustrating the non-load detection position.

Therefore, as illustrated in FIG. 9, in the recording sheet detector 120, when all the recording sheets 5 are fed out from the sheet feeding tray 60 and the loading part 60A becomes empty, the detection lever 124 in the combined state can be rotated from the load detection position to the non-load detection position in the backward rotation direction in a manner that the lever front end part 125B is inserted into the lever insertion hole 67AX.

As a result, in the recording sheet detector 120, as described above, when the sheet feeding tray 60 becomes empty, since the light receiving element cannot receive the detection light with the light receiving surface, a detection signal of the logic "H" level is transmitted to the controller 90.

Therefore, in this case, based on the detection signal provided from the light receiving element of the recording sheet detector 120, the controller 90 can detect that the recording sheets 5 are not properly loaded in the sheet feeding tray 60 (that is, the loading part 60A of the sheet feeding tray 60 is empty).

Further, in the recording sheet detector 120, as described above, in the state in which the detection lever 124 in the combined state is stopped at the non-load detection position, when an empty sheet feeding tray 60 is erroneously contained in the printer body, even when the lifting part 67 is automatically lifted to the lifting upper limit position, the detection lever 124 can be stopped at the non-load detection position by inserting the lever front end part 125B into the lever insertion hole 67AX.

Therefore, in the recording sheet detector 120, as described above, also when an empty sheet feeding tray 60 is erroneously contained in the printer body, since the light receiving element cannot receive the detection light with the light receiving surface, a detection signal of the logic "H" level can be transmitted to the controller 90.

In this case, based on the detection signal provided from the light receiving element of the recording sheet detector 120, the controller 90 can detect that the recording sheets 5 are not properly loaded in the sheet feeding tray 60 (that is, the loading part 60A of the sheet feeding tray 60 is empty).

In this way, when the sheet feeding tray 60, in which the recording sheets 5 are properly loaded in a manner allowing the recording sheets 5 to be fed, is contained in the printer body, the detection lever 124 in the combined state rotates from the non-load detection position to the load detection position in the forward rotation direction and the signal level of the detection signal provided from the light receiving element lowers to the logic "L" level. Therefore, in response to this, the controller 90 can detects that the recording sheets 5 are properly loaded in the sheet feeding tray 60 in a manner allowing the recording sheets 5 to be fed out.

Further, when an empty sheet feeding tray 60 is erroneously contained in the printer body, or when the sheet feeding tray 60 contained in the printer body becomes empty, the detection lever 124 in the combined state rotates to the non-load detection position and the signal level of the detection signal provided from the light receiving element rises to the logic "H" level. Therefore, in response to this, the controller 90 can detect that the recording sheets 5 are not properly loaded in the sheet feeding tray 60 (that is, the sheet feeding tray 60 is empty).

When the recording sheets 5 are loaded in the sheet feeding tray 60 contained in the printer body, the controller 90 can suitably execute the print image formation process described above with respect to FIG. 1.

In contrast to this, when the recording sheets 5 are not properly loaded in the sheet feeding tray 60 contained in the printer body, the controller 90 displays in the display 91 a predetermined message for notifying that the recording sheets 5 are not properly loaded and outputs a predetermined sound from the speaker 92 for notifying that the recording sheets 5 are not properly loaded.

As a result, when the recording sheets 5 are not properly loaded in the sheet feeding tray 60, the controller 90 can notify the user via the display 91 and the speaker 92 that the recording sheets 5 are not properly loaded in the sheet feeding tray 60 and prompt the user to load the recording sheets 5 in the sheet feeding tray 60.

Figure 10A:
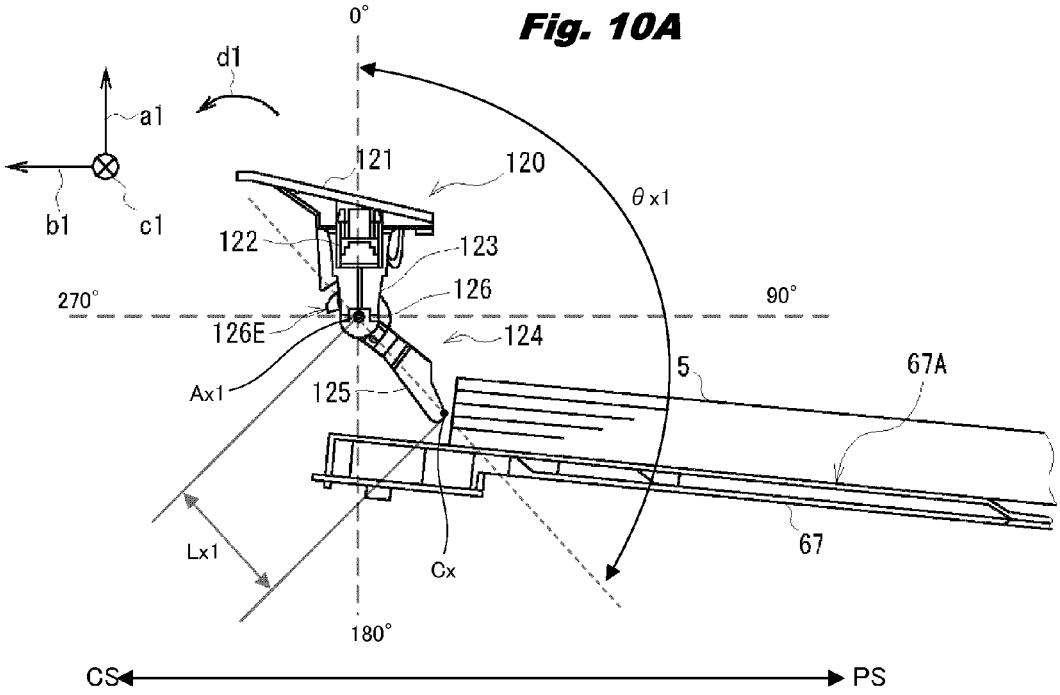
FIGS. 10A-10C illustrate schematic side views for describing retreat of the detection lever of the recording sheet detector when a plurality of recording sheets are loaded in the sheet feeding tray in a manner that a position of the recording sheets is shifted toward a tray containing side.

However, as illustrated in FIG. 10A, in the recording sheet detector 120, when the sheet feeding tray 60 in which a plurality of the recording sheets 5 are loaded in the loading part 60A in a manner that the position of the recording sheets 5 is shifted toward the tray containing side is contained in the printer body, the one end portions of the recording sheets 5 that are automatically lifted by the lifting part 67 are positioned more on the tray containing side (that is, the rear side) than the lever front end part 125B.

That is, in the recording sheet detector 120, in this case, even when the one end portions of the plurality of the recording sheets 5 are lifted by the lifting part 67 in the sheet feeding tray 60, the one end portions of the plurality of the recording sheets 5 are not pressed against the lever front end part 125B. Therefore, the detection lever 124 remains at the non-load detection position in front of the one end portions of the plurality of the recording sheets 5 (that is, portions of short sides on the tray pulling out side) without being rotated in the forward rotation direction.

Therefore, in the recording sheet detector 120, the detection light remains being blocked by the light blocking part 126C, and, since the light receiving element cannot receive the detection light with the light receiving surface, a detection signal of the logic "H" level is transmitted to the controller 90.

Therefore, in this case, even when the recording sheets 5 are loaded in the sheet feeding tray 60 contained in the printer body, based on the detection signal provided from the light receiving element of the recording sheet detector 120, the controller 90 detects that the recording sheets 5 are not properly loaded in the sheet feeding tray 60 and notifies the user about the detection.

Figure 10B:
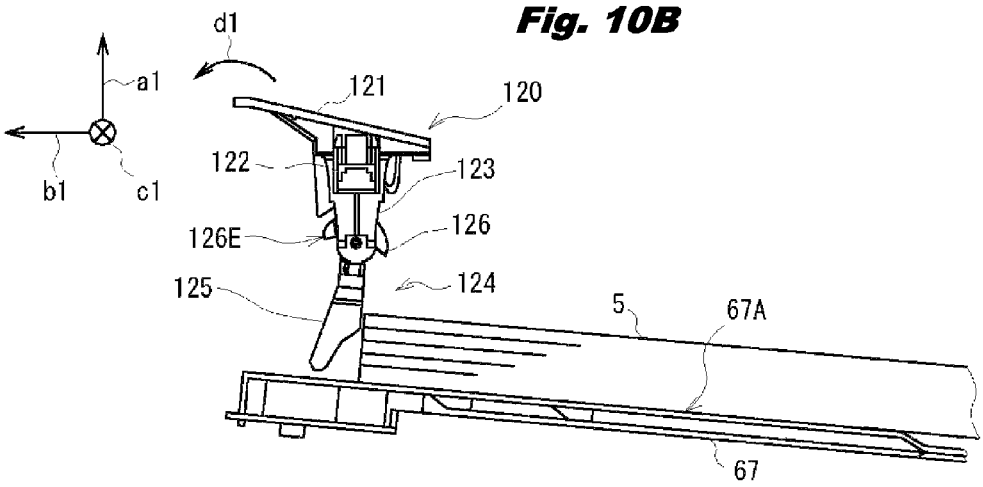

As a result, as illustrated in FIG. 10B, in the recording sheet detector 120, when the sheet feeding tray 60 moves toward the tray pulling out side as being pulled out from the printer body by the user who has received the notification, since the lever front end part 125B is positioned in front of the one end portions of the plurality of the recording sheets 5, the one end portions of the plurality of the recording sheets 5 are pressed from the tray containing side against the lever front end part 125B so that a pressing force to rotate the detection lever 124 in the backward rotation direction is applied to the detection lever 124.

However, in the recording sheet detector 120, in this case, as described above, in response to the pressing force applied by the pressing of the plurality of the recording sheets 5, the lever body 125 of the detection lever 124 can individually start to be rotated from the non-load detection position in the backward rotation direction.

Figure 10C:
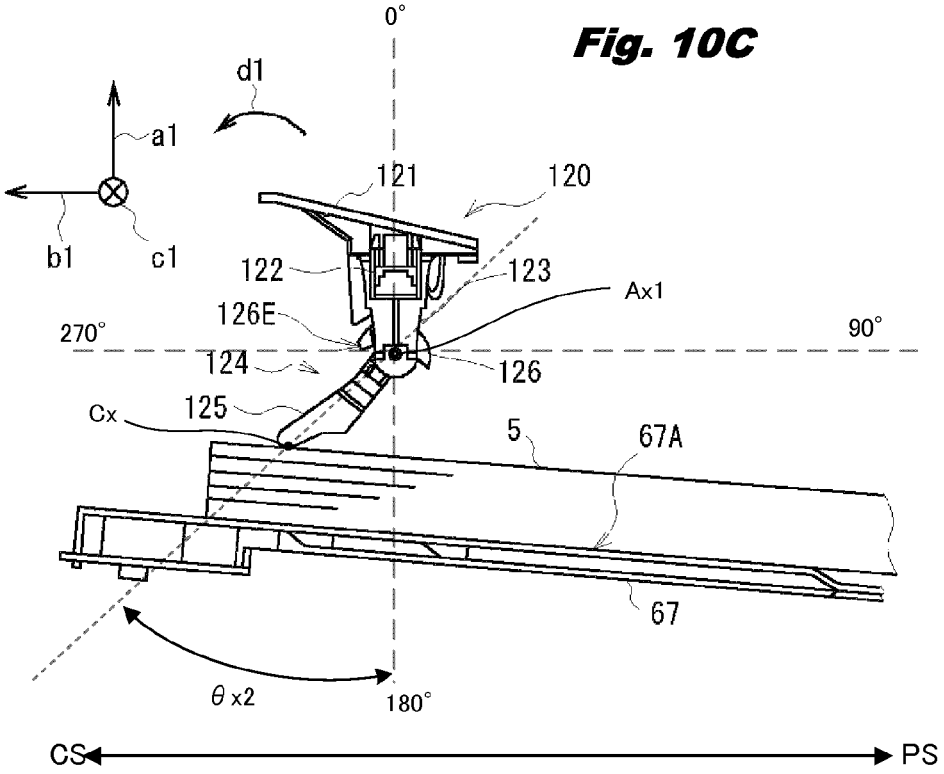

Further, as illustrated in FIG. 10C, in the recording sheet detector 120, when the sheet feeding tray 60 is pulled out from the printer body, since the lifting part 67 is gradually lowered, as the sheet feeding tray 60 further moves toward the tray pulling out side, the lever body 125 is further rotated in the backward rotation direction along a path sequentially from the one ends of the plurality of the recording sheets 5 to the surface of the recording sheet 5 positioned uppermost.

That is, in the recording sheet detector 120, in response to the movement of the sheet feeding tray 60 toward the tray pulling out side, the lever body 125 can be individually rotated in the backward rotation direction while the plurality of the recording sheets 5 are pushed under the lever body 125.

Further, in the recording sheet detector 120, when the sheet feeding tray 60 tray has moved some distance toward the pulling out side and the plurality of the recording sheets 5 are separated away from the lever front end part 125B, while the sheet feeding tray 60 is being pulled out toward the tray pulling out side, the lever body 125 of the detection lever 124 is rotated to return to the non-load detection position in the forward rotation direction in accordance with the bias force of the torsion spring 127.

As a result, in the recording sheet detector 120, the sheet feeding tray 60 can be completely pulled out from the printer body and the detection lever 124 can be again returned to the combined state.

Here, for comparison with the detection lever 124 according to the first embodiment, a case is described using FIG. 11 and FIGS. 12A-12C, where, in the recording sheet detector 120, for example, another detection lever (hereinafter, this is also referred to as comparison detection lever) 130 like that formed by integrating the entire detection lever 124 is provided.

Figure 11:
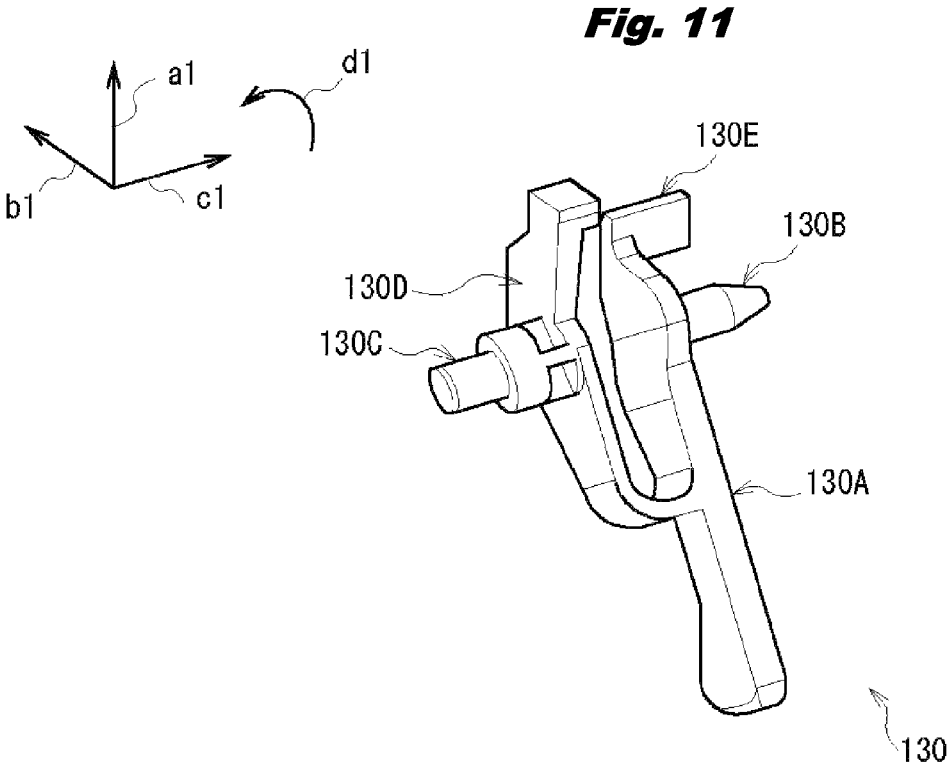
FIG. 11 illustrates a schematic perspective view of a configuration of a comparison detection lever.

As illustrated in FIG. 11, the comparison detection lever 130 has a shape, which is made to match as much as possible the shape of the detection lever 124 according to the first embodiment, and in which, for example, on a lever base part of a substantially Y-shaped lever body 130A, a first and second rotation shafts 130B, 130C, a light blocking part 130D and a stopper 130E are integrally provided.

Figure 12A:
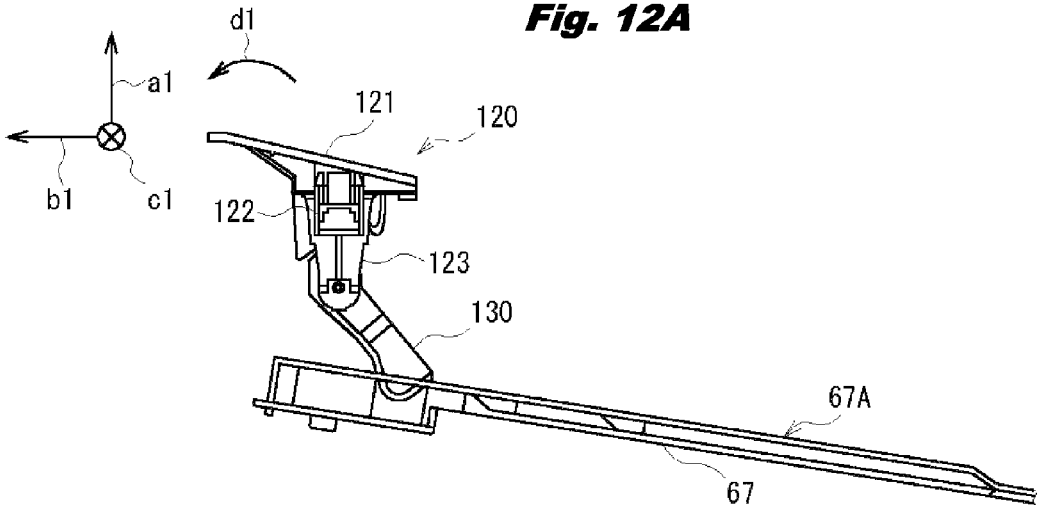
FIGS. 12A-12C illustrate schematic side views for describing a case where the comparison detection lever is provided in the recording sheet detector.

Therefore, as illustrated in FIG. 12A, in the recording sheet detector 120, in the case where the comparison detection lever 130 is provided in place of the detection lever 124 according to the first embodiment, when there is no external pressing force, the comparison detection lever 130 rotates in the backward rotation direction due to its self weight.

Further, in the recording sheet detector 120, when the comparison detection lever 130 rotates to the non-load detection position in the backward rotation direction, the stopper 130E is pressed against the first support leg part 123B of the lever support part 123 from the tray pulling out side.

As a result, in the recording sheet detector 120, the rotation of the comparison detection lever 130 in the backward rotation direction is stopped at the non-load detection position and the light blocking part 130D is inserted into between the first and second sensor arrangement parts 122B, 122C of the sensor containing case 122 (that is, between the light emitting element and the light receiving element) from the tray pulling out side.

Therefore, in the recording sheet detector 120, when an empty sheet feeding tray 60 is erroneously contained in the printer body or when the recording sheets 5 are all fed out so that the sheet feeding tray 60 contained in the printer body becomes empty, the comparison detection lever 130 can remain at the non-load detection position or can rotate to the non-load detection position so that the detection light is blocked by the light blocking part 130D.

Therefore, in the case where the comparison detection lever 130 is provided, the recording sheet detector 120 allows the controller 90 to detect that the sheet feeding tray 60 is empty.

Figure 12B:
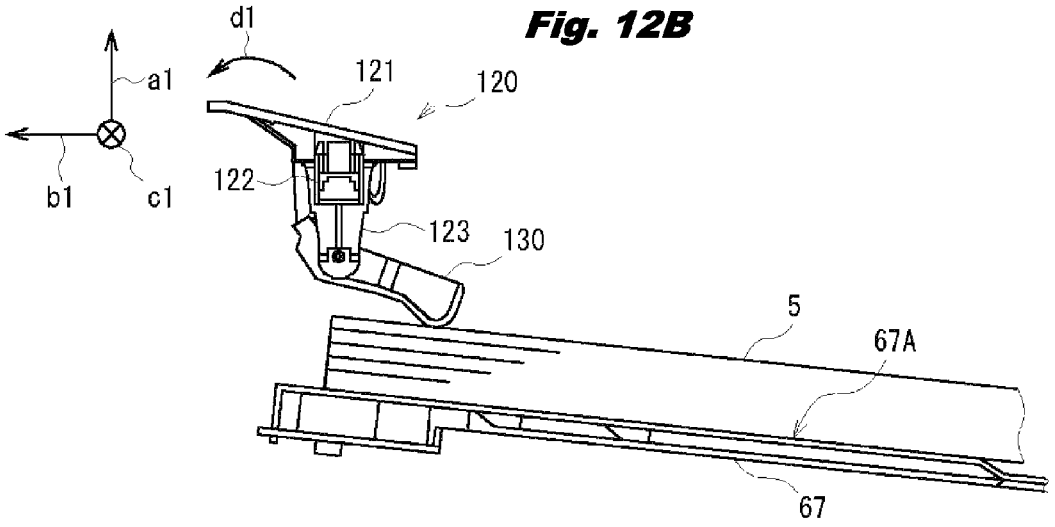

Further, as illustrated in FIG. 12B, in the recording sheet detector 120, when the recording sheets 5 are properly loaded in the sheet feeding tray 60 contained in the printer body in a manner allowing the recording sheets 5 to be fed, one end portions of the recording sheets 5 lifted by the lifting part 67 are pressed against the lever front end part of the comparison detection lever 130 and a pressing force to rotate the comparison detection lever 130 in the forward rotation direction is applied to the comparison detection lever 130.

Therefore, in the recording sheet detector 120, in response to the pressing force applied by the pressing of the recording sheets 5, the comparison detection lever 130 is rotated from the non-load detection position in the forward rotation direction.

As a result, in the recording sheet detector 120, in response to the rotation of the comparison detection lever 130 in the forward rotation direction, the stopper 130E is separated away from the first support leg part 123B of the lever support part 123, and the light blocking part 130D is pulled out from between the first and second sensor arrangement parts 122B, 122C of the sensor containing case 122 (that is, between the light emitting element and the light receiving element) toward the tray pulling out side.

Therefore, in the recording sheet detector 120, in this case, the detection light can be received by the light receiving surface of the light receiving element. Therefore, as described above, in the case where the comparison detection lever 130 is provided, the recording sheet detector 120 allows the controller 90 to detect that the recording sheets 5 are loaded in the sheet feeding tray 60.

Figure 12C:
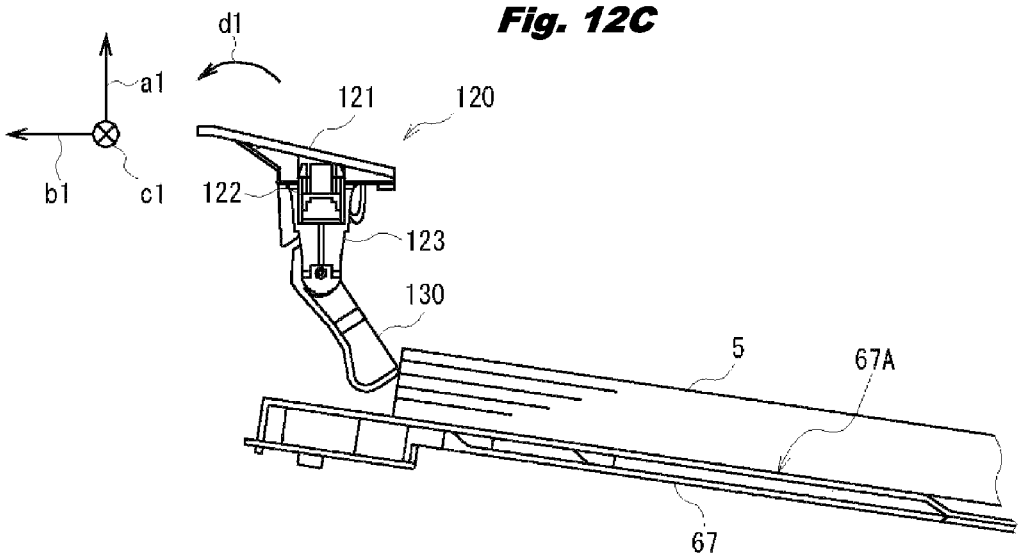

However, as illustrated in FIG. 12C, in the recording sheet detector 120, also in the case where the comparison detection lever 130 is provided, when the sheet feeding tray 60 in which a plurality of the recording sheets 5 are loaded in the loading part 60A in a manner that the position of the recording sheets 5 is shifted toward the tray containing side is contained in the printer body, the one end portions of the recording sheets 5 that are lifted by the lifting part 67 are positioned more on the tray containing side than the lever front end part.

Therefore, in the recording sheet detector 120, the comparison detection lever 130 is not rotated in the forward rotation direction, but remains at the non-load detection position, so that the detection light remains to be blocked by the light blocking part 130D and the controller 90 is caused to detect that the sheet feeding tray 60 is empty.

In the recording sheet detector 120, in this case, when the sheet feeding tray 60 moves toward the tray pulling out side as being pulled out by the user from the printer body, one ends of the plurality of the recording sheets 5 are pressed against the lever front end part from the tray containing side and a pressing force to rotate the comparison detection lever 130 in the backward rotation direction is applied to the comparison detection lever 130.

However, in the recording sheet detector 120, the comparison detection lever 130 is integrally formed and is provided in such a manner that, at the non-load detection position, the stopper 130E is pressed against the first support leg part 123B of the lever support part 123 from the tray pulling out side so that the comparison detection lever 130 does not rotate from the non-load detection position in the backward rotation direction.

Therefore, in the recording sheet detector 120, the comparison detection lever 130 cannot be rotated even when a pressing force to rotate the comparison detection lever 130 in the backward rotation direction is applied, and the plurality of the recording sheets 5 that move along with the sheet feeding tray 60 toward the tray pulling out side are caught by the comparison detection lever 130.

In the recording sheet detector 120, when the sheet feeding tray 60 further moves toward the tray pulling out side, since the plurality of the recording sheets 5 are attempting to move toward the tray pulling out side in a state of being pressed against the comparison detection lever 130, which is positioned to block the movement of the plurality of the recording sheets 5, the plurality of the recording sheets 5 become damaged, such as being bent to become wrinkled or being caused to have breaks.

As described above, when the comparison detection lever 130 is provided in a manner not to rotate from the non-load detection position in the backward rotation direction, the recording sheet detector 120 cannot address the case where the plurality of the recording sheets 5 are loaded in the loading part 60A in the sheet feeding tray 60 contained in the printer body in a manner that the position of the recording sheets 5 is shifted toward the tray containing side.

In other words, when the comparison detection lever 130 is provided as described above, suppose that the sheet feeding tray 60 is configured in a manner always allowing the recording sheets 5 to be loaded without being positionally misaligned, the recording sheet detector 120 can be used to detect presence or absence of loaded recording sheets 5 in the sheet feeding tray 60.

However, when the comparison detection lever 130 is provided as described above, in the case where the sheet feeding tray 60 in which the plurality of the recording sheets 5 are loaded in a manner being positionally misaligned is pulled out from the printer body, since the plurality of the recording sheets 5 are damaged, the recording sheet detector 120 cannot be used for detecting, with respect to the loading part 60A of the sheet feeding tray 60, whether or not the plurality of the recording sheets 5 are properly loaded in a manner allowing the recording sheets 5 to be fed, including presence or absence of the loaded recording sheets 5.

Therefore, in the recording sheet detector 120, in practice, instead of the comparison detection lever 130, the above-described detection lever 124 is provided in a manner allowing the lever body 125 to be individually rotated from the non-load detection position in the backward rotation direction.

As a result, in the recording sheet detector 120, when the sheet feeding tray 60 in which the plurality of the recording sheets 5 are loaded in the loading part 60A in the manner that the position of the recording sheets 5 is shifted toward the tray containing side is pulled out from the printer body, the lever body 125 of the detection lever 124 is retreated to the tray pulling out side by allowing the lever body 125 to individually rotate in the backward rotation direction, so that the plurality of the recording sheets 5 are substantially surely prevented from being caught and damaged by the detection lever 124.

Therefore, by providing the detection lever 124 as described above, the recording sheet detector 120 can be used for detecting, with respect to the loading part 60A of the sheet feeding tray 60, whether or not the recording sheets 5 are properly loaded in the loading part 60A in a manner allowing the recording sheets 5 to be fed, including presence or absence of the loaded recording sheets 5.

However, when the sheet feeding tray 60 is pulled out from the printer body as described above, in response to the movement toward the tray pulling out side, the lifting part 67 is gradually lowered.

Therefore, in the recording sheet detector 120, when the sheet feeding tray 60 is pulled out from the printer body as described above, the rotation angle for the lever body 125 of the detection lever 124 to individually rotate from the non-load detection position in the backward rotation direction to retreat can be made as small as possible.

That is, in the recording sheet detector 120, the rotation angle from the non-load detection position to a position (hereinafter, this is also referred to as a retreat position) at which the lever body 125 of the detection lever 124 is retreated to be oriented obliquely forward and downward when the lever body 125 is individually rotated in the backward rotation direction can be made as small as possible.

Therefore, in the recording sheet detector 120, the lever body 125 of the detection lever 124 can be smoothly rotated from the non-load detection position to the retreat position substantially without being influenced by the bias force due to the torsion spring 127.

Therefore, in the recording sheet detector 120, when the lever body 125 of the detection lever 124 is rotated to the retreat position, although the lever front end part 125B slides from the one ends of the plurality of the recording sheets 5 to the surface of the recording sheet 5 positioned uppermost, the recording sheets 5 can be substantially surely prevented from being damaged by the sliding movement. The retreat position is illustrated in FIGS. 10C and 18C. At the retreat position, the lever body 125 and the front end (a contact point Cx that contacts the sheets in FIG. 10C) are positioned lower left from the rotation axis Ax1 (third quadrant). In the pulling out direction of the sheet tray, they may be defined the pulling out side (PS) than the rotation axis Ax1. Therewith, a pushing force of the loaded sheets that pushes the lever body 125 in the pulling out direction is fended, avoiding the damage on the sheets.

However, in the recording sheet detector 120, suppose that the detection light is blocked by the light blocking part 126C in order to detect that the recording sheets 5 are properly loaded in the sheet feeding tray 60 in a manner allowing the recording sheets 5 to be fed, the position of the detection lever 124 changes according to the number of the recording sheets 5 loaded in the sheet feeding tray 60. Therefore, in order to address this, it is necessary to relatively widen the width (that is, a length along the backward rotation direction) of the light blocking part 126C.

However, in the recording sheet detector 120, in the state in which the detection lever 124 is stopped at the non-load detection position by the stopper 126E, in order to detect that the recording sheets 5 are not properly loaded in the sheet feeding tray 60, the light blocking part 126C is inserted from the tray pulling out side into between the first and second sensor arrangement parts 122B, 122C to block the detection light.

That is, in the recording sheet detector 120, in order to detect that the recording sheets 5 are not properly loaded in the sheet feeding tray 60, the detection light is blocked by the light blocking part 126C while the rotation of the detection lever 124 (that is, the body holding part 126) remains being stopped.

Therefore, in the recording sheet detector 120, the width of the light blocking part 126C for blocking the detection light can be made as narrow as possible and, thus, enlargement of the detection lever 124 can be avoided.

Further, in the recording sheet detector 120, as described above, in the case where the length of the light blocking position regulation part 126D of the body holding part 126 is suitably selected and the light blocking position regulation part 126D and the light blocking part 126C are inserted into between the first and second sensor arrangement parts 122B, 122C of the sensor containing case 122, the other surface of the light blocking part 126C can be brought close to the one surface of the second sensor arrangement part 122C.

Therefore, in the recording sheet detector 120, when the lever body 125 of the detection lever 124 is being individually rotated to the retreat position in response to the pressing of the plurality of the recording sheets 5, even when distortion occurs to the lever body 125 and the body holding part 126 of the detection lever 124 due to the pressing of the recording sheets 5, the light blocking part 126C can be substantially surely prevented from being separated from the one surface of the second sensor arrangement part 122C or being deformed.

Therefore, in the recording sheet detector 120, also when the lever body 125 of the detection lever 124 is being individually rotated in the backward rotation direction, it is possible to maintain a state in which the other surface of the light blocking part 126C is brought close to the one surface of the second sensor arrangement part 122C and to continue to block the detection light.

In this way, in recording sheet detector 120, also when the lever body 125 of the detection lever 124 is being individually rotated to the retreat position, the body holding part 126 can remain at the non-load detection position without changing its state.

Further, in the recording sheet detector 120, when the lever body 125 of the detection lever 124 is individually rotated to the retreat position and the recording sheet 5 is separated away, in accordance with the bias force of the torsion spring 127, the lever body 125 is rotated to the non-load detection position in the forward rotation direction and again returns to the combined state.

However, in the recording sheet detector 120, the bias force of the torsion spring 127 for rotating the lever body 125 to the non-load detection position in the forward rotation direction is smaller than the pressing force that is generated by pressing the recording sheets 5 against the lever body 125 and tends to rotate the lever body 125 in the backward rotation direction.

Therefore, in the recording sheet detector 120, when the lever body 125 of the detection lever 124 is being rotated from the retreat position to the non-load detection position in the forward rotation direction, the body holding part 126 can be prevented from being acted on by an external force such as that causing the light blocking part 126C to be separated away from the one surface of the second sensor arrangement part 122C or to be deformed.

Therefore, in the recording sheet detector 120, even when the lever body 125 of the detection lever 124 is rotated from the retreat position to the non-load detection position in the forward rotation direction, and the lever body 125 is again returned along with the body holding part 126 to the combined state, the detection light blocking state due to the light blocking part 126C can be prevented from being changed before and after the lever body 125 is individually rotated.

(1-3) Operation and Effect of First Embodiment

In the above-described configuration, in the color printer 1, the sheet feeding tray 60, in which the recording sheets 5 of a plurality of kinds of different sizes are loaded by defining a loading area according to the sizes of the recording sheets 5, is provided capable of being pulled out therefrom and contained therein.

Further, in the color printer 1, the detection lever 124 that is configured by the lever body 125, the body holding part 126 and the torsion spring 127 is rotatably provided via the lever support part 123 at a position above the end part on the tray pulling out side of the sheet feeding tray 60 for detecting whether or not the recording sheets 5 are properly loaded in the sheet feeding tray 60 in a manner allowing the recording sheets 5 to be fed out. The body holding part 126 rotatably holds the lever body 125. The torsion spring 127 is for integrating the lever body 125 and the body holding part 126.

Further, in the color printer 1, when a pressing force to rotate the detection lever 124 is not applied from outside to the detection lever 124, the detection lever 124 in the combined state with the lever front end part 125B being oriented toward the tray containing side is rotated to the non-load detection position on a lower side for detecting that the recording sheets 5 are not properly loaded in the sheet feeding tray 60.

Further, in the color printer 1, when a pressing force to rotate the detection lever 124 in the non-load detection position toward an upper side is applied from outside to the detection lever 124, the detection lever 124 in the combined state with the lever front end part 125B being oriented toward the tray containing side is rotated to the load detection position on an upper side for detecting that the recording sheets 5 are properly loaded in the sheet feeding tray 60.

Further, in the color printer 1, when a pressing force to rotate the detection lever 124 in the non-load detection position toward the tray pulling out side is applied from outside to the detection lever 124, the lever body 125 of the detection lever 124 is individually rotated to the retreat position on the tray pulling out side.

Therefore, in the color printer 1, when the sheet feeding tray 60 contained therein is empty, the detection lever 124 in the combined state with the lever front end part 125B being oriented toward the tray containing side is rotated to the non-load detection position on the lower side and that the recording sheets 5 are not properly loaded in the sheet feeding tray 60 can be detected.

Further, in the color printer 1, when the recording sheets 5 are properly loaded in the sheet feeding tray 60 contained therein, in response to the pressing of the recording sheets 5 from below against the lever body 125, the detection lever 124 in the combined state with the lever front end part 125B being oriented toward the tray containing side is rotated to the load detection position on an upper side and that the recording sheets 5 are properly loaded in the sheet feeding tray 60 can be detected.

Further, in the color printer 1, when the plurality of the recording sheets 5 are loaded in the sheet feeding tray 60 contained therein in a manner that the position of the recording sheets 5 is shifted toward the tray containing side, since the recording sheets 5 are not positioned below the detection lever 124, the detection lever 124 in the combined state with the lever front end part 125B being oriented toward the tray containing side is rotate to the non-load detection position on the lower side and that the recording sheets 5 are not properly loaded in the sheet feeding tray 60 can be detected.

Further, in the color printer 1, in the state in which the detection lever 124 is rotated to the non-load detection position as described above, when the sheet feeding tray 60 in which the plurality of the recording sheets 5 are loaded in a manner that the position of the recording sheets 5 is shifted toward the tray containing side is pulled out, in response to the pressing of the plurality of the recording sheets 5 from the tray containing side due to the pulling out of the sheet feeding tray 60, the lever body 125 of the detection lever 124 can be individually rotated from the non-load detection position toward the tray pulling out side to retreat.

Therefore, in the color printer 1, when the sheet feeding tray 60 in which the plurality of the recording sheets 5 are loaded in a manner that the position of the recording sheets 5 is shifted toward the tray containing side is pulled out, the detection lever 124 can avoid blocking the path of the plurality of the recording sheets 5 that move along with the sheet feeding tray 60 toward the tray pulling out side so that the sheet feeding tray 60 together with the plurality of the recording sheets 5 can be completely pulled out.

According to the above-described configuration, in the color printer 1, the sheet feeding tray 60, in which the recording sheets 5 of a plurality of kinds of different sizes are loaded by defining a loading area according to the sizes of the recording sheets 5, is provided capable of being pulled out therefrom and contained therein; and the detection lever 124 having the lever body 125, the body holding part 126 and the torsion spring 127 is rotatably provided via the lever support part 123 at a position above the end part on the tray pulling out side of the sheet feeding tray 60 for detecting whether or not the recording sheets 5 are properly loaded in the sheet feeding tray 60 in a manner allowing the recording sheets 5 to be fed out. When a pressing force to rotate the detection lever 124 is not applied from outside to the detection lever 124, the detection lever 124 in the combined state with the lever front end part 125B being oriented toward the tray containing side is rotated to the non-load detection position on the lower side for detecting that the recording sheets 5 are not properly loaded in the sheet feeding tray 60. When a pressing force to rotate the detection lever 124 in the non-load detection position toward the upper side is applied from outside to the detection lever 124, the detection lever 124 in the combined state with the lever front end part 125B being oriented toward the tray containing side is rotated to the load detection position on an upper side for detecting that the recording sheets 5 are properly loaded in the sheet feeding tray 60. Further, when a pressing force to rotate the detection lever 124 in the non-load detection position toward the tray pulling out side is applied from outside to the detection lever 124, the lever body 125 of the detection lever 124 is individually rotated to the retreat position on the tray pulling out side.

As a result, in the color printer 1, when the plurality of the recording sheets 5 are loaded in the sheet feeding tray 60 in a manner that the position of the recording sheets 5 is shifted toward the tray containing side, the detection lever 124 in the combined state is positioned at the non-load detection position, and that the recording sheets 5 are not properly loaded in the sheet feeding tray 60 can be detected. In this state, when the sheet feeding tray 60 is pulled out, in response to the pressing from the tray containing side by the plurality of the recording sheets 5 that move along with the sheet feeding tray 60 toward the tray pulling out side, the lever body 125 of the detection lever 124 can be individually rotated from the non-load detection position toward the tray pulling out side to retreat from the path of the plurality of the recording sheets 5.

Therefore, in the color printer 1, when the sheet feeding tray 60 in which the plurality of the recording sheets 5 are loaded in a manner that the position of the recording sheets 5 is shifted toward the tray containing side is pulled out, the plurality of the recording sheets 5 can be prevented from being damaged by the detection lever 124.

Further, in the color printer 1, the lever body 125 is rotatably held by the body holding part 126 in the detection lever 124, and the lever body 125 is biased by the torsion spring 127 to rotate toward the upper side with respect to the body holding part 126. Thereby, the body holding part 126 and the lever body 125 are combined in a manner that the abutting part 125E that is provided on the lever body 125 is butted against the engagement part 126F that is provided on the body holding part 126.

Further, in the color printer 1, when the detection lever 124 in the combined state is rotated to the non-load detection position on the lower side, the stopper 126E that is provided on the body holding part 126 is butted against the second support leg part 123C of the lever support part 123 from the tray pulling out side and the rotation of the detection lever 124 is stopped.

Therefore, in the color printer 1, the rotation of the detection lever 124 for detecting whether or not the recording sheets 5 are properly loaded in the sheet feeding tray 60 in a manner allowing the recording sheets 5 to be fed out and the retreat of the detection lever 124 when the sheet feeding tray 60 in which the plurality of the recording sheets 5 are loaded in a manner that the position of the recording sheets 5 is shifted toward the tray containing side is pulled out can be easily realized with a simple configuration.

Further, in the color printer 1, the lifting part 67 is provided in the loading part 60A of the sheet feeding tray 60 in the following manner. On one end part of the lifting part 67 on the tray pulling out side, one end portions of the loaded recording sheets 5 are placed. When the sheet feeding tray 60 is contained in the color printer 1, the one end portions of the recording sheets 5 are obliquely lifted, and when the sheet feeding tray 60 is pulled out from the color printer 1, the one end portions of the recording sheets 5 are gradually lowered.

Therefore, in the color printer 1, when the sheet feeding tray 60 in which the plurality of the recording sheets 5 are loaded in a manner that the position of the recording sheets 5 is shifted toward the tray containing side is pulled out, although the lever body 125 of the detection lever 124 is individually rotated from the non-load detection position to the retreat position on the tray pulling out side against the bias force of the torsion spring 127, in response to the movement of the sheet feeding tray 60 toward the tray pulling out side, the one end portions of the plurality of the recording sheets 5 are gradually lowered. Thereby, the rotation angle from the non-load detection position to the retreat position with respect to the lever body 125 can be made as small as possible.

Therefore, in the color printer 1, when the sheet feeding tray 60 in which the plurality of the recording sheets 5 are loaded in a manner that the position of the recording sheets 5 is shifted toward the tray containing side is pulled out, the lever body 125 can be smoothly rotated to the retreat position substantially without being influenced by the bias force due to the torsion spring 127.

As a result, in the color printer 1, in this case, along with the movement of the sheet feeding tray 60 toward the tray pulling out side, although the lever front end part 125B slides from the one ends of the plurality of the recording sheets 5 to the surface of the recording sheet 5 positioned uppermost, the recording sheets 5 can be substantially surely prevented from being damaged by the sliding movement.

Further, in the color printer 1, between the first and second support leg parts 123B, 123C that rotatably support the detection lever 124 in the lever support part 123, along with the detection lever 124, the pair of the first and second sensor arrangement parts 122B, 122C that contain the light emitting element and the light receiving element for detecting whether or not the recording sheets 5 are properly loaded in the sheet feeding tray 60 in a manner allowing the recording sheets 5 to be fed out are arranged each having one surface opposing one surface of the other across a predetermined spacing.

Further, in the color printer 1, the light blocking part 126C is provided on the body holding part 126 of the detection lever 124 for blocking the detection light emitted from the light emitting element in the first sensor arrangement part 122B so that the detection light cannot be received by the light receiving element in the second sensor arrangement part 122C. When the detection lever 124 is rotated to the non-load detection position, the light blocking part 126C is inserted from the tray pulling out side into between the first and second sensor arrangement parts 122B, 122C for detecting that the recording sheets 5 are not properly loaded in the sheet feeding tray 60.

That is, when the light emitting element and the light receiving element are used along with the rotatable detection lever having the light blocking part for detecting whether or not the recording sheets 5 are properly loaded in the sheet feeding tray 60 in a manner allowing the recording sheets 5 to be fed, suppose that the light blocking part is used to block the detection light in order to detect that the recording sheets 5 are properly loaded in the sheet feeding tray 60 in a manner allowing the recording sheets 5 to be fed, since the position of the detection lever changes in response to the number of the recording sheets 5 loaded in the sheet feeding tray 60, it is necessary to relatively widen the width of the light blocking part along the rotation direction of the detection lever.

However, in the color printer 1, in the state in which the rotation of the detection lever 124 is stopped at the non-load detection position, since the detection light is blocked by the light blocking part 126C, the width of the light blocking part 126C can be made as small as possible. As a result, enlargement of the detection lever 124 can be avoided.

Further, in the color printer 1, the light blocking position regulation part 126D is provided on the front end part of the one surface of the light blocking part 126C on the body holding part 126 of the detection lever 124. When the light blocking part 126C and the light blocking position regulation part 126D are inserted from the tray pulling out side into between the first and second sensor arrangement parts 122B, 12C, the other surface of the light blocking part 126C is brought close to the one surface of the second sensor arrangement part 122C, and the end surface of the light blocking position regulation part 126D is brought to the one surface of the first sensor arrangement part 122B.

Therefore, in the color printer 1, when the detection lever 124 in the combined state rotates to the non-load detection position and the light blocking part 126C and the light blocking position regulation part 126D are inserted from the tray pulling out side into between the first and second sensor arrangement parts 122B, 122C, or when the lever body 125 individually rotates toward the tray pulling out side in the state in which the light blocking part 126C and the light blocking position regulation part 126D remain being inserted from the tray pulling out side into between the first and second sensor arrangement parts 122B, 122C and rotates to return from the retreat position to the non-load detection position, the light blocking part 126C can be substantially prevented from being separated away from the one surface of the second sensor arrangement part 122C or from being deformed.

Therefore, in the color printer 1, in this case, it can be substantially surely prevented that the detection light passes around the light blocking part 126C and is received by the light receiving element and the detection light blocking state due to the light blocking part 126C can be maintained.

Further, in the color printer 1, when whether or not the recording sheets 5 are properly loaded in the sheet feeding tray 60 in a manner allowing the recording sheets 5 to be fed out is detected, the signal level of the detection signal output by the light receiving element is lowered to the logic "L" level when the detection light is received and is raised to the logic "H" level when the detection light is not received.

Therefore, in the color printer 1, for example, in a state in which the light emitting element malfunctions so that the detection light cannot be emitted, when the sheet feeding tray 60 in which the recording sheets 5 are not properly loaded is contained in the printer body, it can be surely avoided to erroneously detect that the recording sheets 5 are properly loaded in the sheet feeding tray 60 in a manner allowing the recording sheets 5 to be fed out and wastefully perform a print image formation process.

(2) Second Embodiment (2-1) Internal Configuration of Color Printer

Next, an internal configuration of a color printer 150 (FIG. 1) according a second embodiment is described. The color printer 150 according to the second embodiment is similarly configured to the color printer 1 according to the first embodiment except a partial configuration of a sheet feeding part 151 (FIG. 1).

The color printer 150 according to the second embodiment, basically, operates in the same manner as the above-described color printer 1 according to the first embodiment to form a print image on the surface of the recording sheet 5.

Therefore, for details of the internal configuration of the color printer 150 according to the second embodiment, see the description of the internal configuration of the color printer 1 according to the first embodiment described above using FIG. 1. A description about the details of the internal configuration of the color printer 150 is omitted here.

(2-2) Configuration of Sheet Feeding Part

Figure 13:
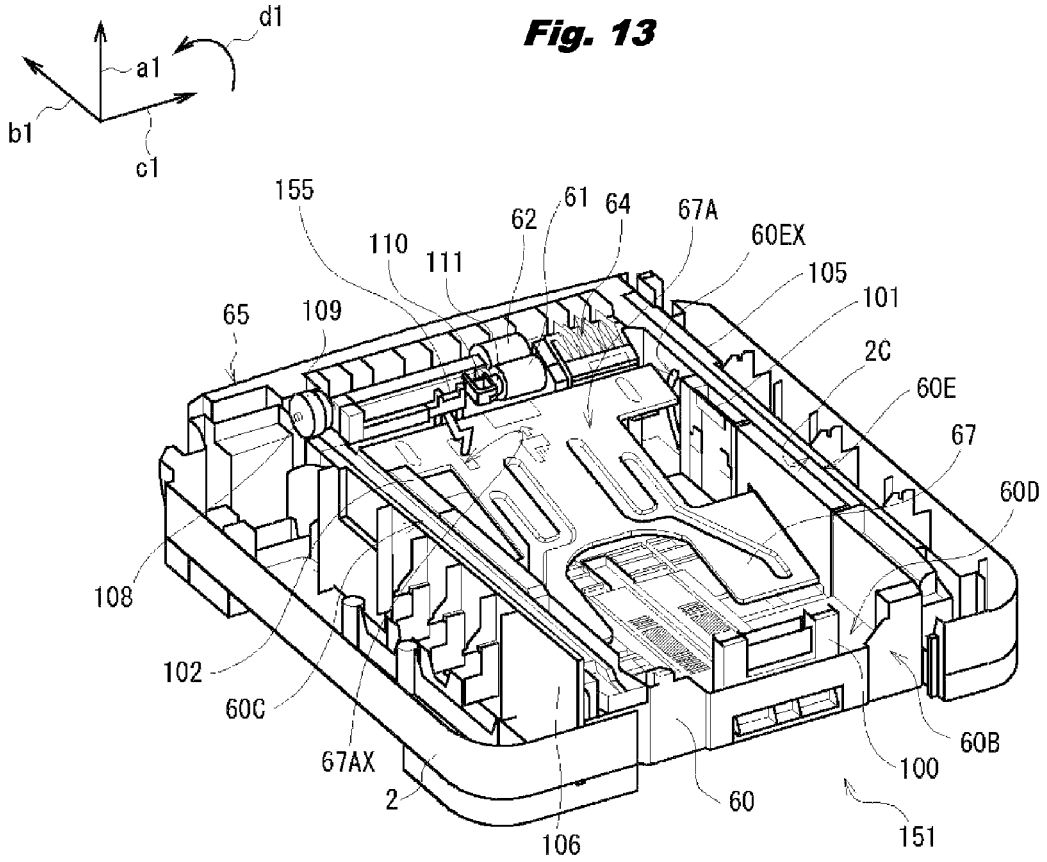
FIG. 13 illustrates a schematic perspective view of a configuration of a sheet feeding part according to a second embodiment.
Figure 14:
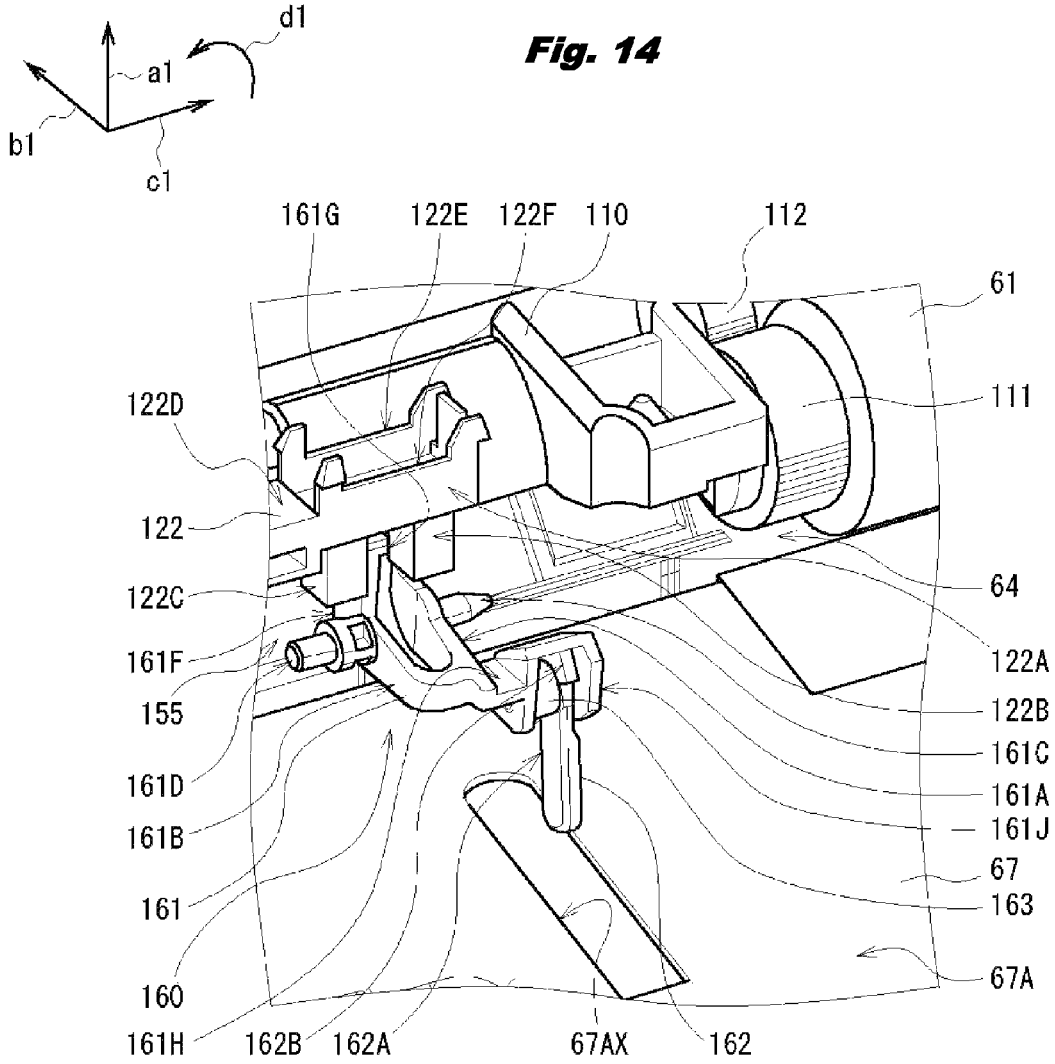
FIG. 14 illustrates a schematic perspective view for describing an arrangement position of a recording sheet detector.

Next, a configuration of the sheet feeding part 151 is described using FIGS. 13 and 14, in which the same reference numeral symbols are used to indicate corresponding parts in FIGS. 2 and 3.

As illustrated in FIGS. 13 and 14, the sheet feeding part 151 similarly configured to the above-described sheet feeding part 8 according to the first embodiment except an arrangement position of a recording sheet detector 155 and a configuration of a detection lever 160 provided in the recording sheet detector 155.

The recording sheet detector 155 is positioned on the right side of the roller connecting part 110 in the printer body (that is, in the printer housing 2), for example, for keeping a balanced arrangement position relative to the other printer configuration components. However, the recording sheet detector 155 is positioned at a predetermined position that is more spaced away from the roller connecting part 110 than the arrangement position of the recording sheet detector 120 according to the above-described first embodiment.

In FIGS. 13 and 14, the recording sheet detector 155 is illustrated in a simplified manner by excluding a part of the configuration. However, the recording sheet detector 155 has a detector base 121, a sensor containing case 122 and a lever support part 123 that are the same as the detector base 121, the sensor containing case 122 and the lever support part 123 of the recording sheet detector 120 according to the above-described first embodiment.

That is, in the recording sheet detector 155, with respect to the detector base 121, the sensor containing case 122 and the lever support part 123 are similarly assembled to the case of the recording sheet detector 120 according to the above-described first embodiment.

In the recording sheet detector 155, the detection lever 160 is further provided having a configuration different from that of the detection lever 124 of the recording sheet detector 120 according to the above-described first embodiment.

Figure 15A:
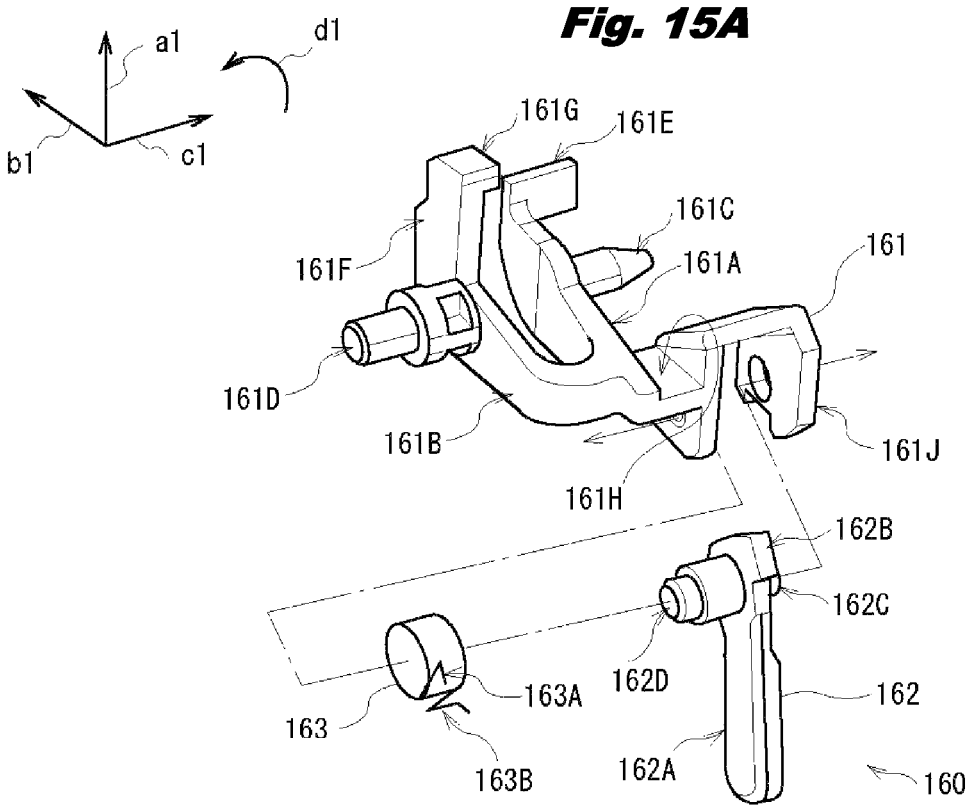
FIGS. 15A and 15B illustrate schematic perspective views of a configuration of a detection lever.
Figure 15B:
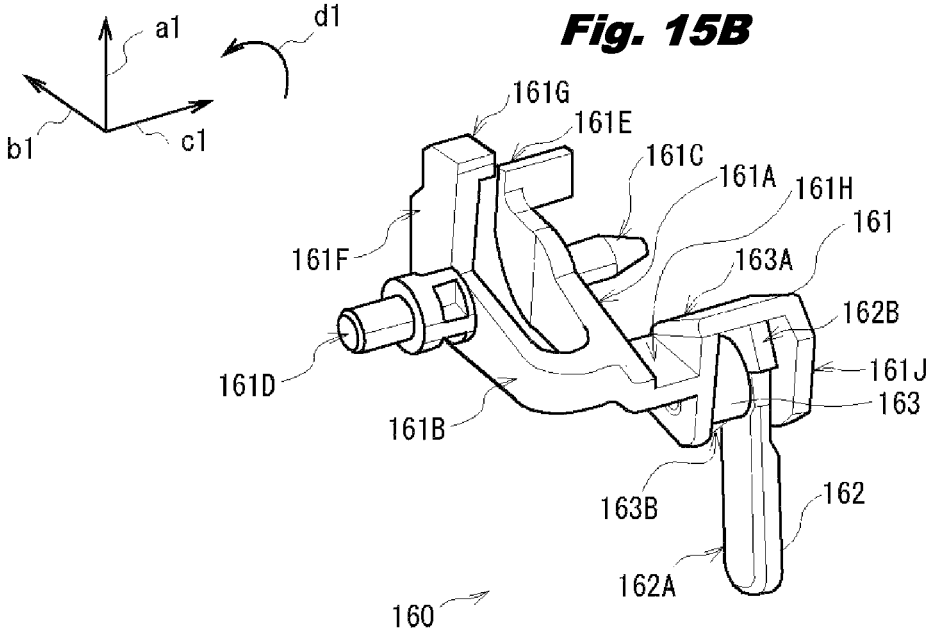

Therefore, in the following, with reference to FIGS. 15A and 15B, the configuration of the detection lever 160 provided in the recording sheet detector 155 is described.

The detection lever 160 has a lever base part 161, a lever front end part 162 and a torsion spring 163.

The lever base part 161 has a configuration like that in which the body holding part 126 (FIGS. 5A and 5B) and the lever base part 125A of the lever body 125 (FIGS. 5A and 5B), according to the above-described first embodiment, are combined.

That is, in the lever base part 161, on one end part of a substantially strip-like first leg part 161A, a substantially J-shaped plate-like second leg part 161B is provided forming a substantially U-shape in which the other end part of the first leg part 161A and the plate-like other end part of the second leg part 161B oppose each other in parallel across a predetermined spacing.

On the other end part on an outer surface of the first leg part 161A of the lever base part 161, a column-shaped first rotation shaft 161C of a predetermined length having a front end part formed in a tapered shape is perpendicularly provided.

Further, on the other end part on an outer surface of the second leg part 161B of the lever base part 161, a second rotation shaft 161D of a predetermined length of which a base part is slightly thicker than a front end part is perpendicularly provided in a manner that a center of the second rotation shaft 161D is position on an imaginary straight line passing through a center of the first rotation shaft 161C.

On the other end of the first leg part 161A of the lever base part 161, a substantially plate-like stopper 161E that regulates rotation of the lever base part 161 is provided in a manner that a longitudinal direction of the stopper 161E is parallel to the first rotation shaft 161C and a front end part of the stopper 161E protrudes toward a front end side of the first rotation shaft 161C.

Further, on the other end part on a lateral side of the second leg part 161B of the lever base part 161, a substantially strip-like light blocking part 161F having a thickness equal to that of the second leg part 161B is provided in a projecting manner having one surface and the other surface being respectively made flush with the inner surface and outer surface of the second leg part 161B.

Further, on a front end part of one surface of the light blocking part 161F of the lever base part 161, a substantially rectangular plate-like light blocking position regulation part 161G having a width equal to that of the front end part of the light blocking part 161F is perpendicularly provided in a manner protruding toward the inner surface side of the second leg part 161B.

Further, on one end part of the outer surface of the first leg part 161A of the lever base part 161, a substantially plate-like connecting part 161H having a predetermined width is perpendicularly provided.

Further, on a front of the connecting part 161H of the lever base part 161, a substantially U-shaped plate-like lever support part 161J is provided in an orientation that a pair of mutually parallel plate-like first and second support parts are parallel to the outer surface of the first leg part 161A and a substantially plate-like engagement part between the first and second support parts is inclined with respect to a longitudinal direction of the first leg part 161A.

Further, at predetermined opposing positions on mutually opposing inner surfaces of the first and second support plates of the lever support part 161J, circular first and second bearing holes are respectively drilled in a manner that a central axis of the first and second bearing holes is parallel to the first and second rotation shafts 161C, 161D.

On the other hand, the lever front end part 162 has a long and thin substantially plate-like front end part body 162A. One end of the front end part body 162A is formed in an arc shape or in an arch shape.

Further, on the other end part on a lateral side of the front end part body 162A of the lever front end part 162, a substantially block-shaped abutting part 162B corresponding to the engagement part of the lever support part 161J of the lever base part 161 is obliquely provided in a projecting manner.

Further, on the other end part of the one surface of the front end part body 162A of the lever front end part 162, a column-shaped third rotation shaft 162C of a predetermined length is perpendicularly provided.

Further, on the other end part of the other surface of the front end part body 162A of the lever front end part 162, a fourth rotation shaft 162D, of which a base part is slightly thicker than a front end part, having a predetermined length longer than that of the third rotation shaft 162C, is perpendicularly provided in a manner that a center of the fourth rotation shaft 162D is positioned on an imaginary straight line passing through a center of the third rotation shaft 162C.

In the detection lever 160, the base part of the fourth rotation shaft 162D of the lever front end part 162 is inserted into the torsion spring 163.

Thereafter, in the detection lever 160, the third rotation shaft 162C of the lever front end part 162 is inserted from an inner side into first bearing hole of the first support part in the lever support part 161J of the lever base part 161.

Further, in the detection lever 160, the front end part of the fourth rotation shaft 162D of the lever front end part 162 is inserted from an inner side into the second bearing hole of the second support part in the lever support part 161J of the lever base part 161.

As a result, in the detection lever 160, the lever front end part 162 is supported via the lever support part 161J by the lever base part 161 in a manner capable of rotating in the forward rotation direction and the backward rotation direction about the third and fourth rotation shafts 162C, 162D that are parallel to the first and second rotation shafts 161C, 161D.

Further, in the detection lever 160, one end part 163A of the torsion spring 163 is engaged with an edge of the engagement part of the lever support part 161J of the lever base part 161, the edge being positioned on a side of the other end of the first leg part 161A.

Further, in the detection lever 160, the other end part 163B of the torsion spring 163 is engaged with a recess part (not illustrated in the drawings) that is formed on one surface of the front end part body 162A of the lever front end part 162.

As a result, in the detection lever 160, the lever front end part 162 is biased by the torsion spring 163 to rotate with respect to the lever base part 161 in the forward rotation direction.

The torsion spring 163 is formed to have a predetermined elastic force by suitably selecting a spring constant and the like.

Therefore, in the detection lever 160, in a state in which, except the bias force due to the torsion spring 163, no external pressing force is applied to the lever front end part 162, in accordance with the bias force of the torsion spring 163, an abutting part 162E of the lever front end part 162 is butted against an inner surface of the engagement part of the lever support part 161J of the lever base part 161.

In this way, in the detection lever 160, in the state in which, except the bias force due to the torsion spring 163, no pressing force is applied to the lever front end part 162, due to the torsion spring 163, the lever base part 161 and the lever front end part 162 are combined as if they were a single molded product that is bent at an obtuse angle at the position of the third and fourth rotation shafts 162C, 162D.

In the following description, also in the detection lever 160, the state in which the lever base part 161 and the lever front end part 162 are combined is referred to as a combined state.

The lever front end part 162 of the detection lever 160 is positioned on the tray containing side (that is, a rear side) more than the lever base part 161, and the first rotation shaft 161C of the lever base part 161 is inserted into the first bearing hole of the first support leg part 123B of the lever support part 123.

Further, the slightly thinner front end part of the second rotation shaft 161D of the lever base part 161 of the detection lever 160 is inserted into the second bearing hole of the second support leg part 123C of the lever support part 123.

As a result, the detection lever 160 is supported on the lever support part 123 in a manner rotatable in the forward rotation direction and the backward rotation direction about the first and second rotation shafts 161C, 161D that are parallel to the printer left-right direction (that is, also parallel to the tray width direction).

The lever front end part 162 is integrally molded, for example, using a predetermined resin material. Further, the lever base part 161 is also molded, for example, using a predetermined resin material.

The lever base part 161 has such an elasticity that, when ends of the first and second leg parts 161A, 161B are sandwiched from both sides using fingers, the first and second leg parts 161A, 161B deform so as to narrow a spacing between the first and second leg parts 161A, 161B, and, in this state, when the fingers are released, the first and second leg parts 161A, 161B restore to their original shapes.

Therefore, by utilizing the elasticity of the lever base part 161, the detection lever 160 can be easily installed on the lever support part 123.

In the detection lever 160, a length from the other end part on the outer surface of the first leg part 161A of the lever base part 161 to a step surface of a central part of the second rotation shaft 161D is selected to be a predetermined length slightly shorter than the spacing between the mutually opposing surfaces of the first and second support leg parts 123B, 123C of the lever support part 123.

Therefore, in the recording sheet detector 155, in the state in which no external pressing force is applied to the lever front end part 162 of the detection lever 160, due to its self weight, the detection lever 160 in the combined state can be rotated in the backward rotation direction in a state in which the lever front end part 162 is oriented toward the tray containing side more than the first and second rotation shafts 161C, 161D.

However, in the recording sheet detector 155, as described above, when the detection lever 160 in the combined state rotates in the backward rotation direction and reaches a position at which the lever front end part 162 is oriented obliquely rearward and downward, the stopper 161E of the lever base part 161 is pressed from the tray pulling out side against the first support leg part 123B of the lever support part 123 so that the rotation of the detection lever 160 in the backward rotation direction is stopped.

However, in the detection lever 160, the light blocking part 161F and the light blocking position regulation part 161G of the lever base part 161 are provided to be positioned obliquely to the right and rear of the stopper 161E.

Further, in the detection lever 160, a length from the step surface of the second rotation shaft 161D of the lever base part 161 to the other surface of the light blocking part 161F (that is, a surface on the front end side of the second rotation shaft 161D) is selected to be a predetermined length substantially equal to a length from one surface of the second support leg part 123C of the lever support part 123 to one surface of the second sensor arrangement part 122C of the sensor containing case 122.

Further, in the detection lever 160, a length from an imaginary straight line passing through centers of the first and second rotation shafts 161C, 161D of the lever base part 161 to a front end of the light blocking part 161F is selected to be a predetermined length that is longer than a length from an imaginary straight line passing through the centers of the first and second bearing holes of the lever support part 123 to the second hole of the sensor containing case 122 and is slightly shorter than a length to the one surface of the case body 122A.

Therefore, in the recording sheet detector 155, when the rotation of the detection lever 160 in the combined state in the backward rotation direction is stopped, the light blocking part 161F and the light blocking position regulation part 161G of the lever base part 161 can be inserted from the tray pulling out side into between the first and second sensor arrangement parts 122B, 122C of the sensor containing case 122 (that is, between the light emitting element and the light receiving element).

Further, in the recording sheet detector 155, in this case, to the one surface of the second sensor arrangement part 122C of the sensor containing case 122, the other surface of the light blocking part 161F of the lever base part 161 can be brought close.

As a result, in the recording sheet detector 155, due to the light blocking part 161F of the lever base part 161, the detection light emitted from the light emitting surface of the light emitting element can be blocked so that the detection light cannot be received by the light receiving surface of the light receiving element.

However, in the detection lever 160, a length (that is, a length in the printer front-rear direction) of the lever base part 161 and a width (that is, a length in the printer left-right direction) of the connecting part 161H are suitably selected according to an arrangement position of the recording sheet detector 155 and a position of the lever insertion hole 67AX of the placing plate 67A in the state in which the sheet feeding tray 60 is contained in the printer body.

As a result, in the recording sheet detector 155, at a position at which the rotation of the detection lever 160 in the combined state in the backward rotation direction is stopped, in the state in which the sheet feeding tray 60 in an empty state is contained in the printer body, the lever front end part 162 can be inserted into the lever insertion hole 67AX of the placing plate 67A.

That is, as described above, there is restriction with regard to the arrangement position of the recording sheet detector 155 in the printer body. The arrangement position for the lever base part 161 to rotate on an upper side of the sheet feeding tray 60 is spaced away from the lever insertion hole 67AX drilled through the placing plate 67A of the sheet feeding tray 60.

Therefore, in the recording sheet detector 155, the arrangement position for the lever front end part 162 to rotate on an upper side of the sheet feeding tray 60 is laterally shifted via the connecting part 161H from the arrangement position for the lever base part 161 to rotate on the upper side of the sheet feeding tray 60 to correspond to the lever insertion hole 67AX of the placing plate 67A.

Therefore, in the recording sheet detector 155, even when the detection lever 160 in the combined state rotates in the backward rotation direction, the position at which the rotation of the detection lever 160 is stopped by the stopper 161E (that is, the position at which the lever front end part 162 is oriented obliquely rearward and downward) becomes the non-load detection position.

In addition to this, in the detection lever 160, a length from the other surface of the light blocking part 161F of the lever base part 161 to the end surface of the light blocking position regulation part 161G (that is, the surface on the front end part side of the first rotation shaft 161C) is selected to be a predetermined length slightly shorter than the spacing between the opposing surfaces of the first and second sensor arrangement parts 122B, 122C of the sensor containing case 122.

Therefore, in the recording sheet detector 155, when the light blocking part 161F and the light blocking position regulation part 161G of the lever base part 161 are inserted into between the first and second sensor arrangement parts 122B, 122C of the sensor containing case 122, the end surface of the light blocking position regulation part 161G can be brought close to one surface of the first sensor arrangement part 122B of the sensor containing case 122.

As a result, in the recording sheet detector 155, when the light blocking part 161F and the light blocking position regulation part 161G of the lever base part 161 are inserted into between the first and second sensor arrangement parts 122B, 122C of the sensor containing case 122, a state can be maintained in which the other surface of the light blocking part 161F is close to the one surface of the second sensor arrangement part 122C.

Therefore, in the recording sheet detector 155, when the stopper 161E of the lever base part 161 is pressed or is being pressed from the tray pulling out side against the first support leg part 123B of the lever support part 123, similar to the case of the above-described first embodiment, it can be substantially surely prevented that, due to that the light blocking part 161F moves away from the one surface of the second sensor arrangement part 122C or is deformed, the detection light passes around the light blocking part 161F and is received by the light receiving surface of the light receiving element.

However, in the detection lever 160, in the combined state, in accordance with the bias force due to the torsion spring 163 toward the forward rotation direction as described above, the abutting part 162B of the lever front end part 162 is butted against the engagement part 126F of the lever support part 161J of the lever base part 161.

Therefore, in the recording sheet detector 155, in the state in which the detection lever 160 is stopped at the non-load detection position, when a pressing force such as a lifting force (that is, a force to rotate the lever front end part 162 in the forward rotation direction) is applied from outside to the lever front end part 162, the detection lever 160 in the combined state can be rotated in the forward rotation direction in a state in which the lever front end part 162 is oriented toward the tray containing side more than the first and second rotation shafts 161C, 161D.

In this case, in the recording sheet detector 155, in response to the rotation in the forward rotation direction of the detection lever 160, the stopper 161E is separated away from the first support leg part 123B of the lever support part 123 toward the tray pulling out side.

Further, in the recording sheet detector 155, in response to the rotation in the forward rotation direction of the detection lever 160, the light blocking part 161F and the light blocking position regulation part 161G of the lever base part 161 are pulled out from between the first and second sensor arrangement parts 122B, 122C of the sensor containing case 122

(that is, from between the light emitting element and the light receiving element) toward the tray pulling out side.

As a result, in the recording sheet detector 155, the detection light emitted from the light emitting surface of the light emitting element can be received by the light receiving surface of the light receiving element.

Therefore, in the recording sheet detector 155, the position when detection lever 160 in the combined state is rotated in the forward rotation direction from the non-load detection position (that is, the position at which the lever front end part 162 is oriented toward the tray containing side more than the non-load detection position in the forward rotation direction) is referred to as a load detection position.

Further, in the detection lever 160, as described above, the lever front end part 162 is biased by the torsion spring 163 to rotate in the forward rotation direction with respect to the lever base part 161 and is combined.

Therefore, in the recording sheet detector 155, in the state in which the detection lever 160 is stopped at the non-load detection position, when a pressing force to press the lever front end part 162 toward the tray pulling out side (that is, to rotate the lever front end part 162 in the backward rotation direction) is applied from outside to the lever front end part 162, the lever front end part 162 can be individually further rotated in the backward rotation direction without rotating the lever base part 161.

That is, in the recording sheet detector 155, in this case, with respect to the lever base part 161 of the detection lever 160, even when a pressing force pressing toward the tray pulling out side is applied, since the stopper 161E is pressed against the first support leg part 123B of the lever support part 123, the rotation remains being stopped at the non-load detection position.

Further, in the recording sheet detector 155, with respect to the lever front end part 162 of the detection lever 160, since the elastic force and the bias force of the torsion spring 163 are relatively small, the lever front end part 162 can be made independent from the ever base part 161 and can be rotated through a lower side of the first and second rotation shafts 161C, 161D toward the tray pulling out side.

Further, in the recording sheet detector 155, when the lever front end part 162 of the detection lever 160 is individually rotated in the backward rotation direction as described above, in response to this, the torsion spring 163 is compressed and the bias force becomes larger.

However, in the recording sheet detector 155, since the bias force due to the torsion spring 163 is relatively small, similar to the case of the above-described first embodiment, the lever front end part 162 can be smoothly rotated to a retreat position in the backward rotation direction to be oriented toward the tray pulling out side such as an obliquely forward and downward side substantially without being influenced by the bias force due to the torsion spring 163.

In practice, in the recording sheet detector 155, when the sheet feeding tray 60 is pulled out from the printer body, due to the self weight of the lever front end part 162, the detection lever 160 in the combined state is rotated to the non-load detection position in the backward rotation direction and the rotation is stopped.

Figure 16:
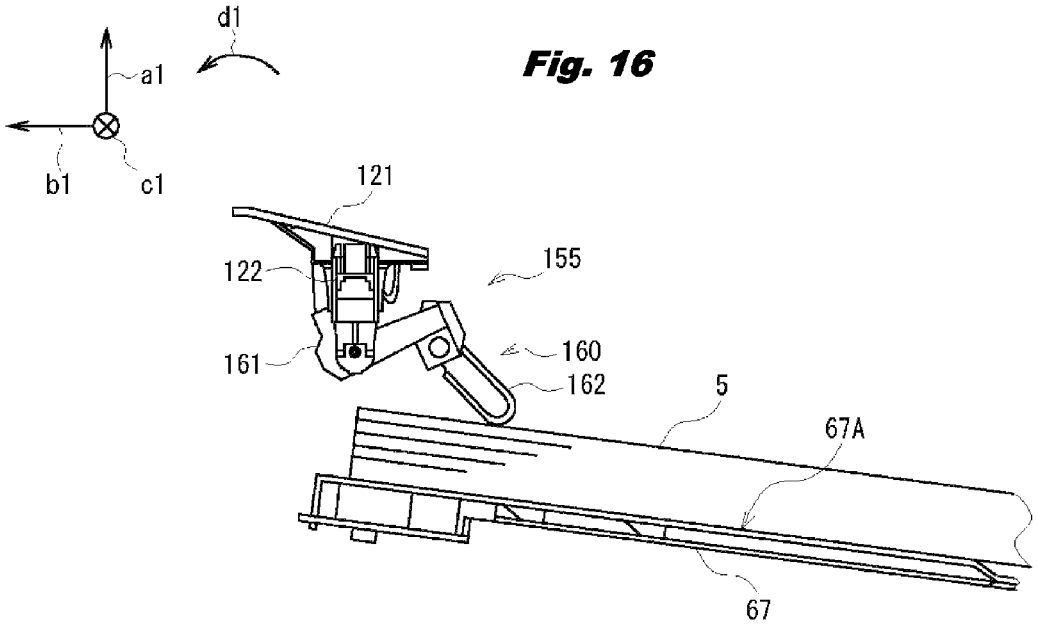
FIG. 16 illustrates a schematic side view for describing the recording sheet detector when recording sheets are properly loaded in a sheet feeding tray, illustrating the load detection position.

Further, as illustrated in FIG. 16, in which the same reference numeral symbols are used to indicate corresponding parts in FIG. 8, in the recording sheet detector 155, when the sheet feeding tray 60 in which at least one recording sheet 5 is properly loaded in a manner allowing the recording sheet 5 to be fed out is contained in the printer body, one end portion of the recording sheet 5 lifted by the lifting part 67 is pressed against the lever front end part 162 from below and a pressing force to rotate the detection lever 160 in the forward rotation direction is applied to the detection lever 160.

As a result, in the recording sheet detector 155, in response to the pressing force applied by the pressing of the recording sheets 5, the detection lever 160 can be rotated from the non-load detection position in the forward rotation direction to the load detection position corresponding to the number of the recording sheets 5 on the placing plate 67A.

Further, in this case, since the detection light emitted by the light emitting element from the light emitting surface is received by the light receiving surface of the light receiving element, the recording sheet detector 155 allows the controller 90 to detect that the recording sheets 5 are properly loaded in the sheet feeding tray 60 in a manner allowing the recording sheets 5 to be fed out.

In the recording sheet detector 155, similar to the case of the above-described first embodiment, in the detection lever 160, lengths of the lever base part 161 and the lever front end part 162 are suitably selected and the one end of the lever front end part 162 is formed in an arc shape or in an arch shape.

Further, in the recording sheet detector 155, an inclination angle of the lever front end part 162 at the non-load detection position with respect to the tray bottom plate 60D is suitably selected depending on a rotation torque when the detection lever 160 rotates from the non-load detection position toward the forward rotation direction in response to the pressing by the recording sheets 5, a friction coefficient of the surface of the recording sheets 5, and the like.

As a result, in the recording sheet detector 155, when the sheet feeding tray 60 is contained in the printer body and the one end portion of the recording sheet 5 lifted by the lifting part 67 is pressed against the lever front end part 162 of the detection lever 160, regardless of the inclination angle of the one end portion of the recording sheet 5, the detection lever 160 can be properly rotated from the non-load detection position to the load detection position in the forward rotation direction without being caught by the surface of the recording sheet 5.

Figure 17:
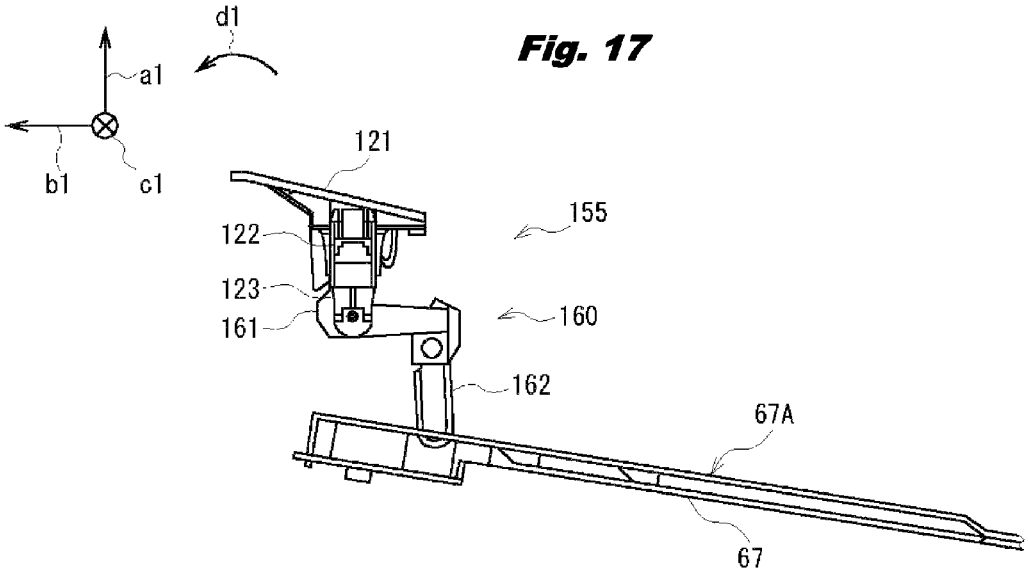
FIG. 17 illustrates a schematic side view for describing the recording sheet detector when the sheet feeding tray is empty, illustrating the non-load detection position.

Further, as illustrated in FIG. 17, in which the same reference numeral symbols are used to indicate corresponding parts in FIG. 9, in the recording sheet detector 155, when all the recording sheets 5 are fed out from the sheet feeding tray 60 and the loading part 60A becomes empty, the detection lever 160 in the combined state can be rotated from the load detection position to the non-load detection position in the backward rotation direction in a manner that the lever front end part 162 is inserted into the lever insertion hole 67AX.

As a result, when the sheet feeding tray 60 becomes empty as described above, since the light receiving element cannot receive the detection light with the light receiving surface, the recording sheet detector 155 allows the controller 90 to detect that the recording sheets 5 are not properly loaded in the sheet feeding tray 60 (that is, the loading part 60A of the sheet feeding tray 60 is empty).

Further, in the recording sheet detector 155, in the state in which the detection lever 160 in the combined state is stopped at the non-load detection position, when an empty sheet feeding tray 60 is erroneously contained in the printer body, even when the lifting part 67 is automatically lifted to the lifting upper limit position, the detection lever 160 can be stopped at the non-load detection position by inserting the lever front end part 162 into the lever insertion hole 67AX.

Therefore, also when an empty sheet feeding tray 60 is erroneously contained in the printer body as described above, since the light receiving element cannot receive the detection light with the light receiving surface, the recording sheet detector 155 allows the controller 90 to detect that the recording sheets 5 are not properly loaded in the sheet feeding tray 60 (that is, the loading part 60A of the sheet feeding tray 60 is empty).

Figure 18A:
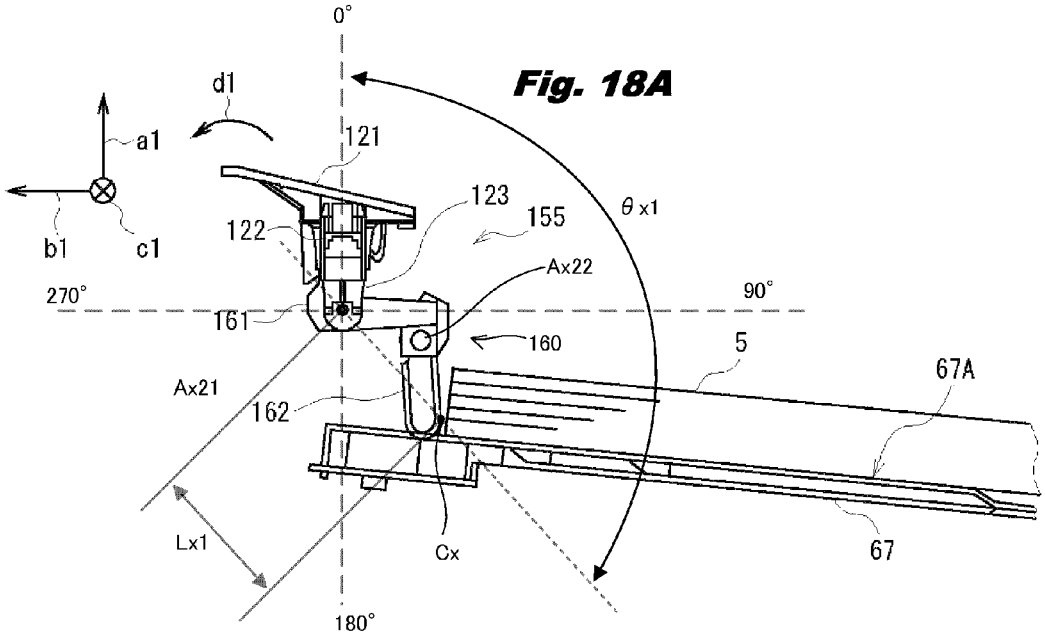
FIGS. 18A-18C illustrate schematic side views for describing retreat of the detection lever of the recording sheet detector when a plurality of recording sheets are loaded in the sheet feeding tray in a manner that a position of the recording sheets is shifted toward a tray containing side.
Figure 18B:
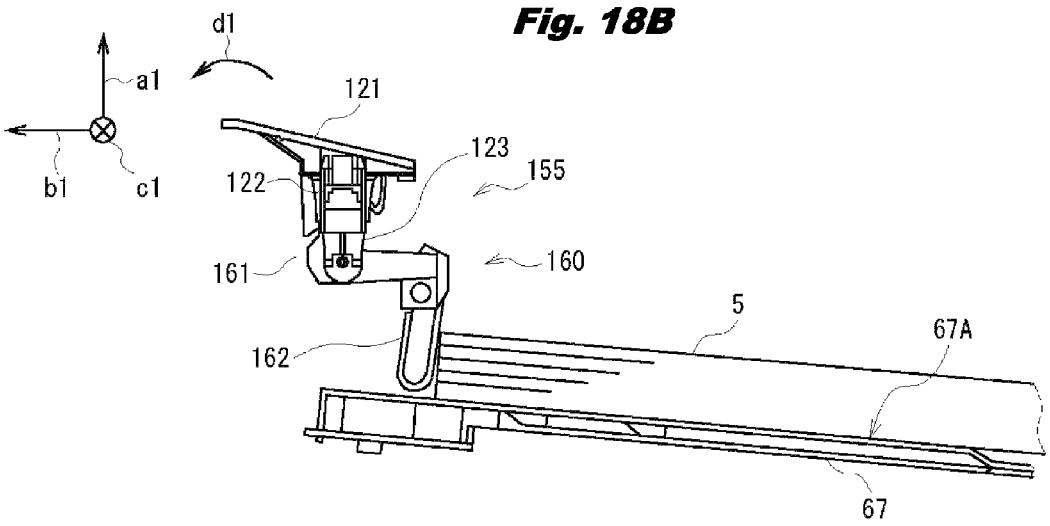
Figure 18C:
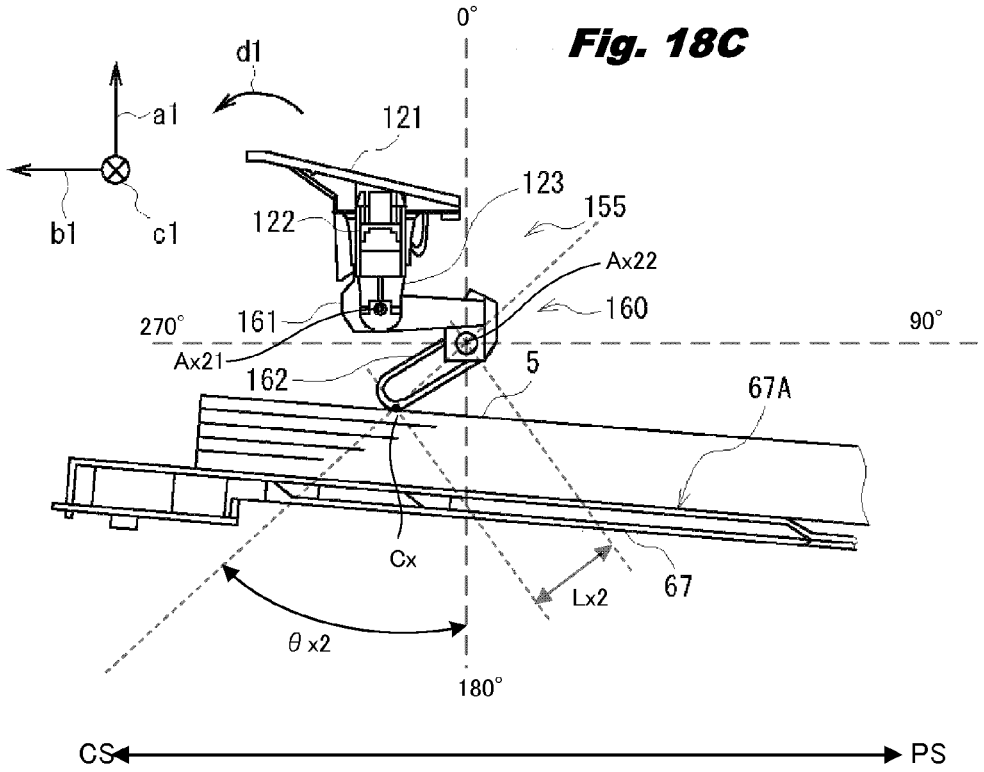

However, as illustrated in FIGS. 18A-18C in which the same reference numeral symbols are used to indicate corresponding parts in FIGS. 10A-10C, in the recording sheet detector 155, when the sheet feeding tray 60 in which a plurality of the recording sheets 5 are loaded in the loading part 60A in a manner that the position of the recording sheets 5 is shifted toward the tray containing side is contained in the printer body, the one end portions of the recording sheets 5 that are automatically lifted by the lifting part 67 are positioned more on the tray containing side (that is, the rear side) than the lever front end part 162.

Therefore, in the recording sheet detector 155, in this case, the detection lever 160 in the combined state cannot be rotated from the non-load detection position in the forward rotation direction and remains in the combined state at the non-load detection position.

Therefore, with that the detection light remains being blocked by the light blocking part 161F, the recording sheet detector 155 allows the controller 90 to detect that the recording sheets 5 are not properly loaded in the sheet feeding tray 60 and notify a user about the detection.

In the recording sheet detector 155, when the sheet feeding tray 60 moves toward the tray pulling out side as being pulled out from the printer body by the user, since the lever front end part 162 is positioned in front of the one end portions of the plurality of the recording sheets 5, the one end portions of the plurality of the recording sheets 5 are pressed from the tray containing side against the lever front end part 162 so that a pressing force to rotate the detection lever 160 in the backward rotation direction is applied to the detection lever 160.

Therefore, in the recording sheet detector 155, in this case, as described above, in response to the pressing force applied by the pressing of the plurality of the recording sheets 5, the lever front end part 162 of the detection lever 160 can individually start to be rotated from the non-load detection position in the backward rotation direction.

Further, in the recording sheet detector 155, when the sheet feeding tray 60 further moves toward the tray pulling out side, in response to this, only the lever front end part 162 of the detection lever 160 is further rotated in the backward rotation direction along a path sequentially from the one ends of the plurality of the recording sheets 5 to the surface of the recording sheet 5 positioned uppermost.

That is, in the recording sheet detector 155, since the lifting part 67 is gradually lowered when the sheet feeding tray 60 is pulled out from the printer body, in response to the movement of the sheet feeding tray 60 toward the tray pulling out side, the lever front end part 162 can be individually rotated in the backward rotation direction while the plurality of the recording sheets 5 are pushed under the lever front end part 162.

Further, in the recording sheet detector 155, when the sheet feeding tray 60 tray has moved some distance toward the pulling out side and the plurality of the recording sheets 5 are separated away from the lever front end part 162, while the sheet feeding tray 60 is being pulled out toward the tray pulling out side, the lever front end part 162 of the detection lever 160 is rotated to return to the non-load detection position in the forward rotation direction in accordance with the bias force of the torsion spring 163.

As a result, in the recording sheet detector 155, the sheet feeding tray 60 can be completely pulled out from the printer body and the detection lever 160 can be again returned to the combined state.

In this way, in the recording sheet detector 155, when the sheet feeding tray 60 in which the plurality of the recording sheets 5 are loaded in the loading part 60A in the manner that the position of the recording sheets 5 is shifted toward the tray containing side is pulled out from the printer body, the lever front end part 162 of the detection lever 160 can be retreated to the tray pulling out side by allowing the lever front end part 162 to individually rotate in the backward rotation direction.

Therefore, in the recording sheet detector 155, in this case, similar to the case of the above-described first embodiment, the plurality of the recording sheets 5 in the sheet feeding tray 60 are substantially surely prevented from being caught and damaged by the detection lever 160.

Further, in the recording sheet detector 155, when the sheet feeding tray 60 is pulled out from the printer body as described above, since the lifting part 67 is gradually lowered, the rotation angle for the lever front end part 162 of the detection lever 160 to individually rotate from the non-load detection position to the retreat position in the backward rotation direction can be made as small as possible.

Therefore, also in the recording sheet detector 155, similar to the case of the above-described first embodiment, the lever front end part 162 of the detection lever 160 can be smoothly rotated from the non-load detection position to the retreat position substantially without being influenced by the bias force due to the torsion spring 163.

Therefore, in the recording sheet detector 155, when the lever front end part 162 is rotated to the retreat position, even when the lever front end part 162 slides from the one ends of the plurality of the recording sheets 5 to the surface of the recording sheet 5 positioned uppermost, the recording sheets 5 can be substantially surely prevented from being damaged by the sliding movement.

Further, in the recording sheet detector 155, in order to detect that the recording sheets 5 are not properly loaded in the sheet feeding tray 60, the rotation of the detection lever 160 is stopped and the detection light is blocked.

Therefore, in the recording sheet detector 155, similar to the case of the above-described first embodiment, the width (that is, the length along the backward rotation direction) of the light blocking part 161F of the detection lever 160 can be made as narrow as possible and enlargement of the detection lever 160 (that is, the lever base part 161) can be avoided.

Further, in the recording sheet detector 155, as described above, in the case where the length of the light blocking position regulation part 161G of the lever base part 161 is suitably selected and the light blocking position regulation part 161G and the light blocking part 161F are inserted into between the first and second sensor arrangement parts 122B, 122C of the sensor containing case 122, the other surface of the light blocking part 161F can be brought close to the one surface of the second sensor arrangement part 122C.

Therefore, in the recording sheet detector 155, when the lever front end part 162 is being rotated to the retreat position, even when distortion occurs to the lever front end part 162 and the lever base part 161 of the detection lever 160 due to the pressing of the recording sheets 5, the light blocking part 161F can be substantially surely prevented from being separated from the one surface of the second sensor arrangement part 122C or being deformed.

Therefore, in the recording sheet detector 155, when the lever front end part 162 is being rotated to the retreat position in the backward rotation direction, the light blocking part 161F can maintain the state in which the other surface of the light blocking part 126C is close to the one surface of the second sensor arrangement part 122C and continue to block the detection light.

In this way, in recording sheet detector 155, also when the lever front end part 162 of the detection lever 160 is being individually rotated to the retreat position, the lever base part 161 can remain at the non-load detection position without changing its state.

Further, in the recording sheet detector 155, when the lever front end part 162 of the detection lever 160 is individually rotated to the retreat position and the recording sheet 5 is separated away, in accordance with the bias force of the torsion spring 163, the lever front end part 162 is rotated to the non-load detection position in the forward rotation direction and again returns to the combined state.

However, in the recording sheet detector 155, similar to the case of the above-described first embodiment, the bias force of the torsion spring 163 for rotating the lever front end part 162 to the non-load detection position in the forward rotation direction is smaller than the pressing force that is generated by pressing the recording sheets 5 against the lever front end part 162 and tends to rotate the lever front end part 162 in the backward rotation direction.

Therefore, in the recording sheet detector 155, when the lever front end part 162 of the detection lever 160 is being rotated from the retreat position to the non-load detection position in the forward rotation direction, the lever base part 161 can be prevented from being acted on by an external force such as that causing the light blocking part 161F to be separated away from the one surface of the second sensor arrangement part 122C or to be deformed.

Therefore, in the recording sheet detector 155, even when the lever front end part 162 of the detection lever 160 is rotated from the retreat position to the non-load detection position in the forward rotation direction, and the lever front end part 162 is again returned along with the lever base part 161 to the combined state, the detection light blocking state due to the light blocking part 161F can be prevented from being changed before and after the lever front end part 162 is individually rotated.

(2-3) Operation and Effect of Second Embodiment

In the above-described configuration, in the color printer 150, the sheet feeding tray 60, in which the recording sheets 5 of a plurality of kinds of different sizes are loaded by defining a loading area according to the sizes of the recording sheets 5, is provided capable of being pulled out therefrom and contained therein.

Further, in the color printer 150, the detection lever 160 that is configured by the lever base part 161, the lever front end part 162 and the torsion spring 163 is rotatably provided via the lever support part 123 at a position above the end part on the tray pulling out side of the sheet feeding tray 60 for detecting whether or not the recording sheets 5 are properly loaded in the sheet feeding tray 60 in a manner allowing the recording sheets 5 to be fed out. The lever front end part 162 is held by the lever base part 161 in a manner individually rotatable at an arrangement position that is different from the arrangement position for the lever base part 161 to rotate. The torsion spring 163 is for integrating the lever base part 161 and the lever front end part 162.

Further, in the color printer 150, when a pressing force to rotate the detection lever 160 is not applied from outside to the detection lever 160, the detection lever 160 in the combined state with the lever front end part 162 being oriented toward the tray containing side is rotated to the non-load detection position on a lower side.

Further, in the color printer 150, when a pressing force to rotate the detection lever 160 at the non-load detection position toward an upper side is applied from outside to the detection lever 160, the detection lever 160 in the combined state with the lever front end part 162 being oriented toward the tray containing side is rotated to the non-load detection position on an upper side.

Further, in the color printer 150, when a pressing force to rotate the detection lever 160 in the non-load detection position toward the tray pulling out side is applied from outside to the detection lever 160, the lever front end part 162 of the detection lever 160 is individually rotated to the retreat position on the tray pulling out side.

Therefore, in the color printer 150, when the sheet feeding tray 60 contained therein is empty, the detection lever 160 in the combined state with the lever front end part 162 being oriented toward the tray containing side is rotated to the non-load detection position on the lower side and that the recording sheets 5 are not properly loaded in the sheet feeding tray 60 can be detected.

Further, in the color printer 150, when the recording sheets 5 are properly loaded in the sheet feeding tray 60 contained therein, in response to the pressing of the recording sheets 5 from below against the lever front end part 162, the detection lever 160 in the combined state with the lever front end part 162 being oriented toward the tray containing side is rotated to the load detection position on an upper side and that the recording sheets 5 are properly loaded in the sheet feeding tray 60 can be detected.

Further, in the color printer 150, when the plurality of the recording sheets 5 are loaded in the sheet feeding tray 60 contained therein in a manner that the position of the recording sheets 5 is shifted toward the tray containing side, since the recording sheets 5 are not positioned below the detection lever 160, the detection lever 160 in the combined state with the lever front end part 162 being oriented toward the tray containing side is rotate to the non-load detection position on the lower side and that the recording sheets 5 are not properly loaded in the sheet feeding tray 60 can be detected.

Further, in the color printer 150, in the state in which the detection lever 160 is rotated to the non-load detection position as described above, when the sheet feeding tray 60 in which the plurality of the recording sheets 5 are loaded in a manner that the position of the recording sheets 5 is shifted toward the tray containing side is pulled out, in response to the pressing of the plurality of the recording sheets 5 from the tray containing side due to the pulling out of the sheet feeding tray 60, the lever front end part 162 of the detection lever 160 can be individually rotated from the non-load detection position toward the tray pulling out side to retreat.

Therefore, in the color printer 150, when the sheet feeding tray 60 in which the plurality of the recording sheets 5 are loaded in a manner that the position of the recording sheets 5 is shifted toward the tray containing side is pulled out, the detection lever 160 can avoid blocking the path of the plurality of the recording sheets 5 that move along with the sheet feeding tray 60 toward the tray pulling out side so that the sheet feeding tray 60 together with the plurality of the recording sheets 5 can be completely pulled out.

Further, in the color printer 150, even when there is restriction with regard to the arrangement position of the lever base part 161 due to that the lever front end part 162 is held by the lever base part 161 in a manner individually rotatably at an arrangement position that is different from the arrangement position for the lever base part 161 to rotate, the lever base part 161 and the lever front end part 162 can be properly rotated for detecting whether or not the recording sheets 5 are properly loaded in the sheet feeding tray 60 in a manner allowing the recording sheets 5 to be fed out.

According to the above-described configuration, in the color printer 150, the sheet feeding tray 60, in which the recording sheets 5 of a plurality of kinds of different sizes are loaded by defining a loading area according to the sizes of the recording sheets 5, is provided capable of being pulled out therefrom and contained therein; and a detection lever 160 having the lever base part 161, the lever front end part 162 that is held by the lever base part 161 in a manner individually rotatable at an arrangement position different from the arrangement position of the lever base part 161, and the torsion spring 163, is rotatably provided via the lever support part 123 at a position above the end part on the tray pulling out side of the sheet feeding tray 60 for detecting whether or not the recording sheets 5 are properly loaded in the sheet feeding tray 60 in a manner allowing the recording sheets 5 to be fed out. When a pressing force to rotate the detection lever 160 is not applied from outside to the detection lever 160, the detection lever 160 in the combined state with the lever front end part 162 being oriented toward the tray containing side is rotated to the non-load detection position on the lower side for detecting that the recording sheets 5 are not properly loaded in the sheet feeding tray 60. When a pressing force to rotate the detection lever 160 in the non-load detection position toward the upper side is applied from outside to the detection lever 160, the detection lever 160 in the combined state with the lever front end part 162 being oriented toward the tray containing side is rotated to the load detection position on an upper side for detecting that the recording sheets 5 are properly loaded in the sheet feeding tray 60. Further, when a pressing force to rotate the detection lever 160 in the non-load detection position toward the tray pulling out side is applied from outside to the detection lever 160, the lever front end part 162 is individually rotated to the retreat position on the tray pulling out side.

As a result, in the color printer 150, the same effect as that obtained by the above-described first embodiment can be obtained. In addition, in the color printer 150, even when there is restriction with regard to the arrangement position of the lever base part 161, the lever base part 161 and the lever front end part 162 can be properly rotated for detecting whether or not the recording sheets 5 are properly loaded in the sheet feeding tray 60 in a manner allowing the recording sheets 5 to be fed out.

Therefore, in the color printer 150, even when there is restriction with regard to the arrangement position of the lever base part 161, whether or not the recording sheets 5 are properly loaded in the sheet feeding tray 60 in a manner allowing the recording sheets 5 to be fed out can be properly detected.

(3) Other Embodiments

(3-1) First Other Embodiment

In the above-described first and second embodiments, the case is described where, when a pressing force to rotate the detection lever 124, 160 of the recording sheet detector 120, 155 of the color printer 1, 150 is not applied from outside, the detection lever 124, 160 rotates to the non-load detection position due to its self weight.

However, the present invention is not limited to this. For example, it is also possible that a bias part such as a torsion spring that biases the detection lever 124, 160 to rotate toward the lower side (that is, the backward rotation direction) is provided between the lever support part 123 and the detection lever 124, 160 in the recording sheet detector 120, 155 of the color printer 1, 150.

Further, in the present invention, it also possible that, when a pressing force to rotate the detection lever 124, 160 of the recording sheet detector 120, 155 of the color printer 1, 150 is not applied from outside, the detection lever 124, 160 is rotated to the non-load detection position in accordance with the bias force of the bias part.

In the present invention, according to such a configuration, when a pressing force to rotate the detection lever 124, 160 is not applied from outside, the detection lever 124, 160 can be properly rotated to the non-load detection position, and it can be substantially surely prevented to erroneously detect whether or not the recording sheets 5 are properly loaded in the sheet feeding tray 60 in a manner allowing the recording sheets 5 to be fed out.

(3-2) Second Other Embodiment

In the above-described first and second embodiments, the case is described where the medium feeding device according to the present invention is applied to the sheet feeding part 8, 151 provided in the color printer 1, 150 that is described in the above with reference to FIGS. 1-18C.

However, the present invention is not limited to this, but can be broadly applied to various other kinds of medium feeding devices such as sheet feeding parts provided in image forming apparatuses including a printer for black-and-white printing, an inkjet printer, a multifunction printer, a facsimile, a multifunction machine, and the like, and medium feeding devices that feed media such as postcards and tickets to downstream processing apparatuses.

(3-3) Third Other Embodiment

Further, in the above-described first and second embodiments, the case is described where the medium feeding device according to the present invention is applied to the color printer 1, 150 that is described in the above with reference to FIGS. 1-18.

However, the present invention is not limited to this, but can be broadly applied to various other kinds of image forming apparatuses such as a printer for black-and-white printing, an inkjet printer, a multifunction printer, a facsimile, and a multifunction machine.

(3-4) Fourth Other Embodiment

Further, in the above-described first and second embodiments, the case is described where, as a device body, the printer body that is described in the above with reference to FIGS. 1-18 is applied.

However, the present invention is not limited to this, but can broadly apply apparatus bodies of various other kinds of configurations such as a device body that is removably provided in a color printer and has a medium feeding function, and a device body that is provided outside a medium processing apparatus such as a color printer and has a function of feeding medium to the medium processing apparatus.

(3-5) Fifth Other Embodiment

Further, in the above-described first and second embodiments, the case is described where, as a tray that is provided in a device body in a manner capable of being pulled out and contained in the device body and in which a plurality of kinds of media having different sizes are loaded by defining a loading area according to the sizes of the media, the sheet feeding tray 60 that is described in the above with reference to FIGS. 1-18 is applied.

However, the present invention is not limited to this, but can broadly apply trays of various other kinds of configurations such as a tray capable of loading postcards or tickets of different sizes and a sheet feeding tray in which the lifting part 67 is not provided.

(3-6) Sixth Other Embodiment

Further, in the above-described first and second embodiments, the case is described where, as a plurality of kinds of media having different sizes that are loaded in a tray that is provided in a device body in a manner capable of being pulled out from and contained in the device body, the recording sheets 5 that are described in the above with reference to FIGS. 1-18 is applied.

However, the present invention is not limited to this, but can broadly apply various other kinds of media such as postcards and tickets.

(3-7) Seventh Other Embodiment

Further, in the above-described first and second embodiments, the case is described where, as a detection lever that is moveably provided at a position above an end part on a tray pulling out side of a tray in a device body for detecting whether or not media are properly loaded in the tray, the detection levers 124, 160 that are described in the above with reference to FIGS. 1-18 are applied.

However, the present invention is not limited to this, but can broadly apply detection levers of various other kinds of configurations such as a detection lever that is provided in a manner having at least a front end part that is deformable for the detection lever to retreat and being moveable to move in a predetermined direction such as an up-down direction, (3-8) Eighth Other Embodiment Further, in the above-described first and second embodiments, the case is described where, as a body holding part that is provided at a position above an end part on a tray pulling out side of a tray in a device body in a manner moveable by rotating, the body holding part 126 that is described in the above with reference to FIGS. 1-18 is applied.

However, the present invention is not limited to this, but can broadly apply body holding parts of various other kinds of materials and shapes.

(3-9) Ninth Other Embodiment

Further, in the above-described first and second embodiments, the case is described where, as a lever body that is rotatably held by a body holding part, the lever body 125 that is described in the above with reference to FIGS. 1-18 is applied.

However, the present invention is not limited to this, but can broadly apply lever bodies of various other kinds of materials and shapes.

(3-10) Tenth Other Embodiment

Further, in the above-described first and second embodiments, the case is described where, as a bias part that biases a lever body to rotate toward an upper side with respect to a body holding part, the torsion spring 127 that is described in the above with reference to FIGS. 1-18 is applied.

However, the present invention is not limited to this, but can broadly apply various other kinds of bias parts such as a rubber belt and a coil spring.

(3-11) Eleventh Other Embodiment

Further, in the above-described first and second embodiments, the case is described where, as rotation regulation parts that stop rotation of a detection lever when the detection lever rotates to a non-load detection position by being combined with a body holding part and a lever body by a bias part, the stopper 126E and the lever support part 123 that are described in the above with reference to FIGS. 1-18 are applied.

However, the present invention is not limited to this, but can broadly apply rotation regulation parts of various other kinds of configurations such as the light blocking part 126C and an engagement part that is provided allowing the light blocking part 126C to be butted against the second sensor arrangement part 122C of the sensor containing case 122.

(3-12) Twelfth Other Embodiment

Further, in the above-described first and second embodiments, the case is described where, as a lever base part that is provided at a position above an end part on a tray pulling out side of a tray in a device body in a manner moveable by rotating, the lever base part 161 that is described in the above with reference to FIGS. 1-18 is applied.

However, the present invention is not limited to this, but can broadly apply lever base parts of various other kinds of materials and shapes.

(3-13) Thirteenth Other Embodiment

Further, in the above-described first and second embodiments, the case is described where, as a lever front end part that is held by a lever base part in a manner individually rotatable at an arrangement position that is different from an arrangement position of the lever base part, the lever front end part 162 that is described in the above with reference to FIGS. 1-18 is applied.

However, the present invention is not limited to this, but can broadly apply lever front end parts of various other kinds of materials and shapes.

(3-14) Fourteenth Other Embodiment

Further, in the above-described first and second embodiments, the case is described where, as a bias part that biases a lever front end part to rotate toward an upper side with respect to a lever base part, the torsion spring 163 that is described in the above with reference to FIGS. 1-18 is applied.

However, the present invention is not limited to this, but can broadly apply various other kinds of bias parts such as a rubber belt and a coil spring.

(3-15) Fifteenth Other Embodiment

Further, in the above-described first and second embodiments, the case is described where, as rotation regulation parts that stop rotation of a detection lever when the detection lever rotates to a non-load detection position by being combined with a lever base part and a lever front end part by a bias part, the stopper 161E and the lever support part 123 that are described in the above with reference to FIGS. 1-18 are applied.

However, the present invention is not limited to this, but can broadly apply rotation regulation parts of various other kinds of configurations such as the light blocking part 161F and an engagement part that is provided allowing the light blocking part 161F to be butted against the second sensor arrangement part 122C of the sensor containing case 122.

(3-16) Sixteenth Other Embodiment

Further, in the above-described first and second embodiments, the case is described where, as a lifting part, on an end part on a tray pulling out side of which one end portion of a loaded medium is place, which obliquely lifts the one end portion of the medium when the medium is contained in a device body, and which gradually lowers the one end portion of the medium when the medium is pulled out from the device body, the lifting part 67 that is described in the above with reference to FIGS. 1-18 is applied.

However, the present invention is not limited to this, but can broadly apply lifting part of various other kinds of configurations.

(3-17) Seventeenth Other Embodiment

Further, in the above-described first and second embodiments, the case is described where, as a light blocking part that is provided on a detection lever and, when the detection lever rotates to a non-load detection position, is inserted from a tray pulling out side into between a light emitting element and a light receiving element to block detection light, the light blocking parts 126C, 161F that are described in the above with reference to FIGS. 1-18 are applied.

However, the present invention is not limited to this, but can broadly apply light blocking parts of various other kinds of configurations such as a block-shaped light blocking part that combinedly has a function of a light blocking position regulation part.

(3-18) Eighteenth Other Embodiment

Further, in the above-described first and second embodiments, the case is described where, as a light blocking position regulation part that is provided on a light blocking part and regulates a detection light blocking position of the light blocking part between a light emitting element and a light receiving element, the light blocking position regulation parts 126D, 161G that are described in the above with reference to FIGS. 1-18 are applied.

However, the present invention is not limited to this, but can broadly apply light blocking position regulation parts of various other kinds of configurations such as a block-shaped light blocking position regulation part that combinedly has a function of a light blocking part.

(Angles, Shapes etc of Lever Body at Non-Load Detection Position)

(1) Non-Load State Angle (θx1)

Non-load state angle θx1 is explained. FIG. 10A and FIG. 18A both illustrate a state in which the detection lever (124, 160) is positioned at the non-load detection position, sheets are loaded but the lever body does not contact the sheets. In this state, when the sheet supply tray 60 is pulled out in b1 plus direction, the lever body 125, which is pushed by the sheets, is supposed to rotate in the backward rotation direction (−d1). In the light of making the rotation smooth, being at the non-load detection position, the lever body 125 is preferred to be as perpendicular as possible with respect to a direction in which the sheet supply tray is pulled out. Specifically, assuming that the pulling out direction PS is the horizontal direction (b1), an ideal angle is the a1 direction. On the other hand, considering that the lever body 125 is moved in the forward rotation by the loaded sheets, and is lifted, the front end of the lever body 125 is required to be on the containing side (right side in the drawing) with respect to the rotation axis of the detection lever, which is the fourth quadrant of rectangular coordinate. In FIG. 18A, the lever body 162 is required to be at lower right from the rotation axis Ax21. According to the above two technical views, assuming that the pulling out direction of the sheet tray is the horizontal direction (b1, 90 to 270 degrees) and the perpendicular direction is the vertical direction (a1, 0 to 180 direction), the angle of the front end Cx of the lever body that is at the non-load detection direction is preferred to be within 135 degrees to 165 degrees based on the rotation axis (Ax1, Ax21) of the detection lever. The angle is the non-load state angle (θx1). The front end Cx is defined as the first contact point to the sheets when the sheet supply tray 67 is being pulled out.

(2) Retreat State Angle θx2

Next, an angle θx2 at the retreat state is explained. FIG. 10C and FIG. 18C illustrate the retreat position. When the rotational angle moving up to the retreat position is very small, it makes impossible to pull out the sheet supply tray on which a large amount of sheets are loaded. The retreat state angle θx2 is preferred to be at least 30 degrees in the backward rotation direction from the 180 degrees that is in the vertical direction.

(3) Lever Lengths Lx1, Lx2

The above front end Cx and length Lx of the rotation axis are explained. In the invention, the sense target part travels in correspondence with the rotational movement of the detection lever. Where the length of the detection lever is short, the moving distance of the sense target part also becomes short, making it difficult to sense precisely. Accordingly, a certain length is required for the detection lever. Specifically, in an embodiment shown in FIG. 10A, a length Lx1 is important, that is determined from the rotation axis Ax1 to a point Cx where it makes the first contact to the sheets and that is the front end (distal end) of the detection lever. In another embodiment shown in FIG. 18A, the length Lx1 is determined by from the rotation axis Ax21 to the front end Cx. For the length Lx1 that is from the rotation axis (Ax1, Ax21) to Cx, it is preferred to range from 20 to 35 mm.

(4) Shape of Detection Lever

Figure 4A:
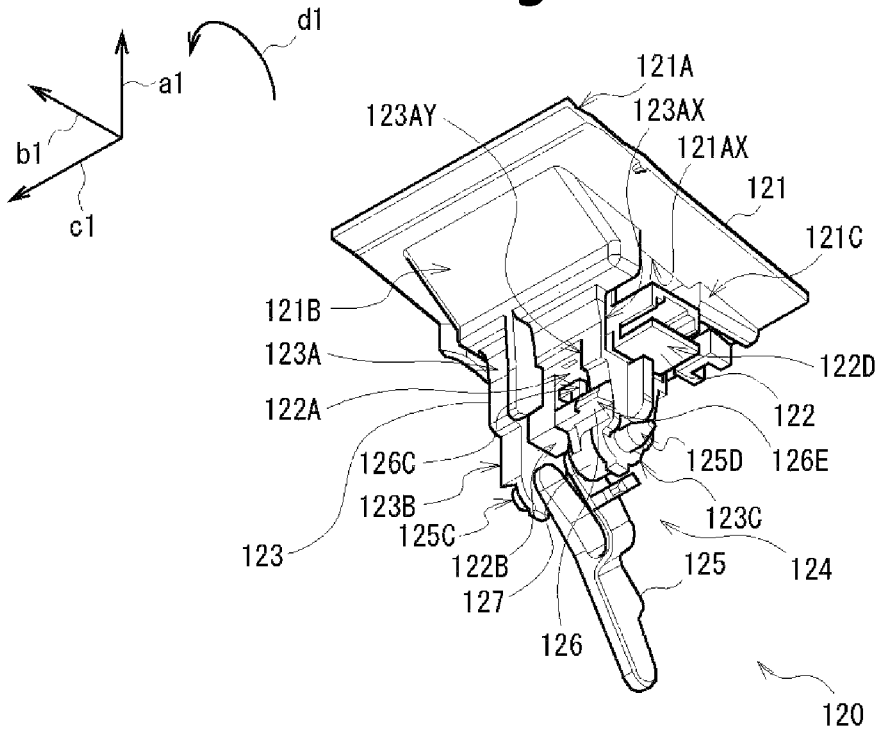
FIGS. 4A and 4B respectively illustrate a schematic perspective view and a schematic side view of a configuration of the recording sheet detector, illustrating a non-load detection position.
Figure 4B:
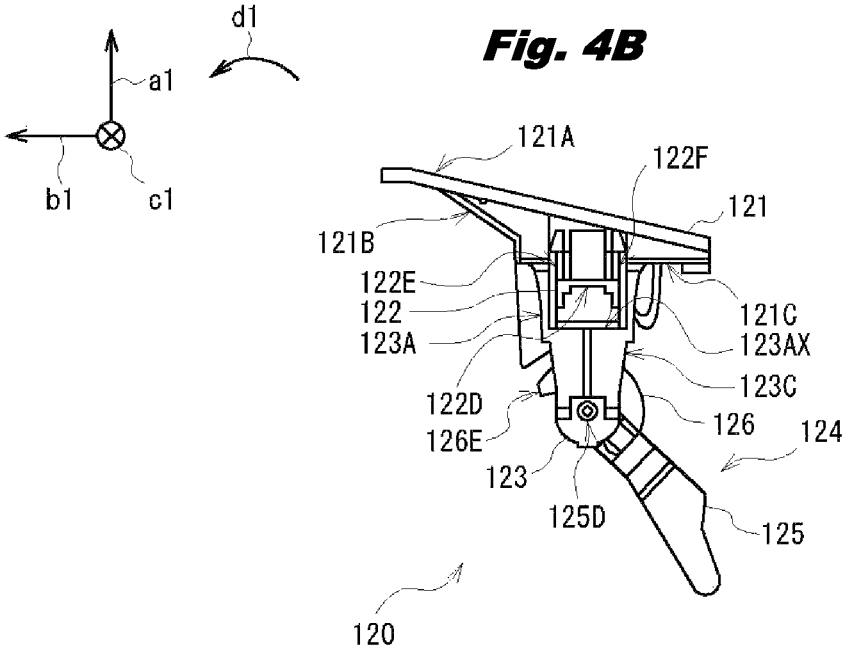
Figure 5A:
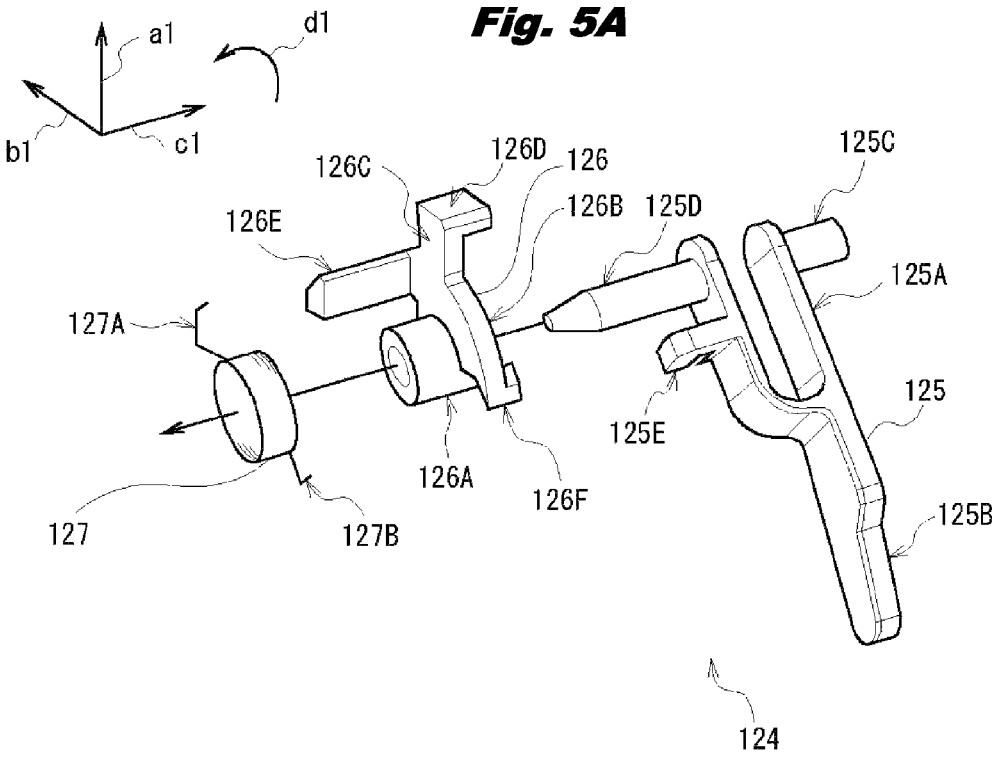
FIGS. 5A and 5B illustrate schematic perspective views of a configuration of a detection lever.
Figure 5B:
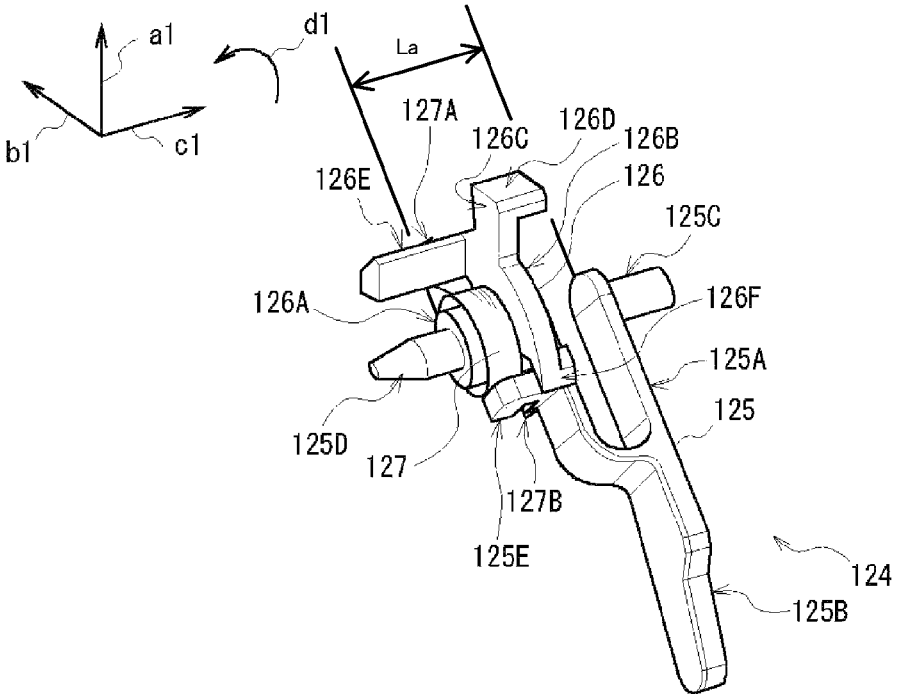

The shape of the detection lever varies under a condition where the angle and length maintain. As shown in FIG. 4B, it is not necessary for the detection lever 125 to be in a straight plate shape. An extending line of the lever body 125*b* including the front end does not necessarily pass through the rotation axis. In order to enlarge the angle θx1, the shape of the lever body 125*b* may be one that bends the front end downwardly. Alternatively, a curved shape is also practical. Further, the detection lever may be configured with multiple parts. As shown in FIG. 16 to FIG. 18C, it may include the rotation axis Ax21 and rotation axis Ax22. In such a configuration, the front end Cx of the lever body 162 is preferred within 135 degrees to 165 degrees (θx1) with respect to the rotation axis Ax21 at the non load detection position, preferred within 90 degrees to 180 degrees with respect to the rotation axis Ax22. Also, at the retreat position, the front end Cx of the lever body 162 is preferred within 165 degrees to 270 degrees with respect to the rotation axis Ax21, and preferred within 180 degrees to 270 degrees with respect to the rotation axis Ax22 (θx2).

(Outline of Structure)

The application discloses a sheet detection part used with a sheet tray on which sheets are loaded in an image forming apparatus, the sheet tray being able to be pulled out and contained with respect to the image forming apparatus. The sheet detection part is configured with three components below:

(1) a lever support part (123, 161J)

(2) a detection lever (120, 160) that is rotatably installed to the lever support part (3) a sensor that senses a position of the detection lever in correspondence with a rotation of a body holding part that is a part of the detection lever.

The detection lever is configured at least with a lever body (125, 162) and body holding part (126, 161).

The lever body is positioned at a front end of the detection lever, is rotatable around a rotation axis (Ax1, Ax21) with respect to the lever support part, a front end (Cx) of the lever body contacts the sheets when the sheets that are improperly loaded are pulled out. The lever body is able to rotate between a load detection position and a retreat position through a non-load detection position with respect to the rotation axis. The non-load detection position means a state that the lever body is not in contact with the sheets. The load detection position means a state that the lever body is in contact with the sheets and was moved in a forward direction from the non-load detection position. Assuming that a pulling out direction of the sheet tray is a horizontal direction (90 degrees to 270 degrees), the load detection position is in the fourth quadrant of rectangular coordinate with respect to the rotation axis (Ax1, Ax21) of the detection lever. The retreat position means a state that the lever body was rotated in a backward rotation direction from the non-load detection position by being pushed in the pulling out direction (b1) with the loaded sheets. The retreat position is in the third quadrant of rectangular coordinate with respect to the rotation axis (Ax1, Ax22) of the lever body. The body holding part (126, 161) is rotatable around the rotation axis (Ax1, Ax21) with respect to the lever support part, is given a bias force toward the lever body so that the body holding part rotates between the load detection position and the non-load detection position together with the lever body (or synchronously rotates). On the other hand, the backward rotation of the body holding part was restricted at the non-load detection position so that the body holding part does not rotate further from the non-load detection position. With the configuration above, when proper sized sheets are loaded on the sheet tray, the loaded sheets move the lever body and the body holding parts in the forward rotation direction from the non-load detection position to the load detection position. The sensor senses the rotation of the body holding part, determining that the sheets are loaded (or loaded state). When sheets are loaded on the sheet tray, but are not in contact with the lever body because the size of the sheets is too small, the lever body remains at the non-load detection position. When the sheet tray is pulled out in the state, the loaded sheets push the lever body in the pulling out direction (b1) so that the lever body rotates in the backward rotation direction from the non-load detection position to the retreat position. However, the body holding part does not rotate backwardly (or does not follow the lever body) but remains at the non-load detection position. Thereby, the sensor maintains the state that sheets are not loaded. The lever body can travel to the retreat position, preventing the loaded sheets from being damaged. Also, it is also possible to prevent the detection lever from being damaged.

INDUSTRIAL UTILITY

The present invention is applicable to medium feeding devices that feed media such as recording sheets, postcards and tickets, and to image forming apparatuses such as a color printer, a printer for black-and-white printing, an inkjet printer, a multifunction printer, a facsimile, and a multifunction machine.

What is claimed is:

1. A medium feeding device, comprising:

a device body;

a roller that is provided at the device body and that feeds media;

a tray that is provided in a manner capable of being pulled out from and inserted into the device body and that faces the roller in a state in which the tray is inserted into the device body;

a detection part that detects presence of the media loaded in the tray; and a bias part that is provided at the detection part, wherein the detection part comprises:

a detection lever that includes a lever body and a body holding part, the lever body having a first engagement part, the body holding part having a second engagement part that engages with the first engagement part and a light blocking part, the detection lever being rotated by contacting the media; and a sensor part that detects the light blocking part, the lever body and the body holding part are rotatable about a common rotational axis, the bias part biases the lever body in a first direction in which the first engagement part of the lever body engages with the second engagement part of the body holding part, when the tray is inserted into the device body and when the media are loaded in the tray so that the media are feedable by the roller, the lever body and the body holding part are rotatable together about the common rotational axis while the first engagement part of the lever body and the second engagement part of the body holding part are engaged with each other by the bias part, and the light-blocking part is in a position away from the sensor part such that the sensor part does not detect the light blocking part, and when a pressing force is applied to the lever body in a second direction that is opposite from the first direction, the engagement between the first engagement part of the lever body and the second engagement part of the body holding part is released against a bias force of the bias part, and the lever body rotates about the common rotational axis in the second direction while the rotation of the body holding part is restricted and the light blocking part blocks the sensor part such that the sensor part detects the light blocking part.

2. The medium feeding device according to claim 1, wherein in the state in which the tray is inserted into the device body, when the media are not properly loaded in the tray, the body holding part and the lever body are combined by the bias part, and the lever body, with a front end part of the lever body being oriented toward a tray inserting side, rotates to a non-load detection position; when the media are properly loaded in the tray, the body holding part and the lever body are combined by the bias part, and the lever body, with the front end part being oriented toward the tray inserting side, rotates to the load detection position; and, when the pressing force is applied to the lever body at the non-load detection position from the tray inserting side, the lever body solely retreats toward the tray pulling out side.

3. The medium feeding device according to claim 1, further comprising:

a rotation regulation part that restricts the rotation of the body holding part when the lever body moves to a non-load detection position or when the pressing force is applied to the lever body in the second direction.

4. The medium feeding device according to claim 3, wherein that the rotation regulation part stops further rotation of the detection lever when the detection lever rotates to the non-load detection position in a state in which the lever base part and the lever front end part are combined by the bias part.

5. The medium feeding device according to claim 3, wherein the tray comprises a lifting part, wherein one end portion of the loaded media is placed on an end part of the lifting part on the tray pulling out side, when the tray is inserted into the device body, the one end portion of the media is obliquely lifted, and when the tray is pulled out from the device body, the one end portion of the media is gradually lowered.

6. The medium feeding device according to claim 5, wherein the sensor part includes:

a light emitting element that emits detection light; and a light receiving element that receives the detection light emitted from the light emitting element, and when the detection lever rotates to the non-load detection position, the light blocking part of the body holding part is inserted from the tray pulling out side into between the light emitting element and the light receiving element to block the detection light.

7. The medium feeding device according to claim 6, comprising:

a light blocking position regulation part that is provided on the light blocking part regulates a light blocking position of the detection light by the light blocking part between the light emitting element and the light receiving element.

8. The medium feeding device according to claim 7, wherein the light receiving element lowers a signal level of a detection signal when the detection light is received and raises the signal level when the detection light is not received, the detection signal indicating with the signal level whether or not the detection light is received.

9. The medium feeding device according to claim 4, wherein the tray comprises a lifting part, wherein one end portion of the loaded media is placed on an end part of the lifting part on the tray pulling out side, when the tray is inserted into the device body, the one end portion of the media is obliquely lifted, and when the tray is pulled out from the device body, the one end portion of the media is gradually lowered.

10. The medium feeding device according to claim 1, wherein the roller faces a separation part separates the media for feeding individually, and the lever body includes a common rotation shaft defining the common rotational axis, about which the detection lever rotates, is positioned further towards a back side of the device body in a tray insertion direction than a rotation shaft of the sheet feeding roller.

11. The medium feeding device according to claim 1, further comprising:

a guide part that regulates a position of the media loaded in the tray; and a roller rotation shaft on and about which the roller is rotated, the roller rotation shaft being arranged at a position different from a position of a common rotation shaft that defines the common rotational axis, wherein the lever body includes the common rotation shaft;

the roller rotation shaft is positioned at a downstream side of the position of the common rotation shaft in a medium carrying direction and at a position higher than the media loaded in the tray, and the guide part is positioned at an upstream side of the position of the common in the medium carrying direction.

12. The medium feeding device according to claim 1, wherein the lever body includes:

a common rotational shaft that defines the common rotational axis, a first side surface on which a first shaft is arranged as a first part of the common rotation shaft, a second side surface opposite on which a second shaft that extends in an opposite direction from the first shaft is arranged as a second part of the common rotation shaft, and a lever front end part that is connected to the first shaft and the second shaft and that contacts the media, the lever body has a space between the first shaft and the second shaft, the space between the first shaft and the second shaft formed on the lever body has a U-shaped part, and the lever front end part is formed closer to the second shaft than the first shaft.

13. The medium feeding device according to claim 12, wherein the body holding part includes a shaft insertion part into which the first shaft is inserted and from which the first shaft protrudes, and the bias part includes a torsion spring into which the shaft insertion part is inserted and which is disposed outside the shaft insertion part.

14. The medium feeding device according to claim 13, wherein the first shaft includes a tapered end part in a section protruding from the shaft insertion part.

15. A medium feeding device, comprising:

a device body;

a tray that is provided in a manner capable of being pulled out from and contained in the device body, and in which a plurality of kinds of media of different sizes are loaded in a loading area according to the sizes of the media;

a sheet feeding roller that is arranged to face a separation roller and that feeds the media loaded in the tray;

a detection lever that is provided in a moveable manner above a loading space in the tray in which the media is stackable and loadable and adjacent to an end part of the media on a tray pulling out side of the tray in the device body for detecting whether or not the media are properly loaded in the tray; and a sensor part that detects the detection lever, wherein, the detection lever includes:

a lever body that has a first shaft and an end part that contacts the media and that rotates about the first shaft depending on presence of the contacted media;

a body holding part that is rotatably mounted on the first shaft of the lever body so as to rotate about the first shaft and that has a sensed object, an engagement part engaging with the lever body, and a stopper regulating a rotation range of the body holding part and regulating a movable range of the sensed object; and a bias part that is mounted on the first shaft of the lever body and that applies a rotational bias force to the lever body with respect to the body holding part so as to rotate about the first shaft in a direction in which the lever body and the engagement part on the body holding part approach each other, in a state in which the tray is contained in the device body, when the media are not properly loaded in the tray, with a front end part of the lever body being oriented toward a tray containing side of the tray, the lever body of the detection lever rotates about the first shaft to a non-load detection position for detecting that the media are not properly loaded in the tray, and the body holding part of the detection lever rotates about the first shaft so as to move the sensed object of the body holding part to the non-load detection position in a state in which the lever body and the engagement part contact each other;

when the media are properly loaded in the tray, with the front end part of the lever body being oriented toward the tray containing side, the lever body of the detection lever rotates about the first shaft to a load detection position for detecting that the media are properly loaded in the tray, and the body holding part of the detection lever rotates about the first shaft so as to move the sensed object of the body holding part to the load detection position in a state in which the lever body and the engagement part contact each other; and when a pressing force is applied to the lever body at the non-load detection position from the tray containing side, the lever body rotates about the first shaft in a direction opposite to a rotation direction in which the body holding part is to approach the sensor part while resisting the bias force of the bias part, the lever body and the engagement part are separated from each other, and the lever body rotates about the first shaft to retreat toward the tray pulling out side while the sensed object of the body holding part is maintained at the non-load detection position, the medium feeding device further comprises a lifting part for lifting up the media, the lever body detects the media lifted by the lifting part in a state in which a plurality of media are loaded between the first shaft and the lifting part, the lever body includes:

a second shaft that is positioned on a side of the lever body opposite from the side on which the first shaft is positioned; and the lever front end part that is connected to the first shaft and the second shaft and that contacts the media, the lever body has a space between the first shaft and the second shaft, the space between the first shaft and the second shaft formed on the lever body has a U-shaped part, and the lever front end part is formed closer to the second shaft than the first shaft.

16. The medium feeding device according to claim 15, wherein the body holding part includes a shaft insertion part into which the first shaft is inserted and from which the first shaft protrudes, and the bias part includes a torsion spring into which the shaft insertion part is inserted and which is disposed outside the shaft insertion part.

17. The medium feeding device according to claim 16, wherein the first shaft includes a tapered end part in a section protruding from the shaft insertion part.

18. A medium feeding device, comprising:

a device body;

a roller that is provided at the device body and that feeds media;

a tray that is provided in a manner capable of being pulled out from and inserted into the device body and that faces the roller in a state in which the tray is inserted into the device body;

a detection part that detects presence of the media loaded in the tray; and a bias part that is provided at the detection part, wherein the detection part comprises:

a detection lever that includes a lever body having a first engagement part and a body holding part having a second engagement part that engages with the first engagement part, the lever body including a first projection integrally formed on a first side surface of the lever body, a second projection integrally formed on a second side surface of the lever body opposite from the first side surface and a space between the first projection and the second projection, the first and second projections extending from the lever body in opposite directions, the detection lever being rotated about the first and second projections functioning as a common rotation shaft by contacting the media; and a sensor part that detects a change in a loading state of the media based on a rotational operation of the detection lever, the lever body and the body holding part are arranged on and rotatably about the common rotation shaft, the bias part biases the lever body in a first direction in which the first engagement part of the lever body engages with the second engagement part of the body holding part, when the tray is inserted into the device body and when the media are loaded in the tray so that the media are fed by the roller, the lever body and the body holding part rotate together about the common rotation shaft while the first engagement part of the lever body and the second engagement part of the body holding part are engaged with each other by the bias part, and when a pressing force is applied to the lever body in a second direction that is opposite from the first direction, the engagement between the first engagement part of the lever body and the second engagement part of the body holding part is released against a bias force of the bias part, and the lever body rotates about the common rotation shaft in the second direction while the rotation of the body holding part is restricted.

* * * * *